US007251596B2

(12) United States Patent
Zhu et al.

(10) Patent No.: US 7,251,596 B2
(45) Date of Patent: Jul. 31, 2007

(54) METHOD AND DEVICE FOR ANALYZING A WAVE SIGNAL AND METHOD AND APPARATUS FOR PITCH DETECTION

(75) Inventors: Lianshan Zhu, Beijing (CN); Tao Yu, Beijing (CN)

(73) Assignee: Canon Kabushiki Kaisha, Tokyo (JP)

( * ) Notice: Subject to any disclaimer, the term of this patent is extended or adjusted under 35 U.S.C. 154(b) by 949 days.

(21) Appl. No.: 10/326,104

(22) Filed: Dec. 23, 2002

(65) Prior Publication Data

US 2003/0171917 A1 Sep. 11, 2003

(30) Foreign Application Priority Data

Dec. 31, 2001 (CN) ..... 01 1 45305

(51) Int. Cl.
*G10L 11/00* (2006.01)

(52) U.S. Cl. ..... 704/203; 704/211; 600/494

(58) Field of Classification Search ..... None
See application file for complete search history.

(56) References Cited

U.S. PATENT DOCUMENTS

| | | | | |
|---|---|---|---|---|
| 4,360,029 | A * | 11/1982 | Ramsey, III | 600/494 |
| 5,340,090 | A * | 8/1994 | Orme et al. | 266/202 |
| 5,536,902 | A * | 7/1996 | Serra et al. | 84/623 |
| 5,606,977 | A * | 3/1997 | Ramsey et al. | 600/494 |
| 6,259,014 | B1 * | 7/2001 | Qian et al. | 84/625 |
| 6,332,867 | B1 * | 12/2001 | Chen et al. | 600/300 |

OTHER PUBLICATIONS

Claudio Becchetti, et al., "Speech Recognition, Theory and C++Implementation", pp. 121-166, John Widely & Son Ltd., Reprinted Aug. 1999, ISBN 0-471-97730-6.

Albert S. Bregman, "Auditory Scene Analysis", pp. 528-594, Second MIT Press paperback edition, 1999, ISBN 0-262-52195-4.

Daniel Jurafsky, et al., "Speech and Language Processing", pp. 258-267, Publisher: Alan Apt, 2000, ISBN 0-13-095069-6.

M.R. Schroeder, "Computer Speech", pp. 41-63 and 135-161, Springer-Verlag Berlin Heidelberg 1999 printed in Germany, ISBN 3-540-64397-4.

Weihua Zhang and W. Harvey Holmes, "Performance and Optimization of the Seevoc Algorithm", School of Electrical Engineering, The University of New South Wales, Sydney 2052, Australia.

Hynek Hermansky, "Should Recognizers Have Ears?", Oregon Graduate Institute of Science & Technology, Portland, Oregon and International Computer Science Institute, Berkeley, California.

Ted Painter and Andreas Spanias, "A Review of Algorithms for Perceptual Coding of Digital Audio Signals", Department of Electrical Engineering, Telecommunications Research Center, Arizona State University, Tempe, Arizona, pp. 1-30.

Carlos Avendaño, "Temporal Processing of Speech in a Time-Feature Space", Ph.D. Thesis, Oregon Graduate Institute, pp. 1-11 (Apr. 1997).

* cited by examiner

*Primary Examiner*—Donald L. Storm
(74) *Attorney, Agent, or Firm*—Fitzpatrick, Cella, Harper & Scinto

(57) ABSTRACT

The present invention provides a unique wave-trigon transformation (WTT) method for performing transformation process over a wave signal. The present invention also provides a pitch detecting method and apparatus for detecting pitch based on the WTT process as well as a sentence detecting method and apparatus for detecting a sentence in a sound signal based on the WTT process. The pitch detecting method and apparatus can effectively detect pitch in a sound signal. In the WTT process, an inputted wave signal (such as a sound signal) is transformed into a series of trigons, and an energy-width spectrum is formed using these trigons. For a sound signal containing voice, the distribution of trigons transformed from the sound signal has a certain pattern. By analyzing the pattern, whether a pitch is contained in the sound signal can be determined. In particular, existence of a pitch can be determined by determining and evaluating the periodicity of trigons in a candidate chained peak in the energy-width spectrum.

30 Claims, 39 Drawing Sheets

*Note: The Projective-height can be positive or negative*

*Note: The Projective-height can be positive or negative*

This is a piece of time-energy curve (wave) taken from a man's vowel 'u'

Vowel having narrow but very high small-segments, such as: 'a'

METHOD AND DEVICE FOR ANALYZING A WAVE SIGNAL AND METHOD AND APPARATUS FOR PITCH DETECTION

FIELD OF THE INVENTION

The present invention relates to a method and a device for analyzing a wave signal and its application on pitch detection. In addition, the present invention relates to a system a method for detecting a pitch in sound. Also, the present invention relates to an apparatus and method for detecting a sentence in a sound signal.

BACKGROUND OF THE INVENTION

Any sound can be decomposed into a set of simple oscillations. Theses simple oscillations have a frequency spectrum and time distribution pattern.

A most commonly used method of wave analyzing is Fourier Time-Frequency Transformation (FTT). However, FTT has its limitation when being used in harmonious sound analysis and pitch detection.

Harmonious sound is key to sound perception of human beings. It includes the sound of the vowels of human's speech, human's singing, birdcalls, most of animals' roars, and most of music. Harmonious sound not only is pleased to be heard but also carries rich information for us.

FIG. 11 shows, as a time-energy curve, an example of a piece of harmonious sound, which is taken from a man's sound of the vowel "u".

Another way of analyzing and describing a piece of sound, as opposed to the way as shown in FIG. 11 of using its time-energy curve, is using its frequency-energy spectrum, as obtained from its time-energy curve using FTT. The frequency spectrum of a harmonious sound features in that it comprises a number of narrow peaks. This means that a very large percentage of the total energy of the harmonious sound concentrates on the frequencies corresponding to these peaks. Moreover, the peak pattern of the spectrum of a harmonious sound is relatively stable during a short period of time. In other words, its main frequency components keep stable both in frequency and energy. If the peak pattern of the spectrum of a sound changes rapidly, then the spectrum does not correspond to a harmonious sound but corresponds to a noise or plosive.

Since the frequency spectrum of a harmonious sound needs to be obtained from a piece of sound (for example from a FTT window), it represents the global feature of this piece of sound. This means it is difficult for a frequency spectrum to allow us to examine more detailed features of this piece of sound, and the ability to detect and measure a sound with rapid change, such as a plosive, is therefore limited.

The time-energy curve (wave) of a harmonious sound has the following features:

1) First, a harmonious sound can be divided into sections nearly equal to one another, as shown in FIG. 12. Here, "nearly" means not exactly equal, thus we say that a harmonious sound has "pseudo" periodicity. The shortest of these sections is called "pitch", which is the basic tone of the harmonious sound. So a harmonious sound is also called a "pitched sound". If the pitches in a piece of sound are exactly equal to one another (that is, in the frequency spectrum, all the energy of the sound are in the peak frequencies and all the peaks have the width of zero), the sound will become non-euphonious, dull and unclear. This shows that the "pseudo periodicity" or small changes among pitches, which seem random, are not meaningless, rather, they are important for our hearing perception as they make harmonious sound such as a vowel of human speech more standing out from its background sound and noise.

2) The pitch frequency of a normal human speech is limited in a range, as a range between a minimum pitch frequency and a maximum pitch frequency.

3) A harmonious sound should have enough duration. For example, a vowel of human speech should have duration of, for example, at least five of its pitches.

4) A harmonious sound in human speech should have an energy that is higher enough than its surrounding sound. For example, the sound energy of a vowel of human speech is higher than its neighboring consonant (fricative, plosive, nasal, etc.)

Some of these features are also used in the harmonious sound detection and pitch detection method of the present invention.

Detection of pitches in human voice is of great importance in speech recognition.

For harmonious sound detection and pitch detection, the inventors of the present invention tested a wave section comparison method, as described below.

Wave Section Comparison (WSC) Method

The WSC method uses the original wave stream as input data. First, it splits the wave stream into small sections by, for example, zero-crossing points. Then, it compares the current section to a neighboring section, which has nearly the same width as that of the current small section, as shown in FIGS. 13(*a*) and (*b*). On the basis of such comparisons, harmonious sound is detected using likelihood scoring, and the sections having the highest likelihood scoring is chosen as the pitch.

The section comparison is performed by calculating the dot-by-dot difference between the two sections.

The WSC method, however, has its problems, which affect the detection of pitch from a piece of sound signal. The problems include:

1) Lower Frequency Disturbing

When a vowel sound is coupled with a relatively strong oscillation of lower frequency, the result of the section comparison will be seriously affected, as shown by example in FIGS. 14(*a*)-14(*c*). From the example of FIGS. 14(*a*)-(*c*), it can be seen that the WSC method fails to detect the pitch because the section having a width W0 differs too much from its right neighbor section having width W1. Obviously, this big difference is caused by the lower frequency oscillation that is added to the original sound.

In practice, the AC power source often causes such a problem by adding its 50 Hz low frequency oscillation to the sound detected or recorded.

2) Double Pitch Width Error

Sometimes, two pitch sections are detected as one pitch, so that the pitch width detected is doubled. Sometimes, the pitch width is even tripled.

The example as shown in FIG. 14(*c*) is also an example of the double pitch width error problem, as shown in FIG. 15.

3) High and Narrow Small Section Shift Error

When a vowel sound is composed of some narrow but high small sections, and the positions of the narrow and high section in the a neighboring pitch section shifts, then the result of comparison will be seriously affected, as shown with the example of FIG. 16. This is because the difference between curves in the two sections near the peaks, shown as Pi and Pj in FIG. 16, is large due to the rapid change of the signal levels. The narrower the peaks are, the greater the error is.

SUMMARY OF THE INVENTION

The first object of the present invention is to provide a method using wave-trigon transformation (WTT) for analyzing a wave signal.

The second object of the present invention is to provide a device using WTT for analyzing a wave signal.

The third object of the present invention is to provide a method for detecting a pitch in a sound signal using WTT.

The fourth object of the present invention is to provide an apparatus for detecting a pitch in a sound signal using WTT.

The fifth object of the present invention is to provide a method for detecting a sentence in a sound signal.

The sixth object of the present invention is to provide an apparatus for detecting a sentence in a sound signal. In a first aspect of the present invention, a method for analyzing a wave signal is provided, comprising:

an acme detecting step for detecting a set of acmes of the waveform of the wave signal; and a trigon extracting step for extracting a set of trigons in accordance with the set of acmes detected by the acme detecting step.

In a second aspect of the present invention, a device for analyzing a wave signal is provided, comprising:

an acme detecting means for detecting a set of acmes of the waveform of the wave signal; and a trigon extracting means for extracting a set of trigons in accordance with the set of acmes detected by the acme detecting means.

In a third aspect of the present invention, a system for analyzing a wave signal is provided, comprising:

a signal detecting means for detecting the wave signal as an analog signal;

an analog/digital converting means for converting the analog wave signal into a digital wave signal;

an acme detecting means for detecting a set of acmes of the waveform of the digital wave signal; and a trigon extracting means for extracting a set of trigons in accordance with the set of acmes detected by the acme detecting means.

In a fourth aspect of the present invention, a system for analyzing a wave signal is provided, comprising:

signal reproducing means for reproducing the wave signal from a recording medium;

an acme detecting means for detecting a set of acmes of the waveform of the wave signal; and a trigon extracting means for extracting a set of trigons in accordance with the set of acmes detected by the acme detecting means.

In a fifth aspect of the present invention, a method for detecting pitch in a sound signal is provided, comprising:

a wave-trigon transformation (WTT) step for performing wave-trigon transformation on the sound signal;

an energy-width spectrum calculating step for calculating an energy-width spectrum of the sound signal;

a candidate chained peak determining step for determining a candidate chained peak on the basis of the energy-width spectrum calculated by said energy-width spectrum calculating step; and a periodicity determining and evaluating step for determining and evaluating the periodicity of the trigons in said candidate chained peak.

In a sixth aspect of the present invention, an apparatus for detecting pitch in a sound signal is provided, comprising:

a wave-trigon transformation (WTT) device for performing wave-trigon transformation on the sound signal;

an energy-width spectrum calculating means for calculating an energy-width spectrum of the sound signal;

a candidate chained peak determining means for determining a candidate chained peak on the basis of the energy-width spectrum calculated by said energy-width spectrum calculating means; and a periodicity determining and evaluating means for determining and evaluating the periodicity of the trigons in said candidate chained peak.

In a seventh aspect of the present invention, a method for detecting a sentence from a sound signal is provided, comprising:

a pitch-noise detecting step for detecting pitch segments, noise segments, and high-frequency segments contained in the sound signal;

a segment combining step for combining the pitch segments, noise segments, and high-frequency noise segments into a sequence of word segments and gaps;

a sentence gap determining step for determining a set of sentence gaps for defining a candidate sentence area between each pair of adjacent sentence gaps;

a sentence scoring step for calculating a score for each of the candidate sentence areas; and a sentence determining step for determining whether each of the candidate sentence areas is a sentence in accordance with the result of the sentence scoring step.

In an eighth aspect of the present invention, an apparatus for detecting a sentence from a sound signal is provided, comprising:

a pitch-noise detecting device for detecting pitch segments, noise segments, and high-frequency segments contained in the sound signal;

a segment combining means for combining the pitch segments, noise segments, and high-frequency noise segments into a sequence of word segments and gaps;

a sentence gap determining means for determining a set of sentence gaps for defining a candidate sentence area between each pair of adjacent sentence gaps;

a sentence scoring means for calculating a score for each of the candidate sentence areas; and a sentence determining means for determining whether each of the candidate sentence areas is a sentence in accordance with the result of the sentence scoring means.

BRIEF DESCRIPTION OF THE DRAWINGS

Other features, advantages, and embodiments of the present invention will become obvious from the detailed description of the preferred embodiments of the present invention given below with reference to accompany drawing. In the drawings:

FIG. 18 also shows, in the lower part thereof, the trigons extracted from this waveform using WTT;

DETAILED DESCRIPTION OF PREFERRED EMBODIMENT

Wave-Trigon Transformation (WTT)

Figure 1:
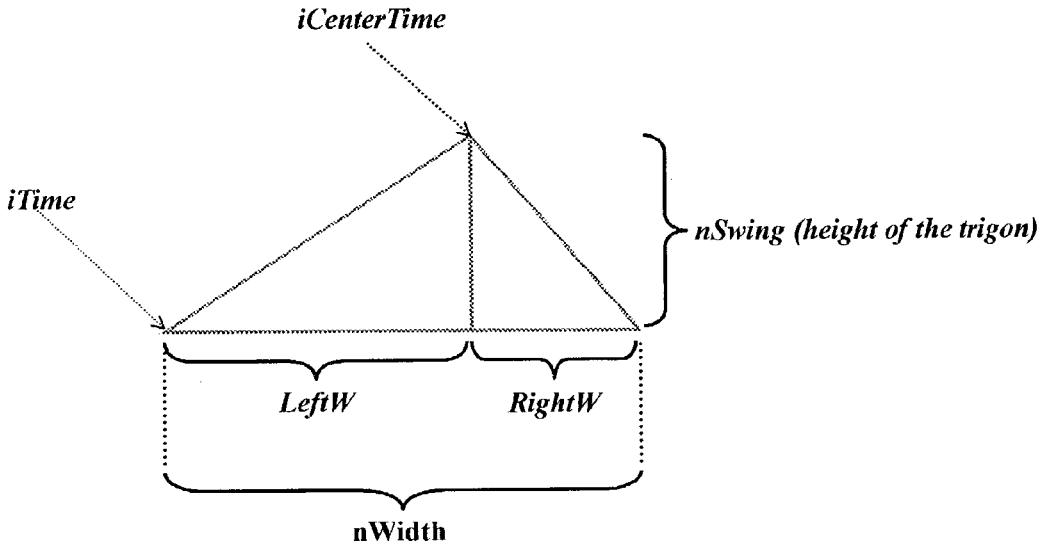
FIG. 1 is for explaining a trigon and its characterizing parameters.

A trigon is defined shown in FIG. 1. As can be seen from FIG. 1, a trigon has the following parameters:

- its beginning point or beginning time (iTime), which represents the time at which the trigon begins;
- its peak point (iCenterTime), representing the time of the peak of the trigon;
- its ending point or ending time, which represents the time at which the trigon ends;
- its height (nSwing), which represents the distance from the top point of the trigon to its base line, which is the line connecting the beginning point (iTime) and the ending point of the trigon; the height of a trigon (nSwing) can be either positive or negative;
- width (nWidth): which represents the period from the beginning time (iTime) to the ending time of the trigon.

To determine a trigon, only some of these parameters are needed. For example, for a trigon, if its beginning time (iTime), peak point (iCenterTime), height (nSwing), and ending time are known, then the trigon is determined. Equivalently, a trigon can also be determined with its beginning time (iTime), height (nSwing), peak point (iCenterTime), and width (nWidth); or with its height (nSwing), ending time, peak point and width (nWidth); etc.

Extracting Trigons from a Wave—Wave-Trigon Transformation (WTT)

Figure 5:
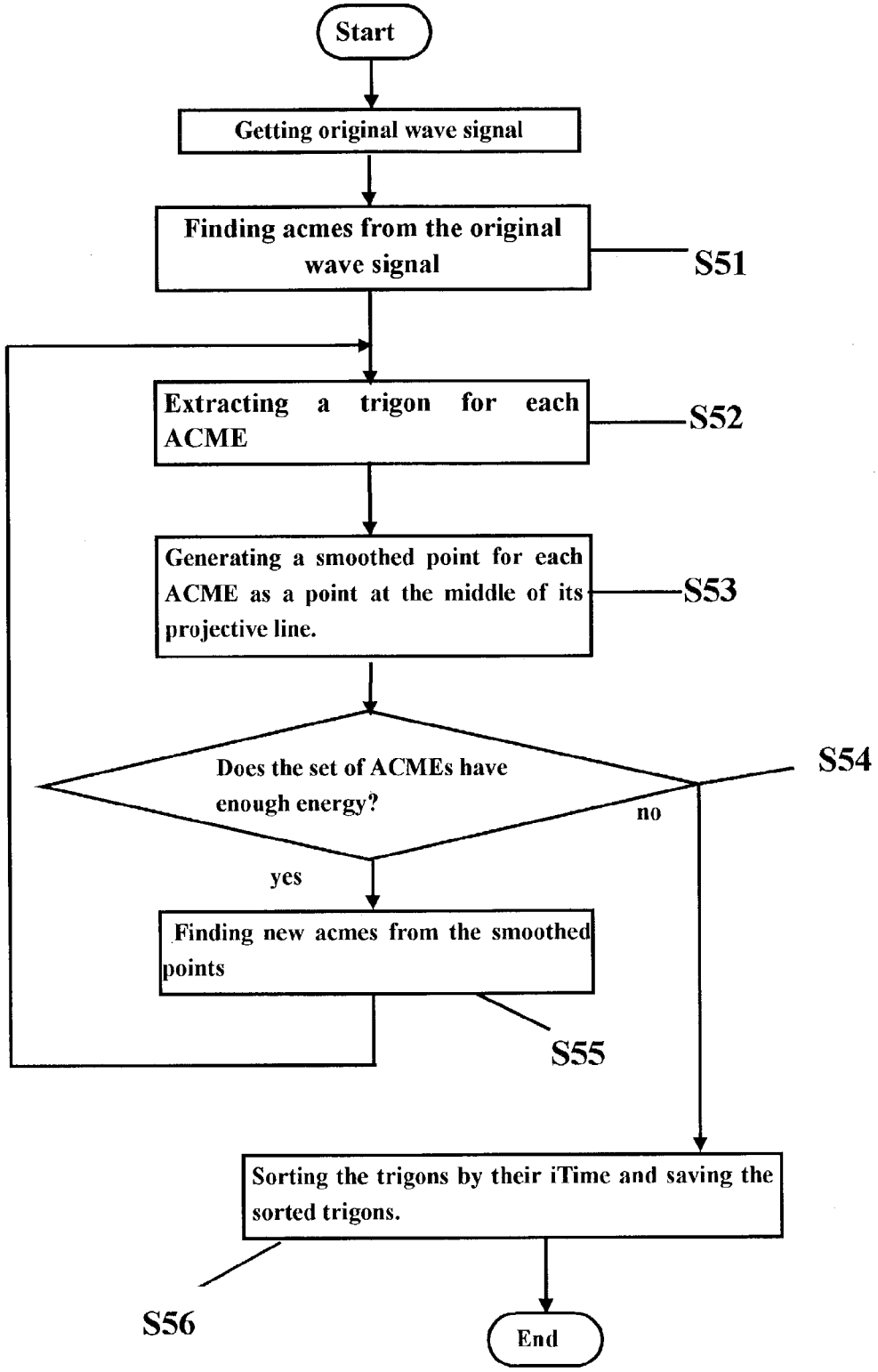
FIG. 5 shows a flowchart of a preferred embodiment of the WTT process for extracting trigons from a wave signal.

FIG. 5 shows an embodiment of the WTT process of the present invention, which includes the following steps:

Step S51: Detecting All Acmes of the Waveform Signal

Figure 2:
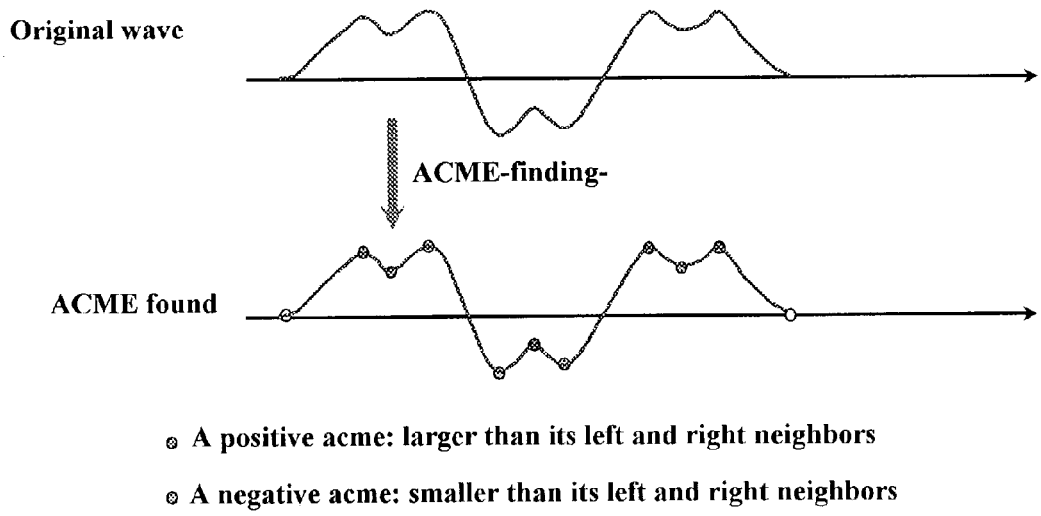
FIG. 2 shows an example of a piece of wave signal and its acmes.

FIG. 2 shows an example of waveform for illustrating the process of acme detection. There are two sorts of acmes: positive acmes and negative acmes. A positive acme of a curve is a point on the curve that is higher than all its neighboring points of the curve on both sides of the point; a negative acme is a point on the curve that is lower than all its neighboring points on both sides of the point. By "neighboring points" we mean the points that are close enough to the point concerned. Equivalently, we can define a positive (negative) acme as a point that is the highest (lowest) point in a range that includes the point.

Step S52: Extracting Trigons

Figure 3:
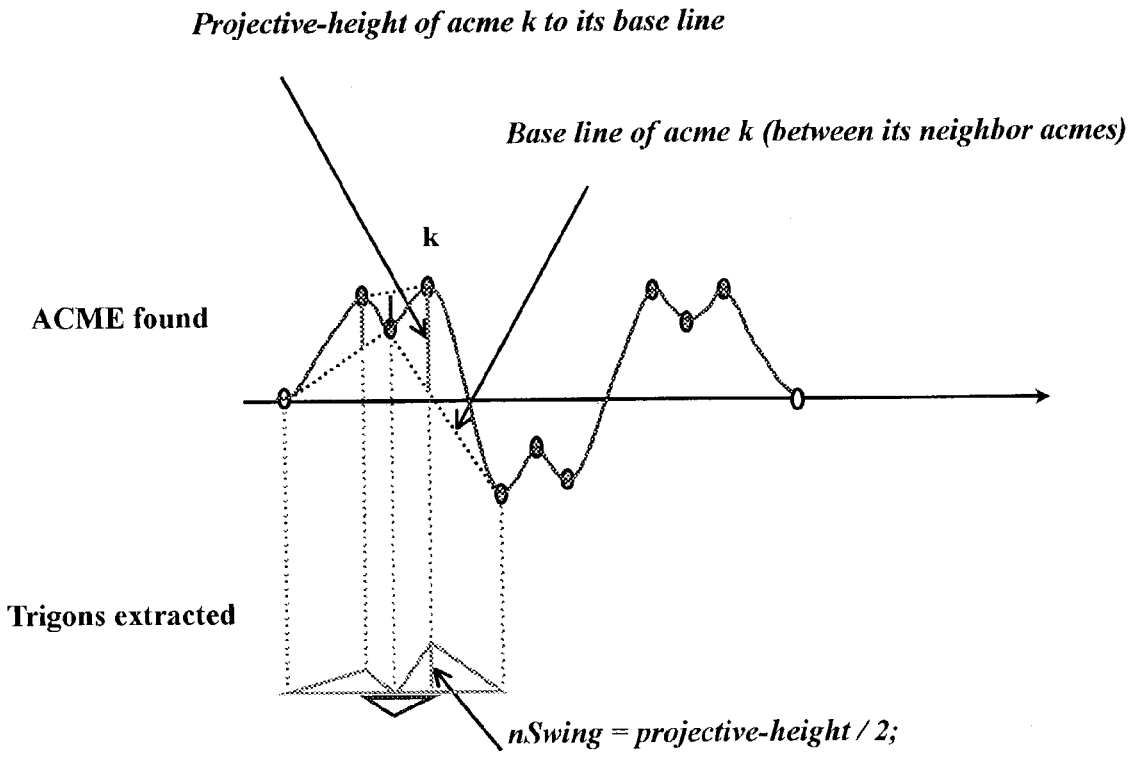
FIG. 3 is for explaining how to extract trigons from the wave signal.

FIG. 3 shows how trigons are extracted from a set of acmes. As shown in FIG. 3, for each acme a trigon is extracted. For a positive acme, for example acme k, a positive trigon is extracted. First, a projective height is calculated, which is length of the projective line from acme k to the line connecting its two adjacent acmes. Then, the trigon for the acme k is determined as having a height (nSwing)=one half of the projective height, a peak point at the time of the acme k, a beginning time (iTime) at its left adjacent acme (k'), and an end time at its right adjacent acme (k").

For a negative acme, for example acme k', its corresponding trigon can be similarly determined by detecting the projective height for acme k'; however, as acme k' is a negative acme, the projective height is a negative one, and the height of the trigon of acme k' is also negative.

Step S53: Generating Smoothed Points

Figure 4A:
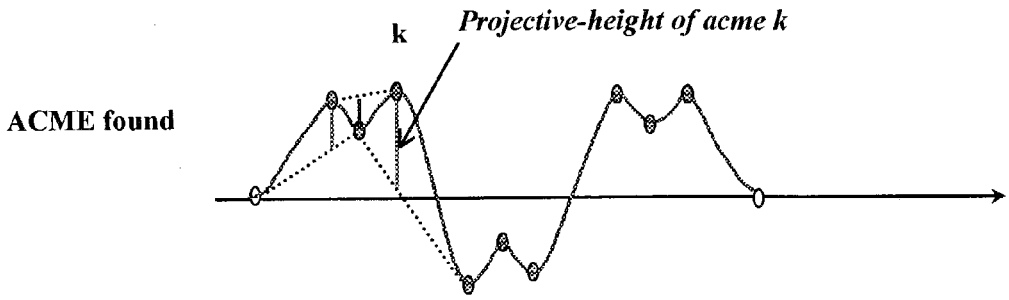
FIGS. 4(*a*)-4(*c*) are for explaining the process of generating smoothed points for the wave signal.
Figure 4B:
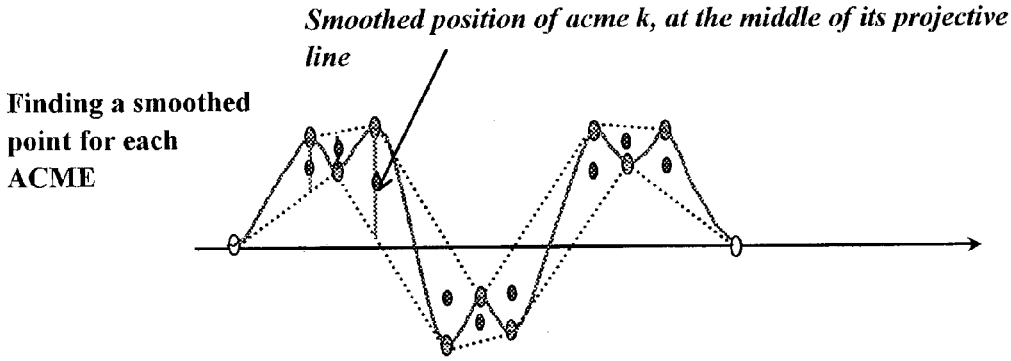
Figure 4C:
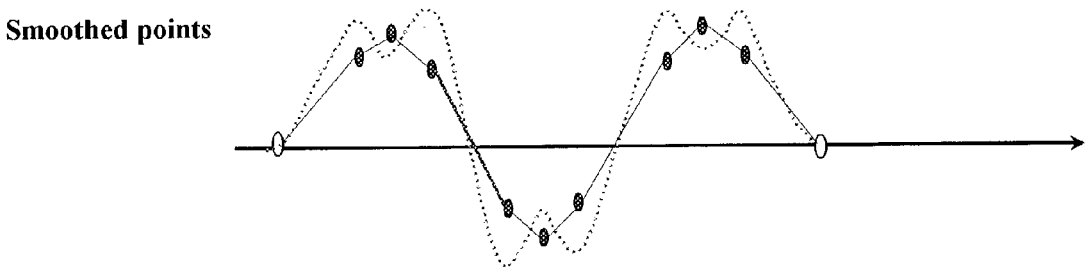

For each acme, a smoothed point is generated, which is at the center or middle point of the projective line of the acme, as shown in FIG. 4(*b*). The smoothed points of all the acmes correspond to a new and smoothed wave, as shown in FIG. 4(*c*).

Step S54: Determining if the Smoothed Points Correspond to a Wave with a Sufficiently High Energy The determination can be carried out in different ways. For example, In one embodiment of the present invention, the determination of energy level is performed by comparing the shortest width of a set of trigons extracted with a threshold for width and comparing and comparing the greatest height of the set of trigons with a threshold for height, The threshold for width may be set near the period of the longest sound wavelength (the lowest frequency) that an average human ear can hear.If the shortest or average width of the set of trigons is larger than the threshold for width, and the greatest height of the set of trigons is smaller than the threshold for height, then it is determined that the set of smoothed points generated after the extraction of the set of trigons do not correspond to a wave with a sufficiently high energy. The preferred range of the threshold for width is 140-180 samples (at a rate of 11025 samples/sec.), and in the present embodiment it is chosen as 160 samples. The preferred range of the threshold for height is 10-100 in a Wav file of PCM format, and it is chosen as 20 in the present embodiment.

The underlying reason for such an approach is that the energy of a harmonic wave is in proportional to the square of its frequency, and a usual wave can be the sum of a plurality of harmonic waves.

Alternatively, the shortest or average width of the trigons may be compared with another preset value to determine if the shortest or average width of the trigons is larger than the preset value. If "yes", then it is determined that the smoothed points do not correspond to a wave with a sufficiently high energy.

Upon determining that the smoothed points do not correspond to a wave with a sufficiently high energy, the WTT process terminates; the extracted trigons, for example, can be saved for future processing (step S56).

If, on the other hand, it is determined that the smoothed points correspond to a wave with a sufficiently high energy, the WTT process proceeds to step S55, where the smoothed points will be subjected to the next order of trigon extraction, as described below.

Step S55: Detecting Acmes Among the Smoothed Points

For the smoothed points, positive and negative acmes are detected, wherein a positive acme is a point that is higher than both of its adjacent smoothed points; a negative acme is a point that is lower than both of its adjacent smoothed points. If a smoothed point is higher (lower) than one of its adjacent smoothed points but is lower (higher) than the other of its adjacent smoothed points, then it is neither a positive acme nor a negative acme.

Then, steps S52 to S54 are repeated for the set of acmes thus determined among the smoothed points, and a $2^{nd}$ order trigon extraction is completed.

Figure 6:
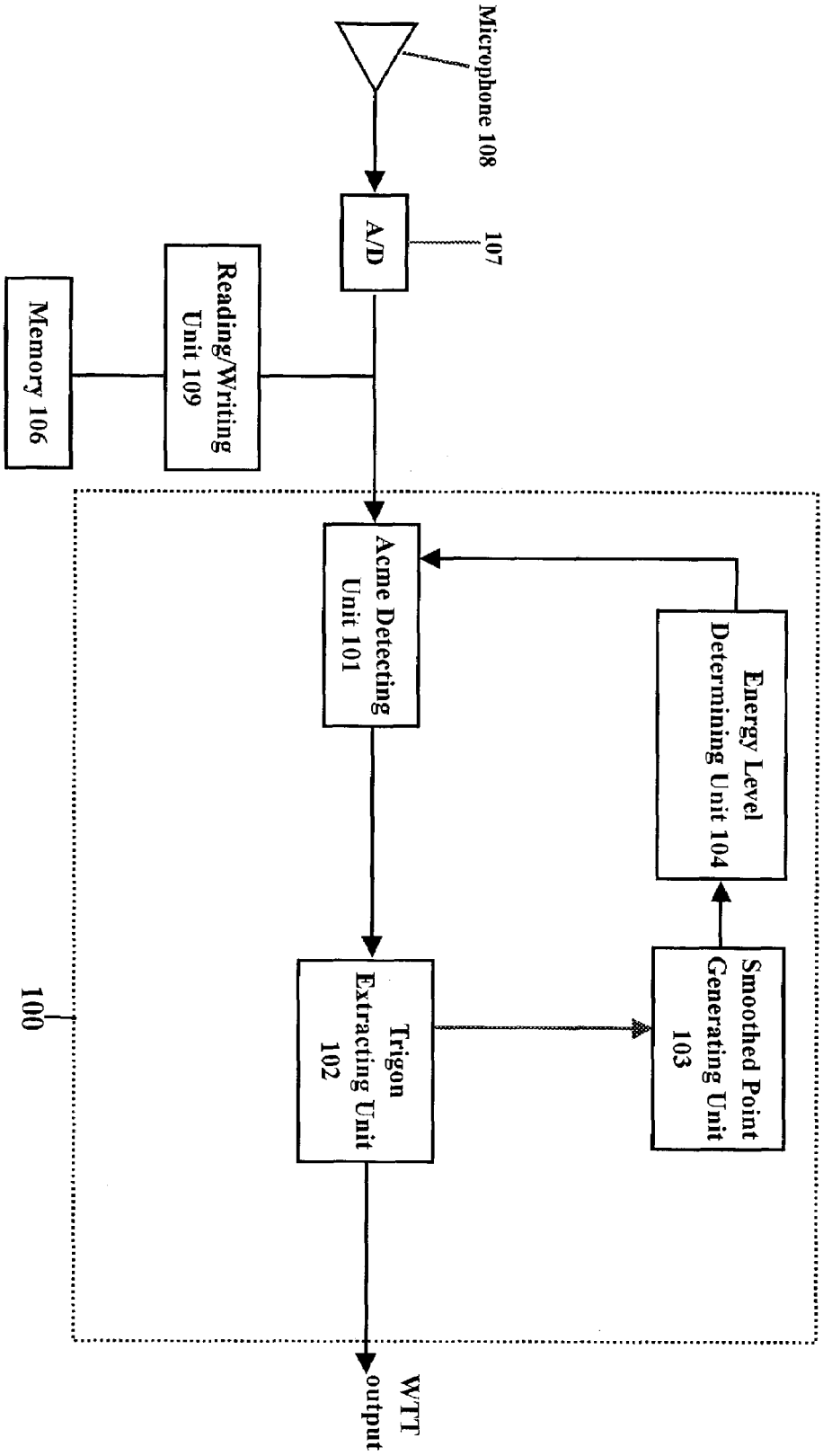
FIG. 6 shows the arrangement of a preferred embodiment of a WTT device of the present invention.

FIG. 6 shows the first embodiment of the wave-trigons transformation system (also referred to as "WTT system" hereinafter) of the present invention, which is suitable for performing trigon extraction on audio/sound signals. Operation of the wave-trigons transformation system of the present invention is described below with reference to the embodiment of FIG. 6.

As shown in FIG. 6, the wave-trigons transformation system of the present invention includes a wave-trigons transformation device (which is also referred to as "WTT device" hereinafter) 100. Sound, such as human voice (including vowel and consonant), singing sound, birdcall, animal's roar, music sound, natural sound, noise, etc. are converted into analog electric signal by a microphone 108. An A/D converter 107 receives the analog electric signal from the microphone 108 and converts the analog electric signal into digital signal. The digital signal from the A/D converter 107 is sent to acme detecting unit 101 or is stored in memory unit 106 through a reading/writing unit 109.

The memory unit 106 can be implemented with a hard disk, a floppy disk, a ROM, a magnetic tape, or any other suitable storing device.

The acme detecting unit 101 of wave-trigons transformation device 100 receives the digital signal from the A/D converter 107 or memory unit 106 via reading/writing unit 109 and detects the acmes of the digital signal received, as described above with reference to FIG. 2.

In actual applications, an input signal dividing unit and a section selecting unit may be arranged before the acme detecting unit. The input signal dividing unit divides the input signal into sections. The section selecting unit selects appropriate sections and sends them to the WTT device. For example, the section selecting unit may select those sections that have sufficient energy level, as described later in more detail.

On the basis of the acmes detected by the acme detecting unit 101, a trigon extracting unit 102 of the WTT device 100 of the present invention performs trigon extraction, as described above with reference to FIG. 3. The trigons extracted by the trigon extracting unit 102 may be stored in a trigon storing unit (not shown) or sent out as output of the WTT device 100 for further processing, such as pitch detection described later. The trigons, extracted directly from the digital signal, are hereinafter referred as "$1^{st}$ order trigons,".

Figure 8:
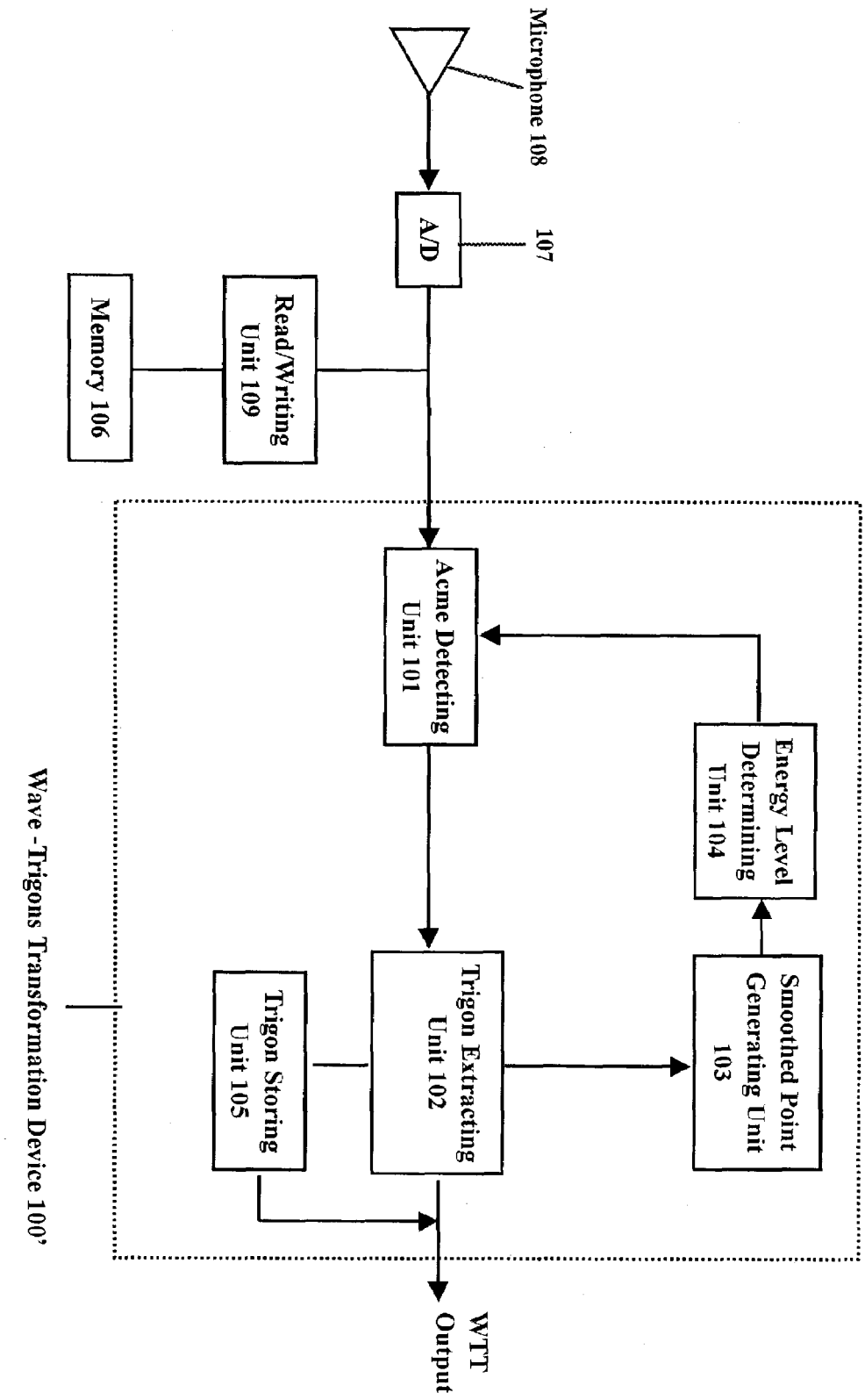
FIG. 8 shows the arrangement of another preferred embodiment of the WTT device of the present invention.

The extracted trigons can be sent out as the output of the WTT device 100 or be stored in a storing device, such as the trigon storing unit 105 shown in FIG. 8).

As described above, a trigon is featured by its beginning time (iTime), peak point (iCenterTime), ending time, and width (nWidth), etc. A trigon has a base line extending from its beginning time to its end time, and the base line is in parallel to the time axis. In other words, a trigon can be determined with its beginning time (iTime), height (nSwing), peak point (iCenterTime), and width (nWidth) (or equivalently, with its beginning time (iTime), height (nSwing), peak point (iCenterTime), and ending time; or with its height (nSwing), ending time, and width (nWidth); etc.) So the storing/retrieval of trigons, as one specific embodiment, may be realized by storing/retrieving the beginning time (iTime), height (nSwing), peak point (iCenterTime), and width (nWidth) etc. of the trigons.

Returning to FIG. 6, on the basis of the trigons extracted by the trigon extracting unit 102, a smoothed point generating unit 103 determines a smoothed point for each of the acmes detected by the acme detecting unit 101, as described above with reference to FIGS. 4(*a*) to 4(*c*). For each acme, a smoothed point is determined, which is the center or middle point of the projective line of the acme, as shown in FIG. 4(*b*). The smoothed points of all the acmes correspond to a new and smoothed wave, as shown in FIG. 4(*c*).

Thus, a set of smoothed points is generated for all the acmes of the digital signal. The set of smoothed points corresponds to a new waveform, which is smoothed as compared with the digital signal received by the acme detecting unit 101 from A/D converter 107 or reading/writing unit 109.

Then, an energy level determining unit 104 determines if the energy level of the waveform corresponding to the set of smoothed points is lower than a preset value.

The determination of the energy level can be realized in various ways. For example, it can be realized as described above with reference to step S54, and the energy level determining unit 104 can perform such a determination in various ways.

As an example, as one of these ways, the energy level determining unit 104 may calculate the shortest or average width of the trigons and compare the shortest or average width of the trigons with a preset threshold.

For example, for human sound process, the preset threshold may approximately correspond to the period of the longest sound wavelength (the lowest frequency) of the components in human voice.

If the energy level determining unit 104 determines that the shortest or average width of the trigons is larger than the preset value, then it is determined that the smoothed points do not correspond to a wave with a sufficiently high energy.

When the energy level determining unit 104 determines that the smoothed points do not correspond to a wave with a sufficiently high energy, the WTT device 100 terminates the WTT extraction process.

On the other hand, if the energy level determining unit 104 determines that the smoothed points correspond to a wave with a sufficiently high energy, the acme detecting unit 101 performs acme detection on the entire set of smoothed points and obtains a $2^{nd}$ set of acmes from the set of smoothed points, and the trigon extracting unit 102 performs trigon extraction on the basis of the acmes detected by the acme detecting unit 101 from the set of smoothed points. That is, the WTT device 100 performs the $2^{nd}$ order of trigon extraction over the set of smoothed points, and a set of $2^{nd}$ order trigons are extracted and sent out as output of the WTT device.

The trigons of the $2^{nd}$ order extracted by the trigon extracting unit 102, like the trigons of the $1^{st}$ order, may be stored in a trigon storing unit (such as the trigon storing unit 105 in FIG. 8) or sent out as output of the WTT device 100 for further processing, such as pitch detection described later.

After the $2^{nd}$ order of trigon extraction, a next set ($2^{nd}$ set) of smoothed points are generated by the smoothed point generating unit 103 for each of the acmes, for which a trigon has been extracted, and the energy level determining unit 104 determines whether the energy level of the wave corresponding to the $2^{nd}$ set of smoothed points is greater than the preset threshold. And if the result of the determination is YES, the WTT process carried out by the acme detecting unit 101, the trigon extracting unit 102, and the smoothed points generating unit 103 will be repeated; if NOT, then the WTT process terminates.

In this way, trigons of $1^{st}$, $2^{nd}$, $3^{rd}$, . . . orders are extracted, until the energy level determining unit 104 determines that a set of smoothed points does not correspond to a high-enough energy level.

Figure 7:
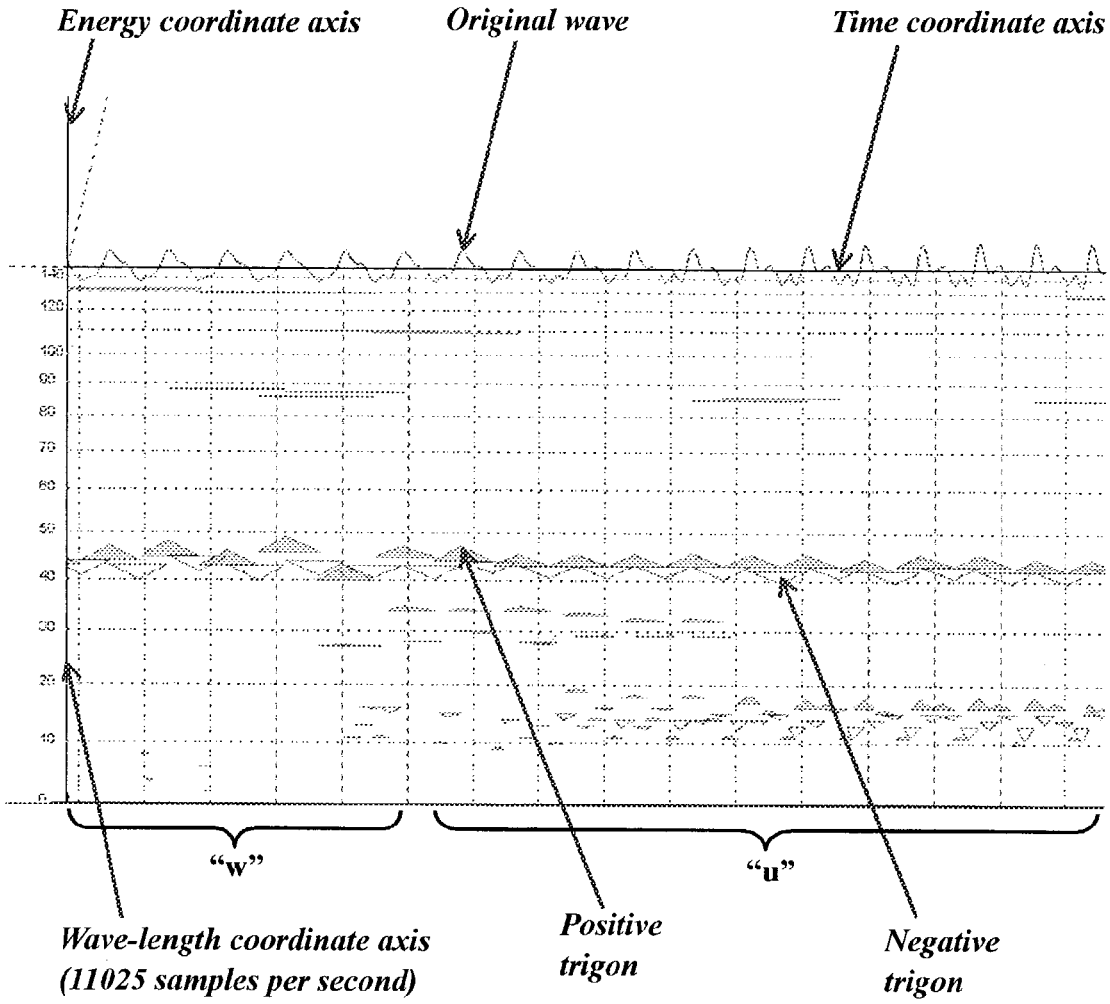
FIG. 7 is an energy/width-time chart showing the trigons extracted from a sound signal using the WTT method of the present invention.

FIG. 7 shows an example of the result of WTT process, in which WTT is applied to a piece of sound wave of the sound "wu" pronounced by a Japanese woman.

In the upper portion of FIG. 7, the original sound wave is shown, with the horizontal axis representing time and the vertical axis representing energy.

In the lower portion of FIG. 7, trigons extracted from the sound wave are shown. Note that for the lower portion of FIG. 7 the vertical axis represents both the energy and the width of the trigons, that is, the position of the base line of a trigon in the vertical direction represents to the width of the trigon, while the height of the trigon, i.e. the distance from the peak point of a trigon to its base line, corresponds to energy of the trigon, so the baselines of trigons having the same width appears on the same height in the lower portion of FIG. 7.

FIG. 8 shows another embodiment of the WTT system of the present invention. As shown in FIG. 8, the embodiment of WTT system includes a WTT device 100', which is the same as the WTT device of the first embodiment as shown in FIG. 6 except that the energy level determining unit 104 of WTT device 100' is arranged before the smoothed point generating unit 103. In addition, a trigon storing unit 105 is shown in FIG. 8 for storing the extracted trigons.

During the WTT process of the WTT device 100', after the trigon extracting unit 102 performs trigon extraction, the energy level determining unit 104 estimates the energy level represented by the smoothed pointed to be generated by smoothed point generating unit 103. As a specific embodiment, the energy level determining unit 104 calculates the shortest or average width of the trigons and compares the shortest or average width of the trigons with a preset threshold. For human sound process, the preset threshold may correspond to, for example, the period of the longest sound wavelength (the lowest frequency) that an average human ear can hear.

If the energy level determining unit 104 determines that the shortest or average width of the trigons is equal to or larger than the preset threshold, then it is determined that the energy level represented by the smoothed points to be generated by the smoothed point generating unit 103 is not great enough, and the WTT process terminates.

On the other hand, if the energy level determining unit 104 determines that the shortest or average width of the trigons is smaller than the preset threshold, then the WTT process continues in order to extract trigons of the next order; the smoothed point generating unit 103 generates a smoothed point for each acme, for which a trigon has been extracted by the trigon extracting unit 102, so as to obtain a set of smoothed points; and, the acme detecting unit 101 performs acme detection over the set of smoothed points. After that, the trigon extracting unit 102 extracts trigons of the next order over the set of smoothed points. The extracted trigons can be sent out as the output of the WTT device 100' or be stored in the trigon storing unit 105.

Figure 9:
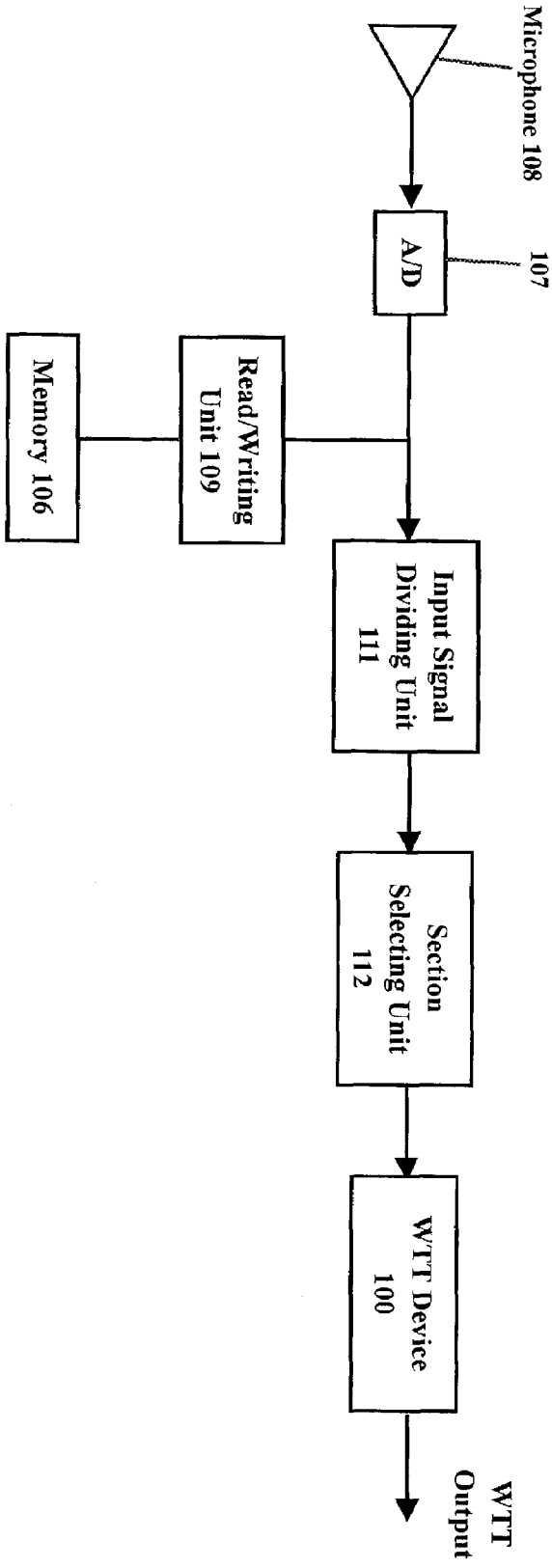
FIG. 9 shows the arrangement of a preferred embodiment of a WTT system of the present invention.

FIG. 9 shows another embodiment of the WTT system of the present invention, wherein an input signal dividing unit 111 and a section selecting unit 112 are provided between A/D converter 107 and the WTT device 100.

The input signal dividing unit 111 divides the input signal into sections. the section selecting unit 112 selects appropriate sections and sends selected sections to WTT device 100.

Figure 10:
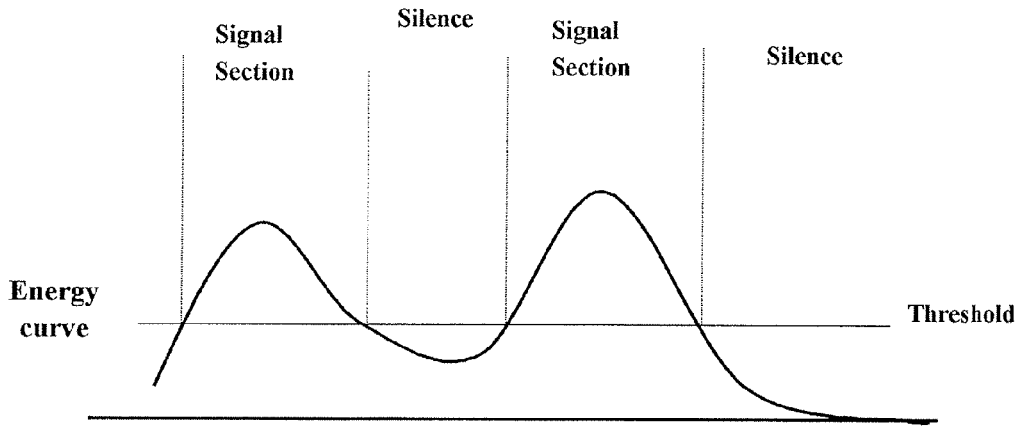
FIG. 10 is for explaining a method for dividing a wave signal.
Figure 11:
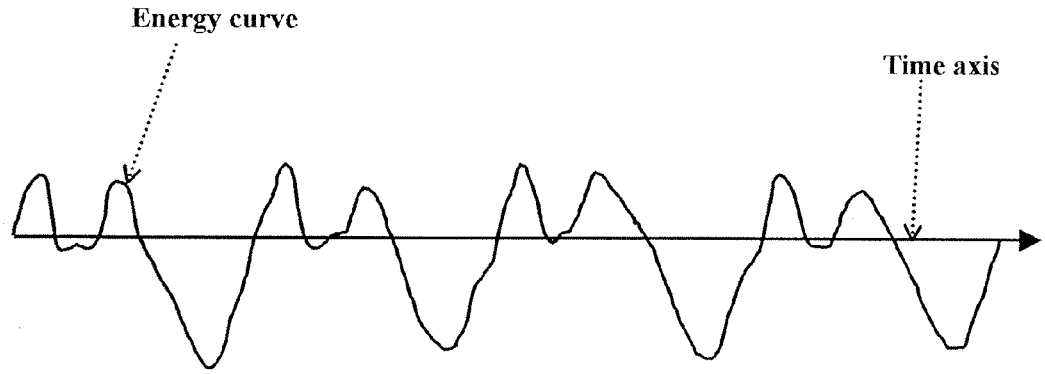
Figure 11 PRIOR ART
FIG. 11 shows the waveform of a piece of sound signal of a man's vowel "u"
Figure 12:
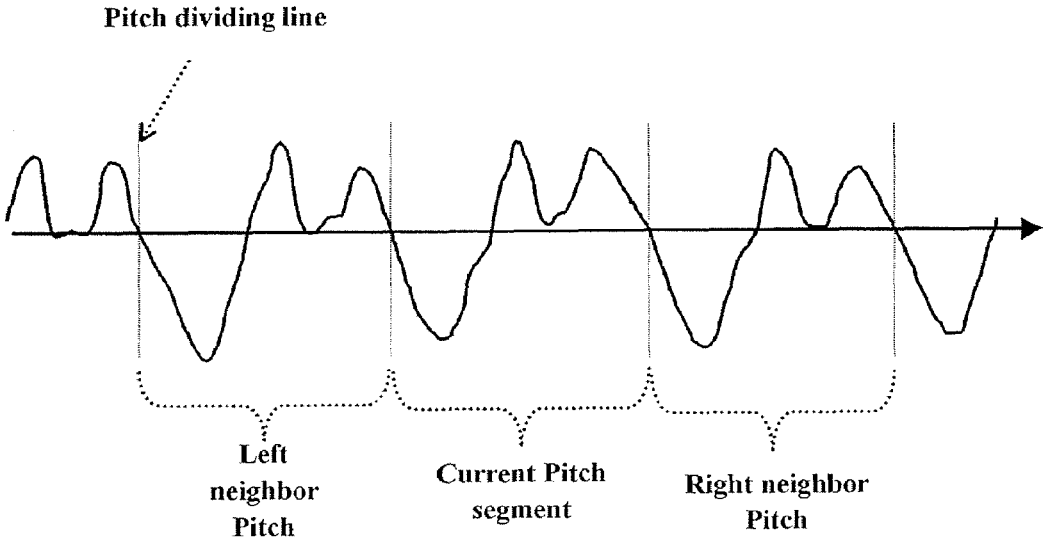
Figure 12 PRIOR ART
FIG. 12 is for showing the pitch in the sound signal shown in FIG. 11.
Figure 13A:
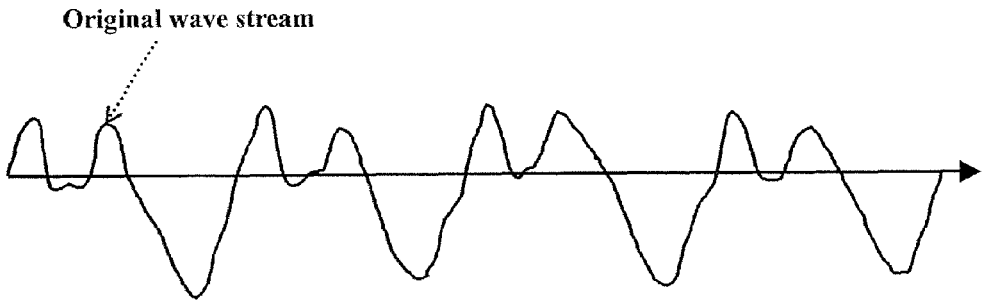
Figure 13a PRIOR ART
FIGS. 13(*a*) and 13(*b*) are for explaining the conventional wave section comparison (WSC) method for detecting pitch in the sound signal.
Figure 13B:
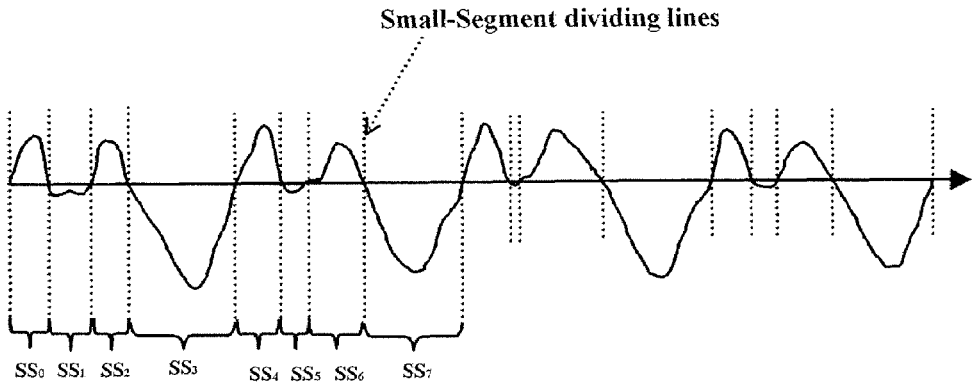
Figure 13b PRIOR ART
Figure 14A:
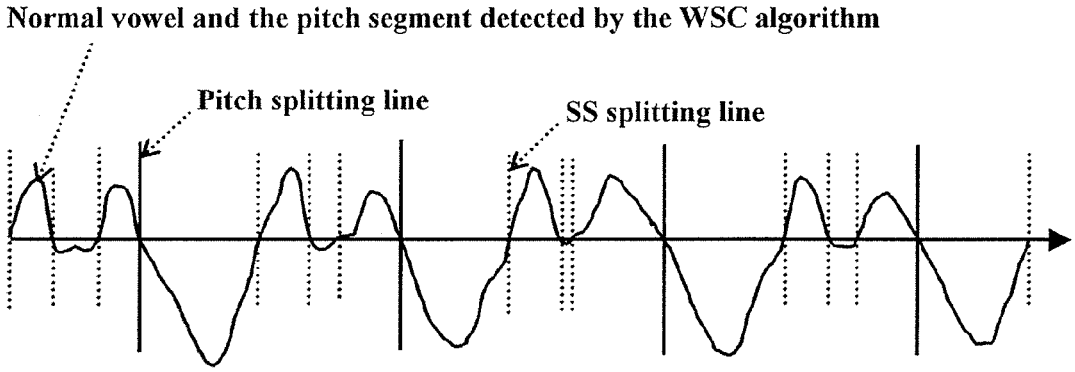
Figure 14a PRIOR ART
FIGS. 14(*a*) to 14(*c*) are for explaining the lower frequency oscillation error occurred in the conventional WSC method.
Figure 14B:
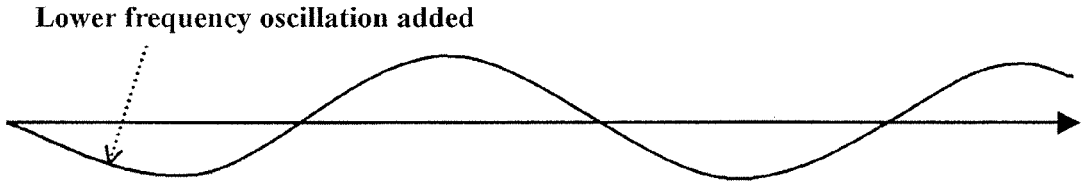
Figure 14b PRIOR ART
Figure 14C:
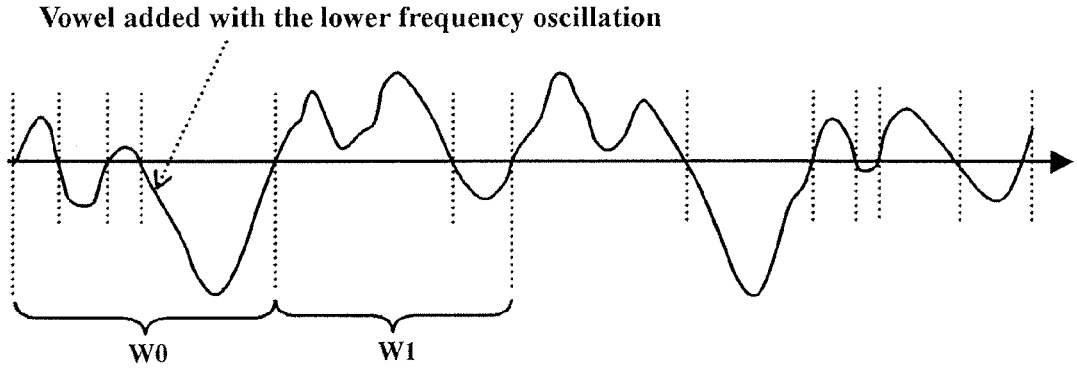
Figure 14c PRIOR ART
Figure 15:
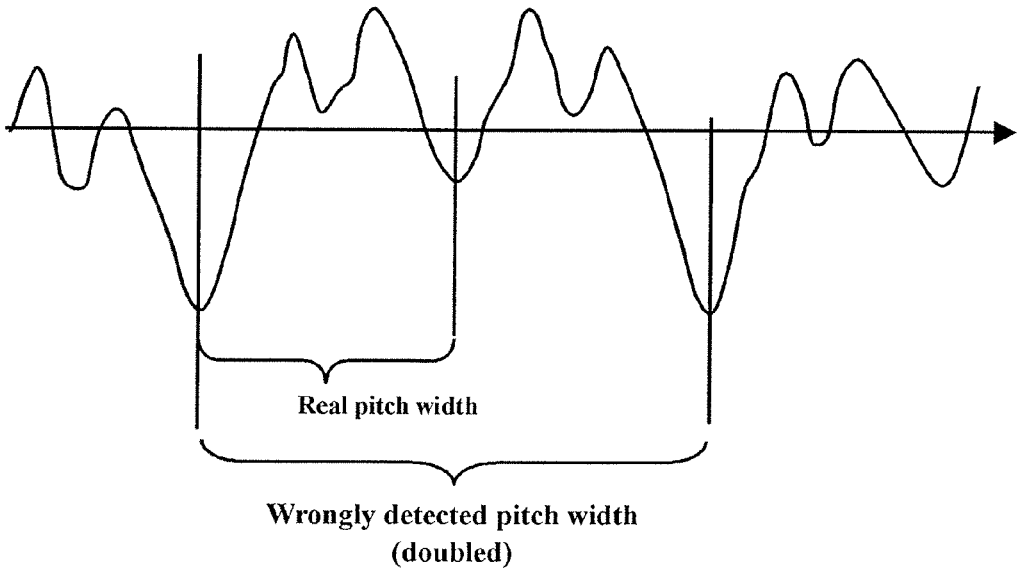
Figure 15 PRIOR ART
FIG. 15 is for showing the double-pitch error occurred when using conventional pitch detection methods.
Figure 16:
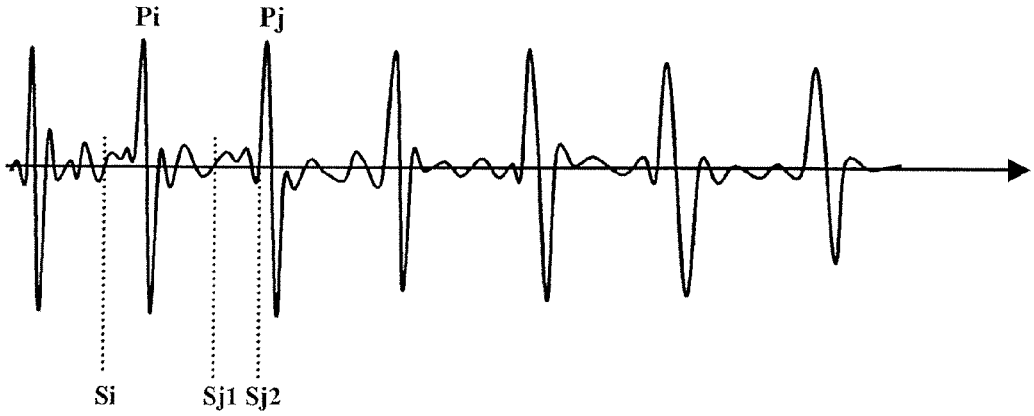
Figure 16 PRIOR ART
FIG. 16 is for showing the high and narrow small section shift error occurred when using conventional pitch detection methods.

FIG. 10 shows the process of the signal dividing unit 111 according to an embodiment of the present invention. According to an embodiment, the signal dividing unit 111 first obtains the average energy level over a range of, e.g., 147 samples, as in an embodiment, thus obtaining an integrated energy curve as shown in FIG. 10. Then, the signal dividing unit compares the energy curve with a silence threshold, and determines the sections lower than the threshold as the silence sections and the sections with energy higher than the threshold as signal portions for later processing.

Then, the section selecting unit 112 selects only the signal sections for later processing.

Of course, other method for dividing the input signal into silence sections and signal sections for later processing may be utilized in implementing the present invention."

In the situation of human voice recognition, a usual human speech contains vowels, consonants, pauses, and stops, so its energy curve is more or less like that shown in FIG. 10, with vowels and consonants corresponding to sections having relatively high energy and pauses and stops corresponding to sections with relatively low energy. As the main component of vowels, pitches exist only in the sections with relatively high energy. So by dividing the input signal into sections and only providing sections with sufficiently high energy to the WTT device for pitch detection, as is arranged in an embodiment of the present invention, the efficiency of pitch detection is improved.

It is to be understood that while the WTT system of the present invention has been described with reference to embodiments for sound wave WTT processing, the WTT system can also be used for processing any other wave signals, such as pressure/force signal, light signal, etc., and the microphone 108 as shown in FIGS. 6, 8, and 9 can be replaced by a pressure/force transducer, a photoelectric converter, etc. Of course, the WTT system of the present invention can be utilized for WTT process of electric signals, wherein the microphone 108 is replaced by a suitable electric detecting unit, e.g. a voltmeter or an ampere meter.

So generally speaking, the WTT system of the present invention can perform WTT process on all the waveform physical quantities. It comprises a converter unit (such as microphone 108) that converts an original physical quantity (sound, pressure, force, light, etc) into an analog electric signal or an electric sensor that detects an electric quantity (voltage or current) to generate an analog electric signal for which WTT process is to be made, and an A/D converter 107 that converts the analog signal into a digital signal.

Pitch Detecting Method and Apparatus of the Present Invention

In view of the problems of the WSC method as mentioned in the background description, the inventors have tested a so-called "pitch width trigon chain" (PWTC) approach for detecting pitches using WTT, as described below.

Figure 17:
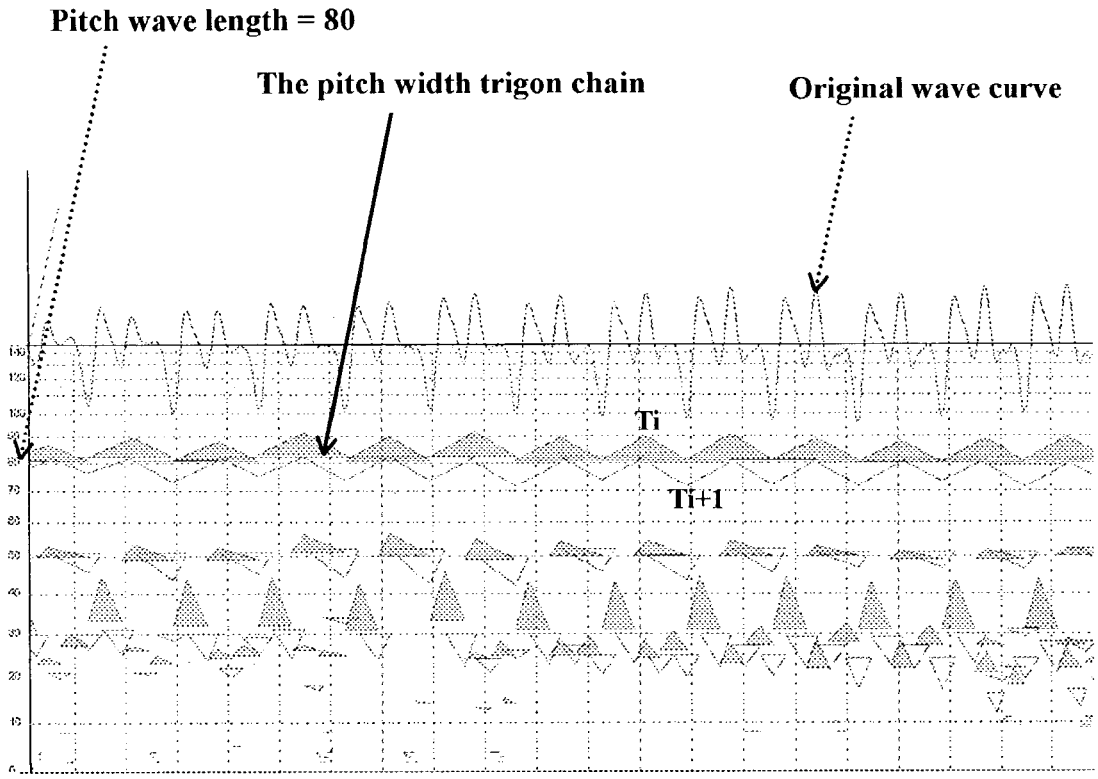
FIG. 17 shows, in the upper portion thereof, the waveform of the vowel "u" produced by a Chinese male and also shows, in the lower portion thereof, the results of WTT analysis of the waveform as trigons displayed at different heights corresponding to the width of the trigons.

FIG. 17 shows, in the upper portion thereof, the waveform of the vowel "u" produced by a Chinese male and also shows, in the lower portion thereof, the results of WTT analysis of the waveform as trigons displayed at different heights corresponding to the width of the trigons.

Through extensive studies and researches, the inventors have discovered that in the distribution of trigons extracted from many vowels in Chinese (as "a", "e", "i", "u" etc.) and many vowels in other languages, a feature of trigon distribution, "the pitch width trigon chain" (PWTC), is of significance in the detection of pitch from a sound signal.

FIG. 17 shows the PWTC of the original sound wave example shown.

The inventors have found out that a PWTC has the following characteristics:

1) The width of each of trigons in the PWTC is approximately equal to widths of other trigons in the PWTC.
2) Trigons in PWTC are characteristics of the oscillations at pitch frequencies, so the widths of trigons in the PWTC are approximately the width of the pitch.
3) Trigons in PWTC have sufficiently great heights and their heights are close to those of their neighboring trigons in the PWTC.
4) Trigons in PWTC are positively/negatively interleaving and concatenating. Interleaving means that the absolute value of height of a positive trigon (such as trigon $T_i$ shown in FIG. 17) is approximately equal to the absolute value of height of its closest negative trigon (such as trigon $T_{i+1}$ shown in FIG. 17). Concatenating means that the time of the peak point of trigon Ti (iCenterTime) approximately equals to the starting time of trigon $T_{i+1}$ (iTime) (Ti and $T_{i+1}$ have opposite polarities, i.e. if Ti is a positive trigons, then $T_{i+1}$ is a negative trigons, and vise versa) and that the starting time of trigon Ti plus its width approximately equals the time of the peak point of the trigon $T_{i+1}$, or Ti.iTime+Ti.nWidth=$T_{i+1}$.iCenterTime.

By these features, it can be determined whether a trigon belongs to PWTC. Thus, for many vowels, it becomes easy to detect their pitches. By experiments, the inventors have found out that the PWTC approach works very well on almost all the Chinese vowels the inventor had tested, with nearly 100% rate of correct pitch detection.

The PWTC approach improves the efficiency of pitch detection, however, it fails in many cases. For example, when detecting pitches from voices with background noises (a situation commonly encountered in pitch detection from speeches of everyday life) and voices of some languages other than Chinese (for example, English or Japanese) etc., the PWTC approach fails to give satisfactory results Vowels in normal Chinese speech tend to be longer than those in English and Japanese speech. In other words, components with pitch frequencies of vowels of English and Japanese speech tend to be weaker than those of Chinese speech, so it is more difficult or even impossible to detect the pitch width trigon chains in vowels of English or Japanese. The inventors believe that this is one of the main reasons why the PWTC approach fails to detect pitches in those situations as mentioned above.

Figure 18:
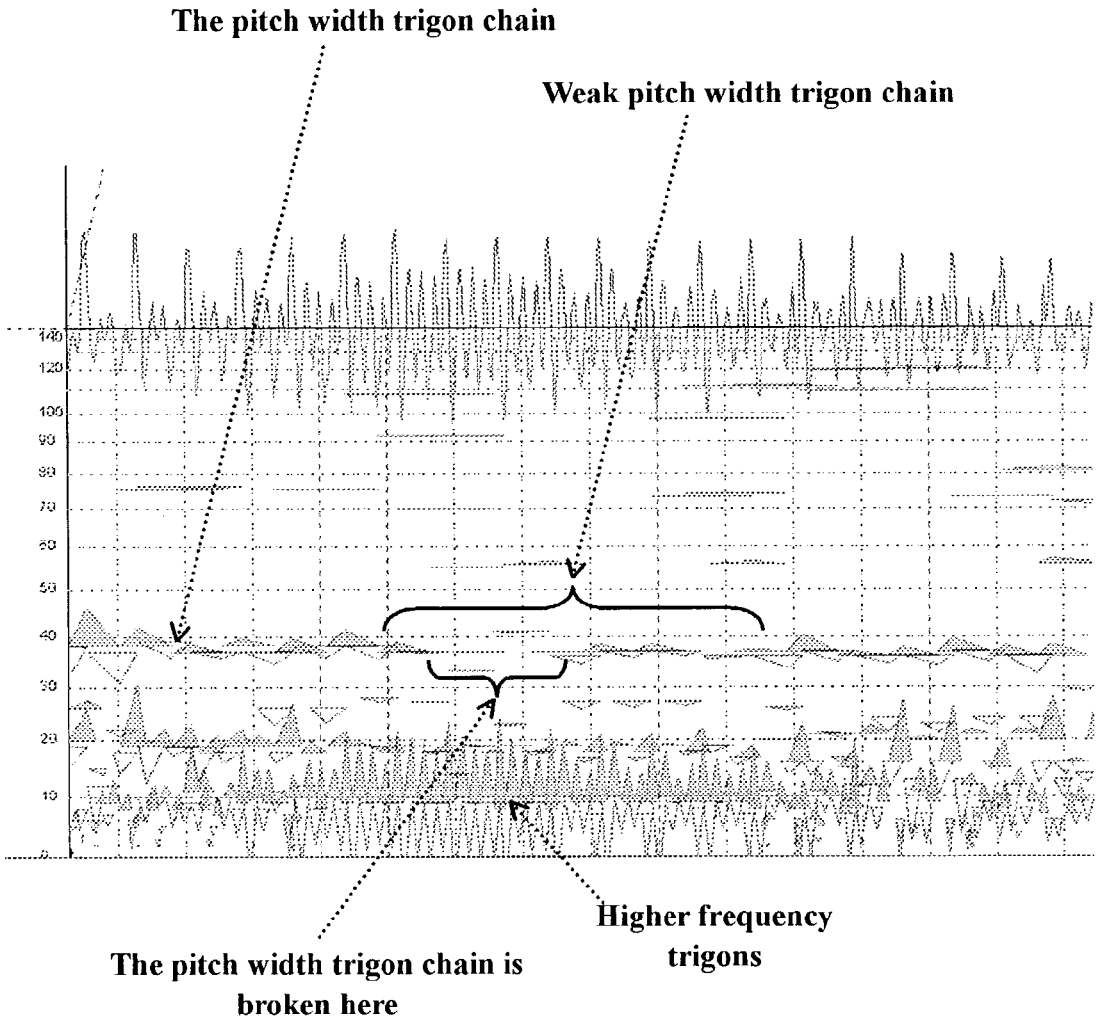
FIG. 18 shows, in the upper part of the drawing, the waveform of a Japanese young female's vowel "ou", which is an example of a vowel with weak pitch frequency.

FIG. 18 shows, in the upper part of the drawing, the waveform of a Japanese young female's vowel "ou", which is an example of a vowel with weak pitch frequency; FIG. 18 also shows, in the lower part thereof, the trigons extracted from this waveform using WTT.

As shown in FIG. 18, the pitch width trigon chain (PWTC) becomes weak or even broken in some areas. Through extensive studies on the WTT results over various vowels of different languages, the inventors have found out that vowels with weak pitches have the following features:

1) In the weak pitch portion, the energy is mainly distributed on some narrow trigons having widths smaller than those of trigons in PWTC, so these narrow trigons are relatively high.
2) In these vowels with weak pitch frequency component, the pitch width periodicity still exists even in the areas where PWTC are weak or broken, but the periodicity is reflected by the periodicity of the variation of the height of the narrow trigons instead of by the pitch frequency component itself. As the height of the trigons corresponds to energy, such periodicity of the variation of the height of the narrow trigons is referred to as "energy-periodicity".
3) Pitches with such energy periodicity occur mostly in vowels having large percentage of higher-frequency components, such as "a", "e".

With all these studies and considerations, the inventors have devised the method and apparatus of pitch detection of the present invention.

Figure 19:
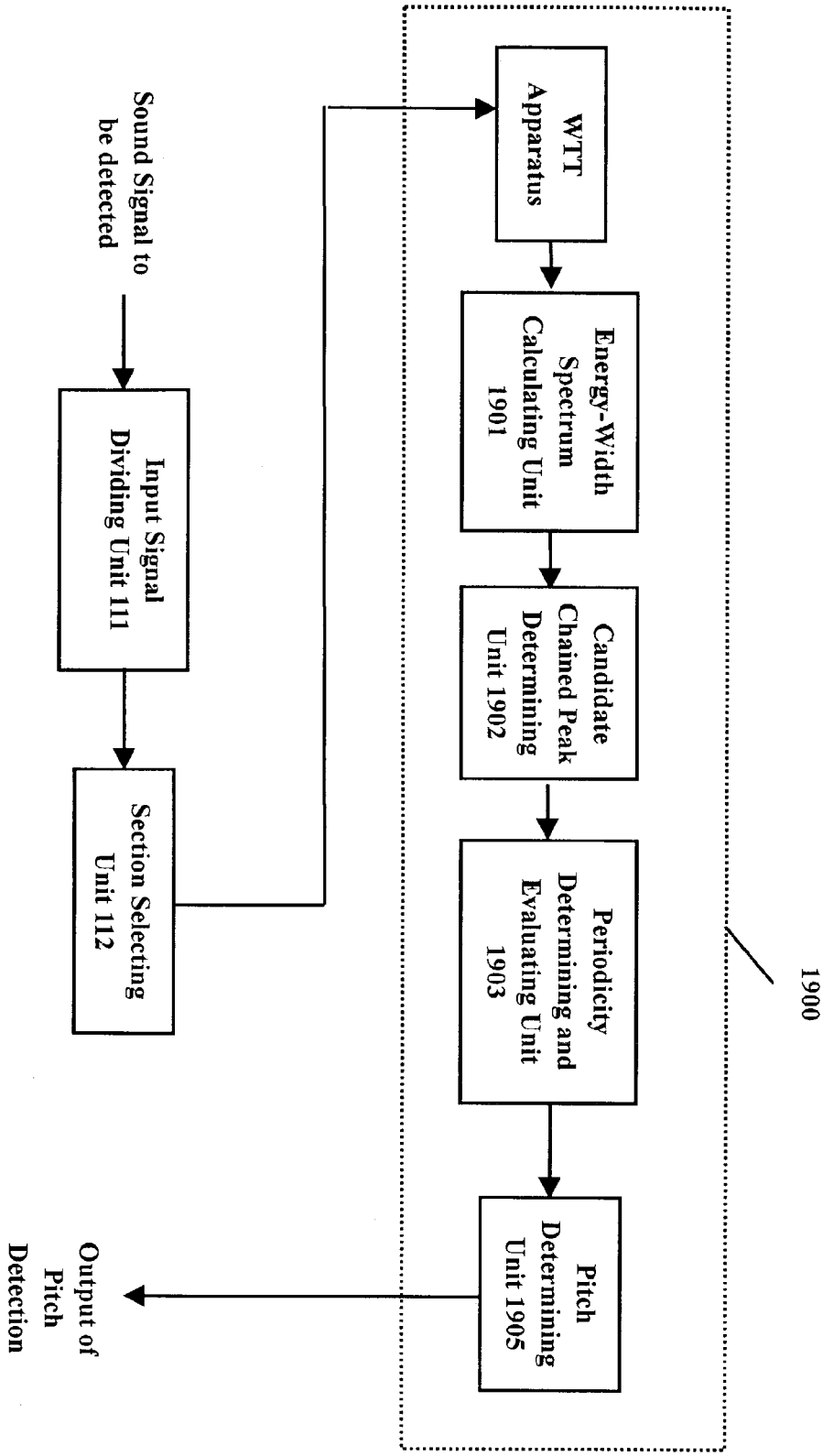
FIG. 19 shows a preferred embodiment of the pitch detecting apparatus of the present invention.

FIG. 19 shows a preferred embodiment of the pitch detecting apparatus of the present invention.

As shown in FIG. 19, an input signal dividing unit 111, as described above, divides the sound signal to be detected into sections; a section selecting unit 112, as described above, selects appropriate sections for the pitch detecting apparatus 1900 of the present invention. The input signal dividing unit 111 may use the silence/signal sectioning method as described above or any other suitable method in dividing the sound signal to be detected. The section selecting unit 112 selects sections based on, for example, the energy levels of the sections.

The pitch detecting apparatus 1900 of the present invention comprises: a WTT device 100 of the present invention as described above, for performing WTT transformation on the sections of sound signal selected by the section selecting unit 112; a width-energy spectrum calculating unit 1901 for obtaining a width-energy spectrum based on the result of WTT transformation of the WTT device 100; a candidate chained peak determining unit 1902 for determining a candidate chained peak in the width-energy spectrum obtained by the width-energy spectrum calculating unit 1901; a periodicity determining and evaluating unit 1903 for determining and evaluating the periodicity of the candidate chained peak; and, a pitch determining unit 1905 for determining a pitch of the sound signal based on the determination and evaluation result of the periodicity determining and evaluating unit 1903. The operations of the embodiment of the pitch detecting apparatus shown in FIG. 19 will be described below.

Figure 20:
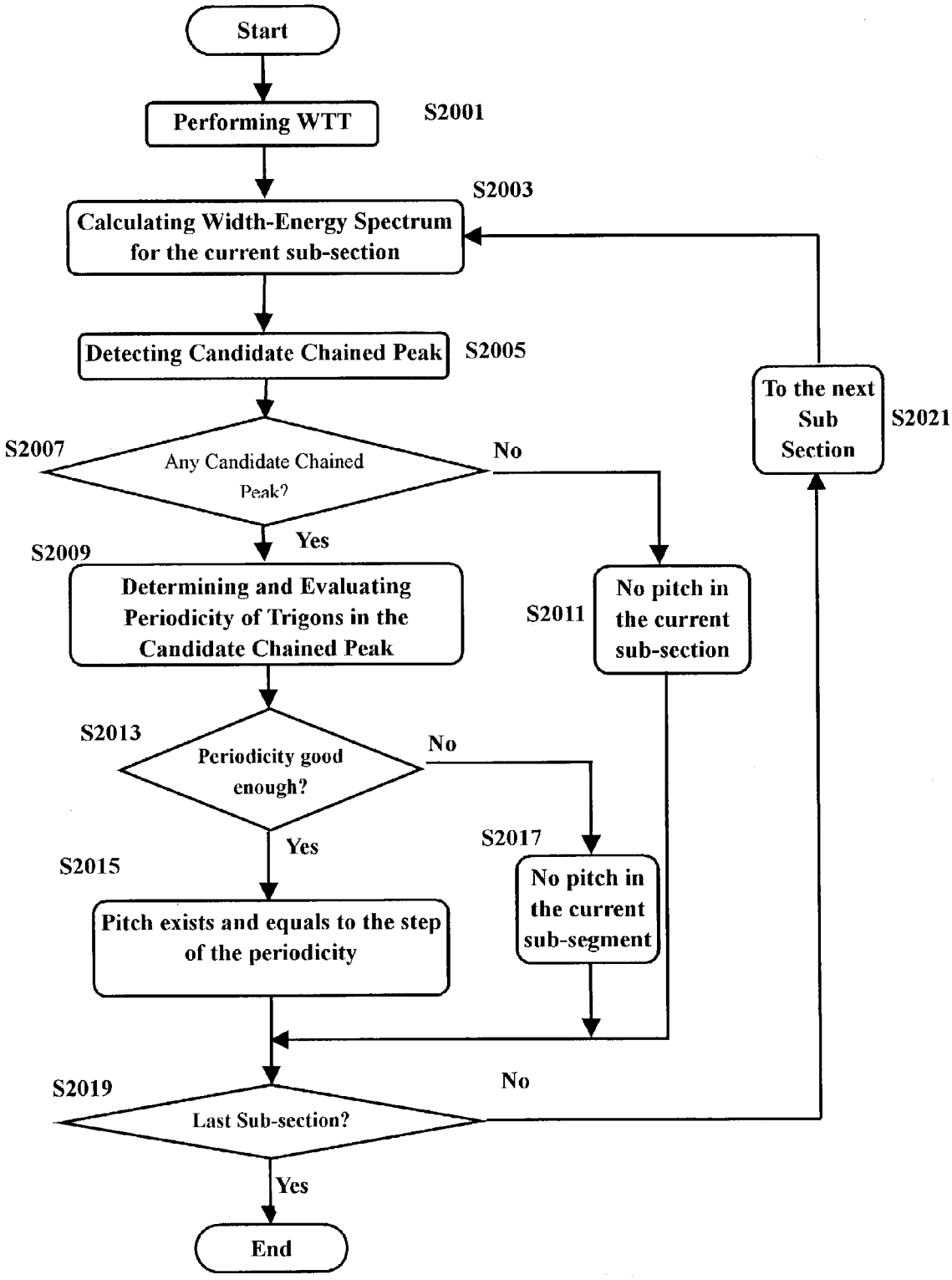
FIG. 20 is a flowchart showing the operations of the embodiment of the pitch detecting apparatus shown in FIG. 19.

FIG. 20 is a flowchart showing the operations of the embodiment of the pitch detecting apparatus shown in FIG. 19.

As shown in FIG. 20, at step S2001, a section of sound signal selected by the section selecting unit 112 is WTT transformed by the WTT device 100.

Then, at step S2003, the width-energy spectrum calculating unit 1901 calculates a width-energy spectrum of the current section of signal.

Specifically, as a practical measure, the width-energy spectrum calculating unit 1901 further divides a section of signal into sub-sections and calculates width-energy spectrum for each of the sub-sections. The sub-sections may have the same length, or they may have different lengths.

Figure 21:
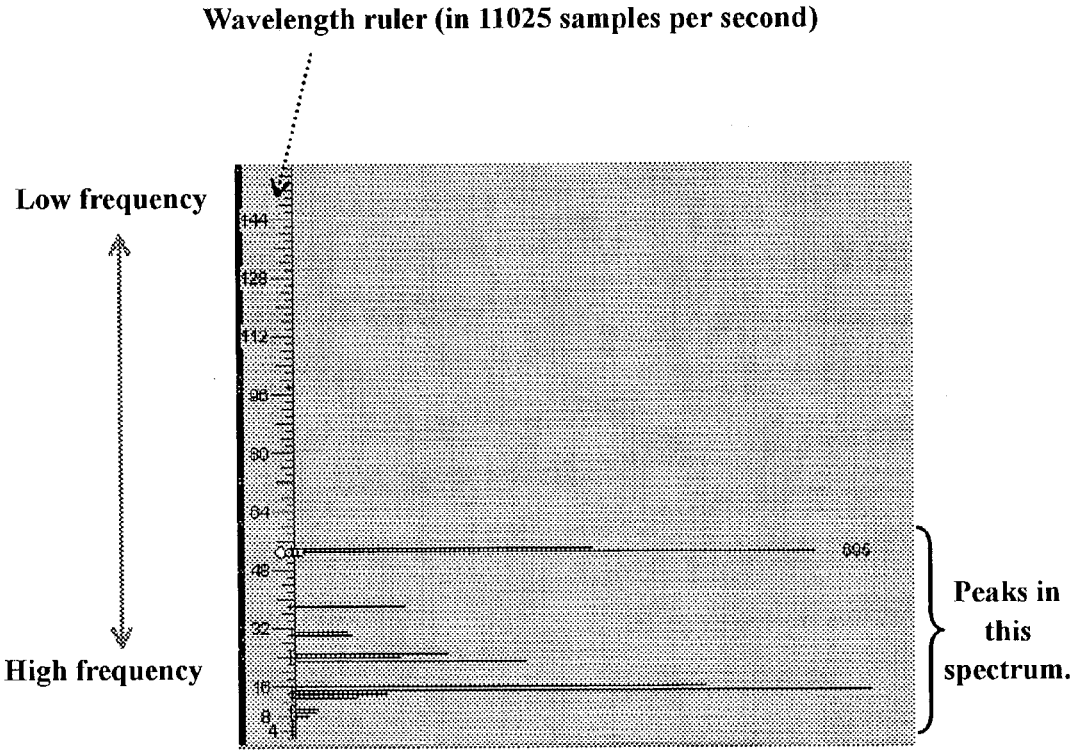
FIG. 21 shows a width-energy spectrum of the sound signal shown in the upper part of FIG. 18.

FIG. 21 shows a width-energy spectrum of the sound signal shown in the upper part of FIG. 18. In FIG. 21, the ordinate indicates the width of trigons (note the scale of the ordinate is not linear), and the abscissa indicates the total energy of trigons having the same width. In FIG. 21, the unit of the ordinate is the sample period; for the example of FIG. 21, the sampling frequency is 11025/second, so the unit of ordinate is $1/11025$ second. Thus, a line at width 14 in the width-energy spectrum as shown FIG. 18 represents the sum of energy of all trigons with a width of 14 sample periods.

The length of one of the sub-section may be set as a value longer than the longest pitch in human voices. For example, the lower limit of the length of the sub-section may be 640 samples at the rate of 11025 sample/second, or 640/11025=0.2320 second. The upper limit of the length of the sub-section may vary. But it is preferred that the length of the sub-section be in the range of 0.0580 to 0.2900 second, that is, one to five times the above lower limit. Longer length of the sub-section will slow the processing.

Usually, the sampling frequency is the sampling rate of the A/D converter 107. However, the present invention is not limited to a sampling period of $1/11025$ second. Further, the present invention may use any other unit of width in constructing the width-energy spectrum, as can be understood by one skilled in the art. Higher sampling rate, i.e. more sample in a give period of time, results in slower processing as well as finer separation of peaks in the spectrum. On the other hand, a peak combining process can be utilized to reduce the number of peaks for further processing, as will be described later.

In the example process shown in FIG. 21 for calculating width-energy spectrum for the current sub-section, the length (height) of each peak in the spectrum is calculated by summing the absolute values of the heights all the trigons of that peak. For trigons at the borders of the sub-section, only the part of width within the current sub-section has contribution to the sum. So the energy of each peak in the spectrum can be calculated as:

$$E=\Sigma(\text{absolute value of the height of } Ti)\times(\text{width of } Ti \text{ within the sub-section})/(\text{width of } Ti)$$

Where Ti represents trigons having the width of the peak in the sub-section and the summation is performed over Ti (i=1,2, . . . ). For trigons within the sub-section but not on the borders of the sub-section, width of Ti within the sub-section=width of Ti. But for a trigon on the borders, width of Ti within the sub-section is the length of the part of the baseline of the trigon within the current sub-section.

Back to FIG. 20, in step S2005, the candidate chained peak determining unit 1902 determines a candidate chained peak in the width-energy spectrum obtained by the width-energy spectrum calculating unit 1901. The candidate chained peak is the one that:

1) has a width greater than Wcpmin, wherein the value of Wcpmin is preferably in the range of 5-9; and
2) has the greatest energy in all the peaks with a width greater than Wcpmin.

In an embodiment, it is set that Wcpmin=7.

Then, in step S2007, the periodicity determining and evaluating unit 1903 determines whether a candidate chained peak has be determined by the candidate chained peak determining unit 1902. If no candidate chained peak is determined in the sub-section, the pitch detecting apparatus determines that no pitch exists in the sub-section (step S2011), and the process advances to step S2019 to determine whether the current sub-section is the last sub-section in the section.

If it is determined in step S2007 that a candidate chained peak exists in the sub-section, the process advances to step S2009, where the periodicity determining and evaluating unit 1903 evaluates the periodicity of the trigons in the candidate chained peak, as explained below.

After that, in step S2013 the pitch determining unit 1905 judges whether the candidate chained peak exhibits a periodicity that is good enough, as explained below. If the result at step S2013 is "YES", the pitch determining unit 1905 determines that the current sub-section contains a pitch (step S2015), and its pitch is the step of the periodicity of the trigons in the candidate chained peak; the process then goes to step S2019. If the result of step S2013 is "NO", then the pitch determining unit 1905 determines that the current sub-section does not contain any pitch (step S2017), and the process goes to step S2019.

In step S2019, the width-energy spectrum calculating unit 1901 determines if the current sub-section is the last sub-section in the present section. If the result of step S2019 is "YES", the pitch detecting process for this section ends. If "NO" in step S2019, the process goes to step S2021, where the width-energy spectrum calculating unit 1901 starts processing the next sub-section.

Figure 22:
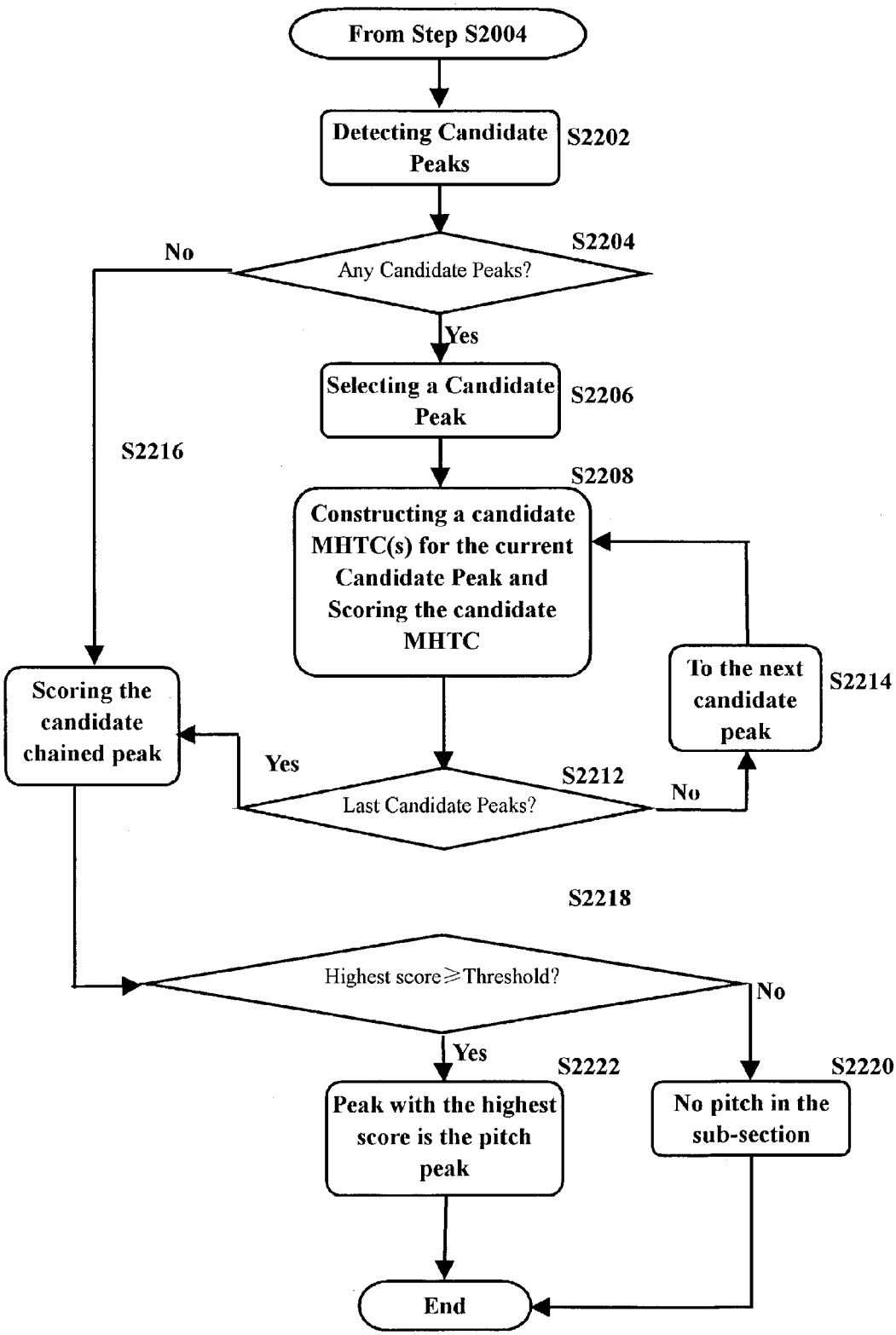
FIG. 22 shows a preferred embodiment of the process of the present invention for evaluating and determining the periodicity of trigons of the candidate chained peak.
Figure 24:
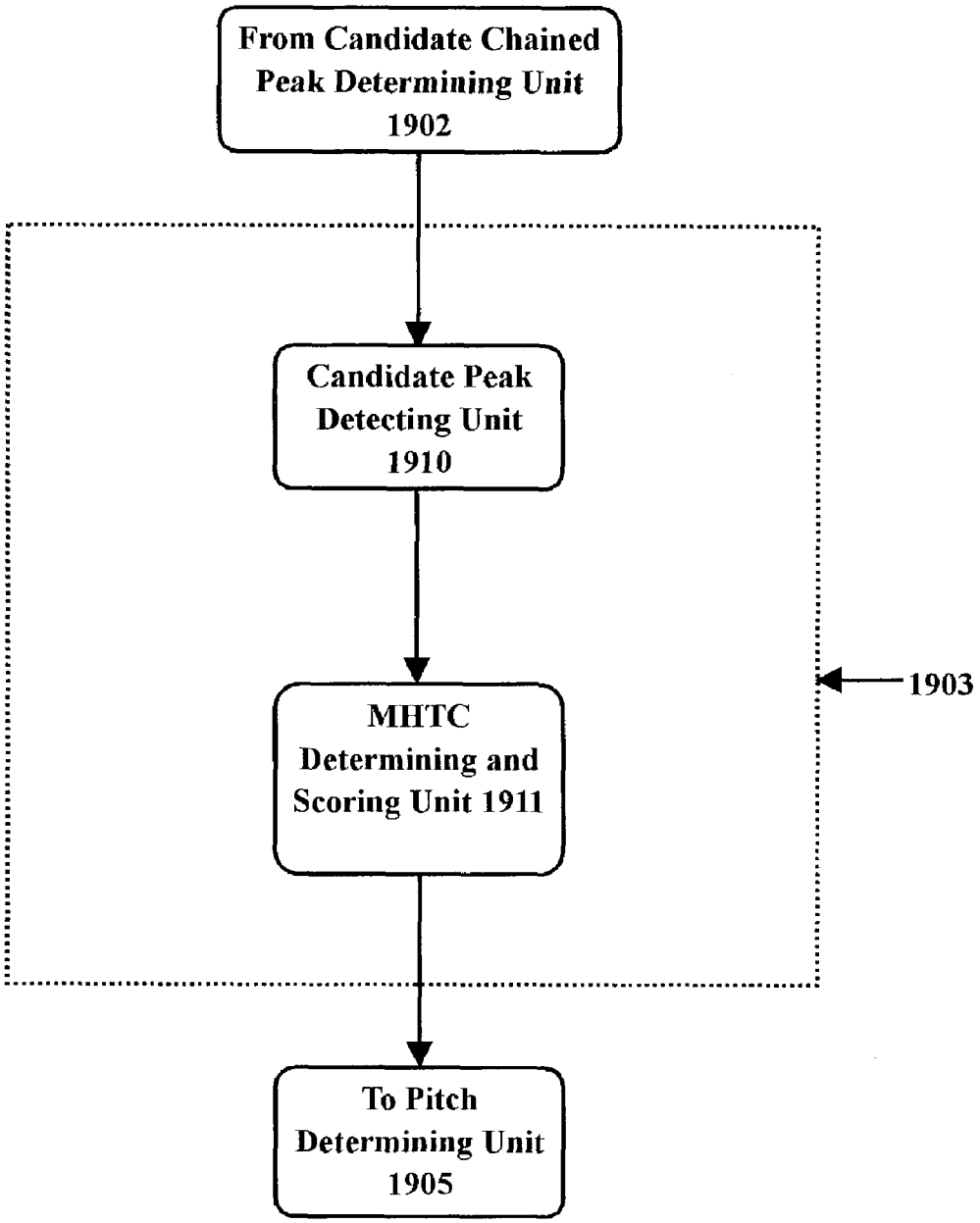
FIG. 24 shows the construction of an embodiment of the periodicity determining and evaluating unit of the present invention.

FIG. 24 shows the construction of an embodiment of the periodicity determining and evaluating unit 1903, and FIG. 22 shows in more detail an embodiment of the process for evaluating and determining periodicity of trigons of the candidate chained peak in step S2009 of FIG. 20.

In the embodiment as shown in FIG. 24, the periodicity determining and evaluating unit 1903 comprises: a candidate peak detecting unit 1910 for detecting candidate peaks in the width-energy spectrum obtained by the width-energy spectrum calculating unit 1901; and, a maximum height trigon chain (MHTC) determining and scoring unit 1904 for determining, for each of the candidate peaks, a candidate maximum height trigon chain (candidate MHTC) from the trigons in the candidate chained peak and performing a scoring process for each of the candidate MHTCs and for the candidate chained peak.

MHTC is a subset of the trigons in the candidate chained peak. MHTC has the following features:

1) If pitch exists in the current sub-section, the width of trigons in MHTC should be smaller or equal to the pitch width. In the case that the width of trigons in MHTC equals to the pitch width, the candidate chained peak itself is the MHTC.
2) The height of a trigon in MHTC (for a negative trigon in MHTC, the absolute value of its height) usually should be greater than its neighboring trigons in the candidate chained peak within one pitch width.
3) The difference of the heights of between any two neighboring trigons in MHTC should be small enough.
4) The interval between trigons in MHTC should be stable, that is:

$$T_i.i\text{Time}-T_{i-1}.i\text{Time}\approx T_{i+1}.i\text{Time}-T_i.i\text{Time}$$

Where $T_i$(i=1,2 . . . ) represents trigons in MHTC, and iTime is the starting time of Ti.

Determination and scoring of MHTC will be described later in more detail.

FIG. 22 shows a preferred embodiment of the process of the periodicity determining and evaluating unit 1903 of FIG. 24 for evaluating and determining the periodicity of trigons of the candidate chained peak.

As shown in FIG. 22, at step S2202, the candidate peak detecting unit 1910 detects candidate peaks in the width-energy spectrum obtained by the width-energy spectrum calculating unit 1901.

Figure 23:
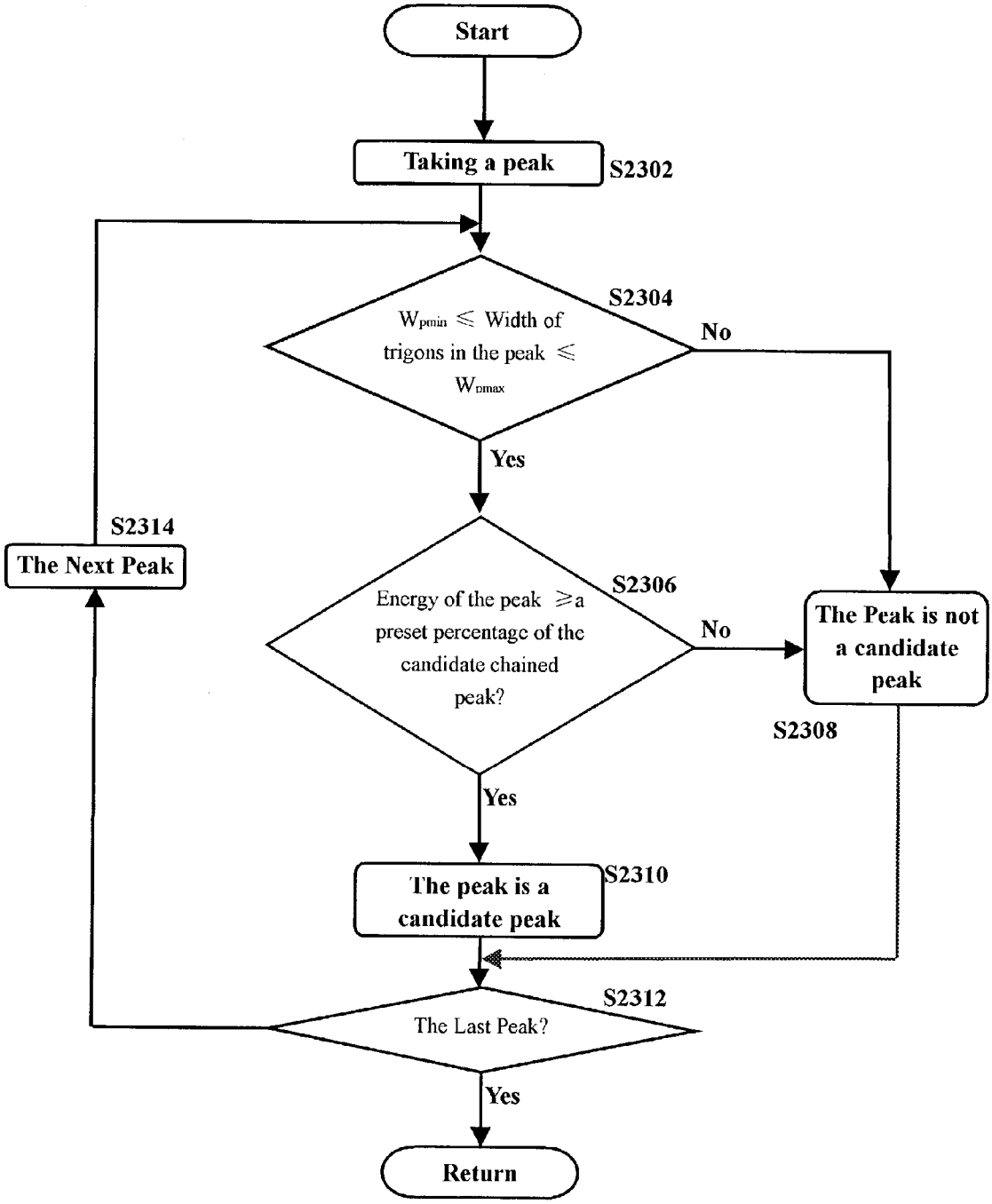
FIG. 23 shows an embodiment of the candidate peak detecting process of the present invention.

FIG. 23 shows an embodiment of the candidate peak detecting process in step S2202.

As shown in FIG. 23, at step S2302, the candidate peak detecting unit 1910 chooses a peak in the spectrum. Then, at step S2304, it is determined if the width of the trigons in the current peak is in the range of:

$$\text{Wpmin} \leqq \text{the width of trigons of the peak} \leqq \text{Wpmax}$$

Where Wpmin is preferably in the range of 15-30 (in unit of $1/11025\times$ second, as explained above), and is chosen as 20 in the present embodiment; Wpmax is preferably in the range of 150-180 (in unit of $1/11025$ second, as explained above) and is chosen as 160 in the present embodiment.

If it is determined that the width W of the trigons of the peak is not in the range of Wpmin<W<Wpmax, then the current peak is not regarded as a candidate peak (step S2308), and then the process goes to step S2312 to determine if the current peak is the last peak in the spectrum.

If it is determined that the width W of the trigons of the peak is in the range of Wpmin<W<Wpmax, the process advances to step S2306, where it is determined whether the energy of the current peak (height of the peak) is greater than a preset percentage of the energy of the candidate chained peak detected at step S2005 in FIG. 20. A preferred range of the preset percentage is 1%-5%, and it is taken as 2% in the present embodiment.

If the result of step S2306 is "YES", then this peak is regarded as a candidate peak (step S2310), and the process goes to step S2312; if the result of step S2306 is "NO", then the current peak is not regarded as a candidate peak (step S2308), and the process goes to step S2312.

At step S2312, it is determined whether the peak is the last peak in the spectrum. If the result of step S2312 is "NO", the next peak in the spectrum is chosen (step S2314) and then the process returns to step S2304. If the result of step S2312 is "YES", the process for detecting candidate peaks ends.

Turning back to FIG. 22, after detecting candidate peaks at step S2202, the candidate peak determining unit 1910 determines, in step S2204, whether at least one candidate peak has been determined in step S2202. If the result of step S2204 is "NO", the process goes to step S2216, where a scoring process is performed for the candidate chained peak.

If the result of step S2204 is "YES", the process goes to step S2206, where the MHTC determining and scoring unit 1911 takes a candidate peak. Then the MHTC determining and scoring unit 1911 constructs a candidate MHTC for the current candidate peak and calculates a score for the candidate MHTC constructed for the current candidate peak (step S2208). The process for constructing a candidate MHTC will be described in detail later.

Then, in step S2212, it is determined whether the current candidate peak is the last candidate peak in the width-energy spectrum. If the result of step S2212 is "NO", the process goes to step S2214, where the candidate peak determining unit 1910 take the next candidate peak, and then the process goes to step S2208 to construct and score a candidate MHTC for the next candidate peak. If the result of step S2212 is "YES", the process goes to step S2216.

In step S2216, the MHTC determining and scoring unit 1911 calculates a score for the candidate chained peak. After that, the process goes to step S2218, where the pitch determining unit 1905 determines whether the highest score, among the scores calculated for candidate peaks at step S2208 and the score calculated for the candidate chained peak at step S2216, is equal to or greater than a preset threshold Pt.

A preferred range of the preset threshold Pt is 150-500, and in the present embodiment it is chosen that Pt=200.

If the result of step S2218 is "NO", the process goes to step S2220, where the pitch determining unit 1905 determines that no pitch exists in the current sub-section, and the pitch detecting process for the current sub-section ends. If, on the other hand, the result of step S2218 is "YES", the process goes to step S2222, where the pitch determining unit 1905 determines that the peak having the highest score is the pitch peak, and the pitch detecting process for the current sub-section ends.

It is to be understood, however, that the periodicity of trigons of the candidate chained peak can be evaluated using other processes than that specifically explained in FIG. 22. Moreover, the periodicity determining and evaluating unit 1903 can be implemented in other ways than that as shown in FIG. 21. All methods and arrangements suitable for evaluating and determining the periodicity of trigons in the candidate chained peak are within the scope and spirit of the present invention.

As mentioned above, in a preferred embodiment, a peak combining process is performed to combine two or more adjacent peaks into a single peak.

Due to the sampling period, the width-energy spectrum is a discrete spectrum, and the smallest separation between two neighboring peaks is one sampling period.

By combining peaks close enough to one another into a single peak, the number of candidate peaks is reduced and the efficiency of pitch detecting process can be improved.

In a preferred embodiment, for a peak corresponding to a width of nPeak, all the peaks within the range of nPeak/6+2 are combined into this peak. That is, the range in which peaks are combined varies with the height of the peak into which its adjacent peaks are combined.

As described above, MHTC has the following features:

1) If pitch exists in the current sub-section, the width of trigons in MHTC should be smaller or equal to the pitch width. In the case that the width of trigons in MHTC equals to the pitch width, the candidate chained peak itself is the MHTC.
2) The height of a trigon in MHTC (for a negative trigon in MHTC, the absolute value of its height) should be greater than its neighboring trigons in the candidate chained peak within one pitch width.
3) The difference of the heights of between any two neighboring trigons in MHTC should be small enough.
4) The interval between trigons in MHTC should be stable, that is:

$$T_i.i\text{Time}-T_{i-1}.i\text{Time}\approx T_{i+1}.i\text{Time}-T_i.i\text{Time}$$

Where $T_i$(i=1,2 . . . ) represents trigons in MHTC, and iTime is the starting time of Ti.

These features are utilized in scoring a constructed candidate MHTC.

Figure 27A:
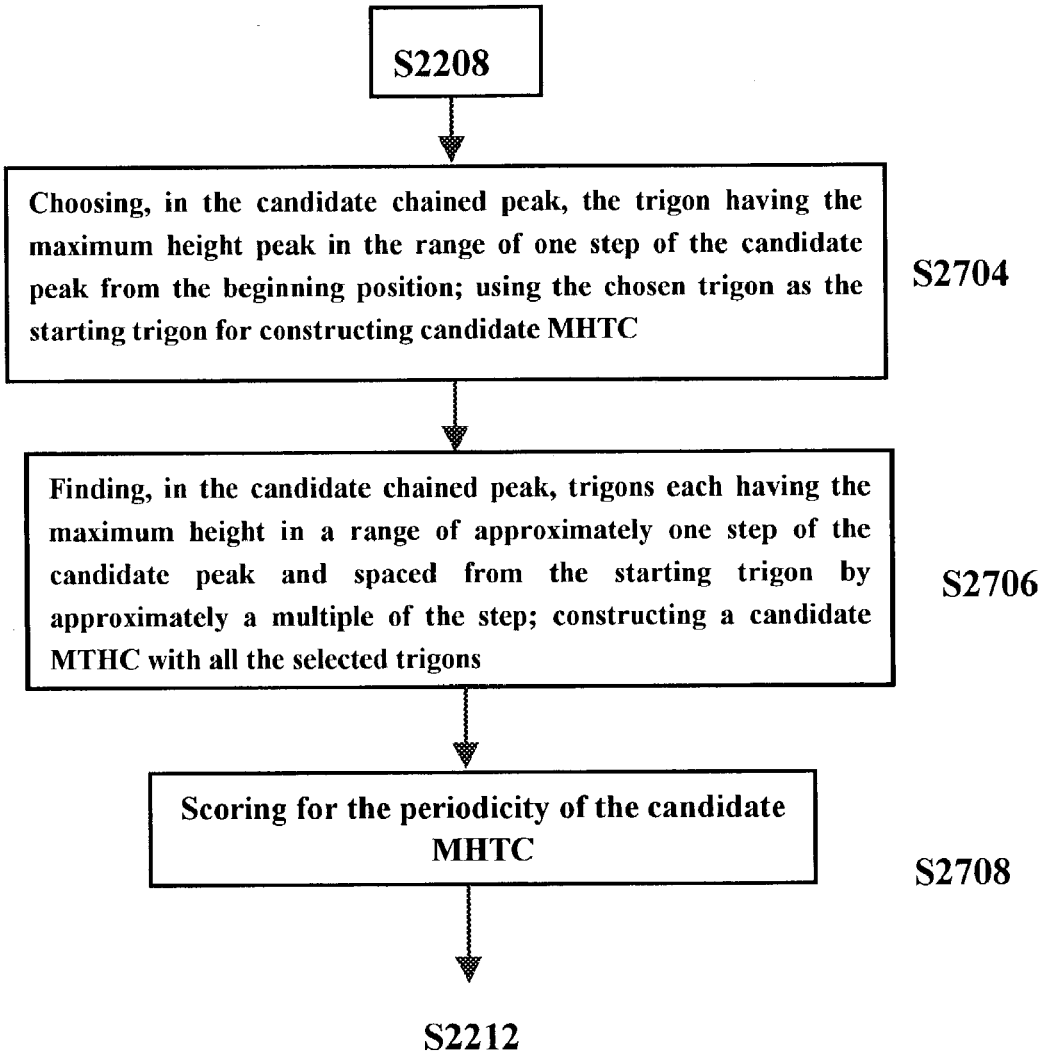
FIG. 27*a* is a flowchart showing a preferred embodiment of the process of the present invention for constructing a candidate MHTC.

FIG. 27*a* shows a preferred embodiment of the process for constructing a candidate MHTC for the current candidate peak and calculating a score for the candidate MHTC in step S2208 shown in FIG. 22.

As shown in FIG. 27*a*, at step S2704, the MHTC determining and scoring unit 1911 chooses, in a range of one step (width of a trigon) of a current candidate peak starting at the beginning position, the trigon having the maximum height in the candidate chained peak and uses it as the starting trigon for constructing candidate MHTC.

At step S2706, the MHTC determining and scoring unit 1911 determines in the candidate chained peak each of the trigons spaced from the starting trigon by approximately a multiple of the width of the trigons in the current candidate peak and constructs a candidate MTHC with all the located trigons. As trigons in the candidate chained peak are concatenating, if more than one trigons contain the same position which is spaced from the starting trigon (such as its starting point) by a multiple of the width of the trigons in the current candidate peak, then the one of these trigons whose stating point is closest to the position is chosen as the trigon of the candidate MHTC. Or, alternatively, the trigon having the greatest height among the more than one trigons is chosen as the trigon of the candidate MHTC.

Here, as explained above for PWTC, concatenating means that the time of the peak point of trigon Ti (iCenterTime) equals to the starting time of trigon $T_{i+1}$ (iTime) (Ti and $T_{i+1}$ have opposite polarities, i.e. if Ti is a positive trigons, then $T_{i+1}$ is a negative trigons, and vise versa) and that the starting time of trigon Ti plus its width equals the time of the top point of the trigon $T_{i+1}$, that is, Ti.iTime+Ti.nWidth==$T_{i+1}$.iCenterTime.

If no trigon in the candidate chained peak is found at a position spaced from the starting trigon by a multiple of the width of the current candidate peak, then a "flaw" is recorded for that position. A flaw has no positive contribution to the scoring of the candidate MHTC.

Figure 27B:
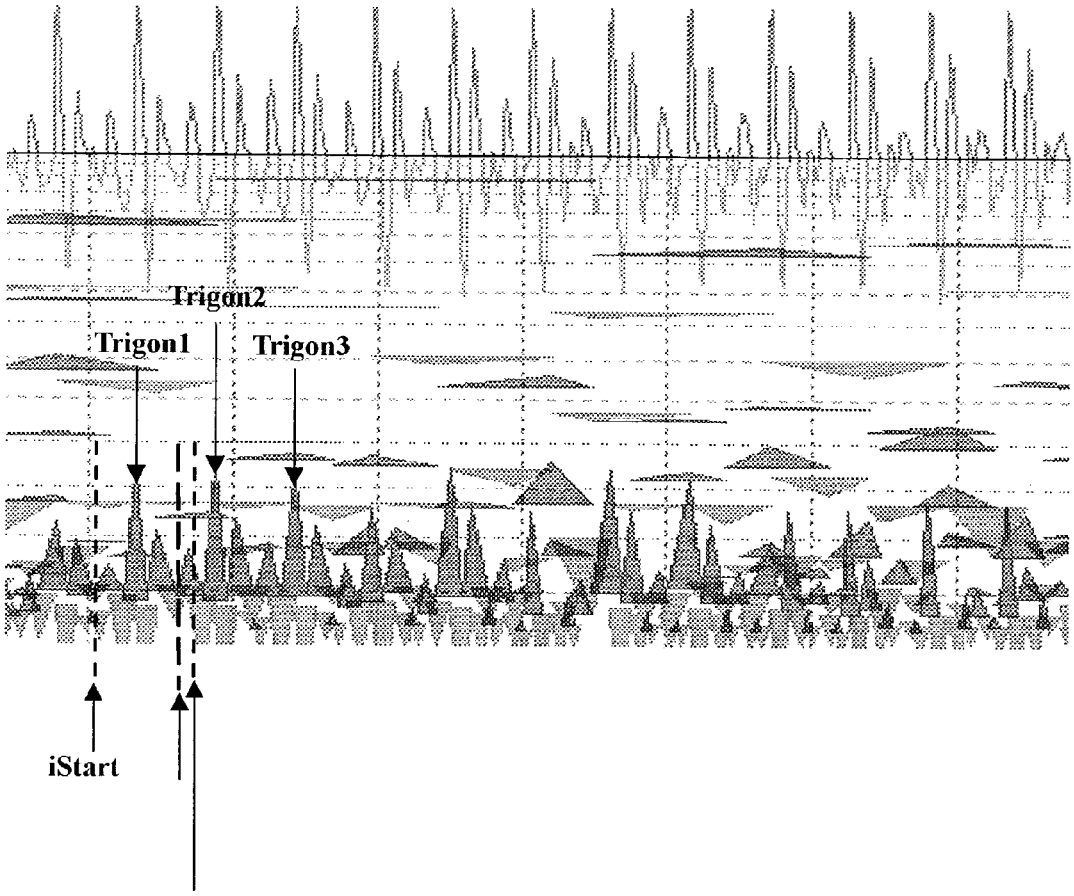
FIG. 27*b* shows in detail how a candidate MHTC is constructed according to an embodiment of the present invention.

FIG. 27*b* shows in detail how a candidate MHTC is constructed according to an embodiment of the present invention.

As shown in FIG. 27*b*, according to an embodiment of the present invention, for an exemplary candidate peak having a width of 26, to find a starting trigon for constructing a candidate MHTC, a first trigon (trigon 1) is found, that has its beginning point (iTime1) in the region from the starting time (iStar) of the current sub-section to iStar+26(the step of the candidate peak)+5, has the maximum (positive) height among all trigons in the range, and has a width within the range of between $wp_0-(wp_0/6+2)$ and $wp_0+(wp_0/6+2)$, where $wp_0$ is the width of the candidate chained peak.

After finding the first trigon that satisfies the above requirements, then a second trigon (trigon 2) is found, that has its beginning point in a range between the beginning point the first trigon (iTime1) and iTime1+26, has the maximum (positive) height of all trigons in the region between the beginning point the first trigon (iTime1) and iTime1+26, and has a width within the range between $wp_1-(wp_1/6+2)$ and $wp_1+(wp_1/6+2)$, where $wp_1$ is the width of the first trigon.

Then, after finding the second trigon that satisfies the above requirements, then a third trigon is found, that has its beginning point in a range between the beginning point the second trigon (iTime2) and iTime2+26, has the maximum (positive) height of all trigons in the region between the beginning point the second trigon (iTime2) and iTime2+26, and has a width within the range between $wp_2-(wp_2/6+2)$ and $wp_2+(wp_2/6+2)$, where $wp_2$ is the width of the second trigon.

So by repeating this step, a set of trigons having the maximum positive height in a range of 26 is obtained. Then the set of trigon is taken as a candidate MHTC and is scored (as described below).

As an alternative embodiment, using the above described process, negative trigons each have a maximum absolute height in its range of the width of the candidate peak are found and used to construct a candidate MHTC. And the candidate MHTC is scored.

As a further alternative embodiment, using the above described process, trigons each have a maximum positive height in its range of the width of the candidate peak are found, and trigons each have a maximum negative height in its range of the width of the candidate peak are also found, and each of the set of positive maximum trigons and the set of negative maximum trigons is used to construct a candidate MHTC, respectively. And each of the two candidate MHTCs is scored. Of the two candidate MHTCs, the one with a higher score is chosen for subsequent processing.

After the trigons for the candidate MHTC have been located and the candidate MHTC has been constructed using the found trigons, in step S2708, the MHTC determining and scoring unit 1911 performs a scoring for the periodicity of the candidate MHTC so as to evaluate whether the candidate MHTC can be accepted as the MHTC.

There are various ways for scoring for a candidate MHTC. An exemplary scoring process, used by the inventors, is described below.

In the exemplary process, first, for each trigon $T_i$ in the candidate MHTC, a first score is calculated as:

$$1000\times\mathrm{Min}(T_i.\mathrm{nSwing},\ T_{i-1}.\mathrm{nSwing})/\mathrm{Max}(T_i.\mathrm{nSwing},\ T_{i-1}.\mathrm{nSwing})$$

where $T_i$.nSwing is the height of trigon Ti in the candidate MHTC, and $T_{i-1}$.nSwing is the height of the left (or right) consecutive trigon ($T_{i-1}$) of Ti in the candidate MHTC. Min($T_i$.nSwing, $T_{i-1}$.nSwing) is the smaller one of $T_i$.nSwing and $T_{i-1}$.nSwing, and Max($T_i$.nSwing, $T_{i-1}$.nSwing) is the greater on of $T_i$.nSwing and $T_{i-1}$.nSwing. If a trigon, which should have appeared in the MHTC, is missing, that is, a flaw appears, then the above score is set to zero.

Then the average score $$s=\Sigma 1000\times\mathrm{Min}(T_i.n\mathrm{Swing},T_{i-1}.n\mathrm{Swing})/\mathrm{Max}(T_i.n\mathrm{Swing},T_{i-1}.n\mathrm{Swing})/n\mathrm{ChainStep}$$

is calculated for all the trigons Ti in the candidate MHTC. Where nChainStep is the number of steps (one step=width of one trigon in the candidate peak) contained in the MHTC.

Finally, a score is calculated:

$$\mathrm{Score}=s\times(n\mathrm{ChainStep}-n\mathrm{StepFlaw})/n\mathrm{ChainStep})\times(n\mathrm{ChainLen}/n\mathrm{SSegLen})$$

Where nStepFlaw is the total number of flaws in the current sub-section, nChainLen is the length of the candidate MHTC (the distance from the leftmost trigon in the MHTC to the rightmost trigon in the candidate MHTC), and nSSegLen is the length of the current sub-section.

After scoring the candidate MHTC for the current candidate peak, the process advances to step S2212 shown in FIG. 22.

In another preferred embodiment, during the MHTC constructing and scoring process in step S2208 of FIG. 22, the MHTC determining and scoring unit 1911, instead of only choosing the trigon having the maximum height in the candidate chained peak and using it as the starting trigon for constructing candidate MHTC, selects in the candidate chained peak a plurality of trigons having enough height from trigons within the range of one step (width) of the candidate peak, constructs a candidate MHTC for each of the chosen trigons by using the trigon as the starting trigon, scores for each of the candidate MHTC constructed, and selects the candidate MHTC with the maximum score as the candidate MHTC of the current candidate peak.

Figure 28:
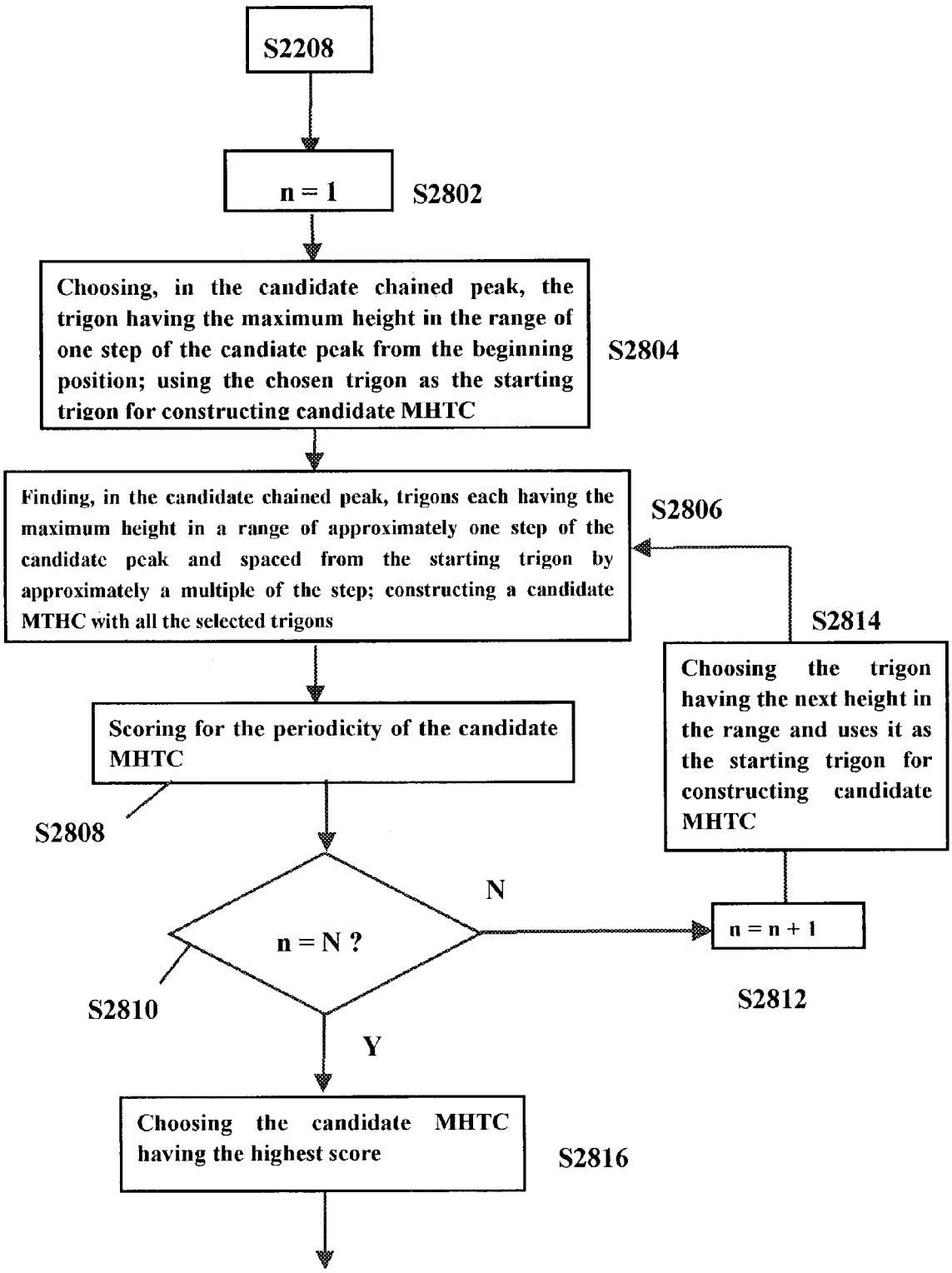
FIG. 28 is a flowchart showing another preferred embodiment of the process of the present invention for constructing a candidate MHTC.

FIG. 28 shows the flowchart of such a preferred embodiment. As shown in FIG. 28, steps S2804, S2806 and S2808 correspond to step S2704, S2706 and S2708, respectively. At step 2810, the process determines if the number of starting trigons chosen has reached a predetermined number N, which is preferably in the range of 1-3. If the result of step S2810 is "NO", then the process goes to step S2814, where the trigon having the next height is chosen as the starting trigon. Then, the process returns to step S2806 to construct a new candidate MHTC for the current candidate peak. If, on the other hand, the result of step S2810 is "YES", the process goes to step S2816, where the candidate MHTC having the highest score is chosen as the candidate MHTC for the current candidate peak.

In the embodiment, the process in step S2216 for scoring the candidate chained peak is the same as described above, i.e., the process of step S2216 is the same as the scoring process in step S2208, but the scoring is performed on the trigons of candidate chained peak rather than on the trigons of a constructed candidate MHTC. In other words, the series of all trigons in the candidate chained peak is taken as the candidate MHTC for the scoring process of step S2216.

Figure 25:
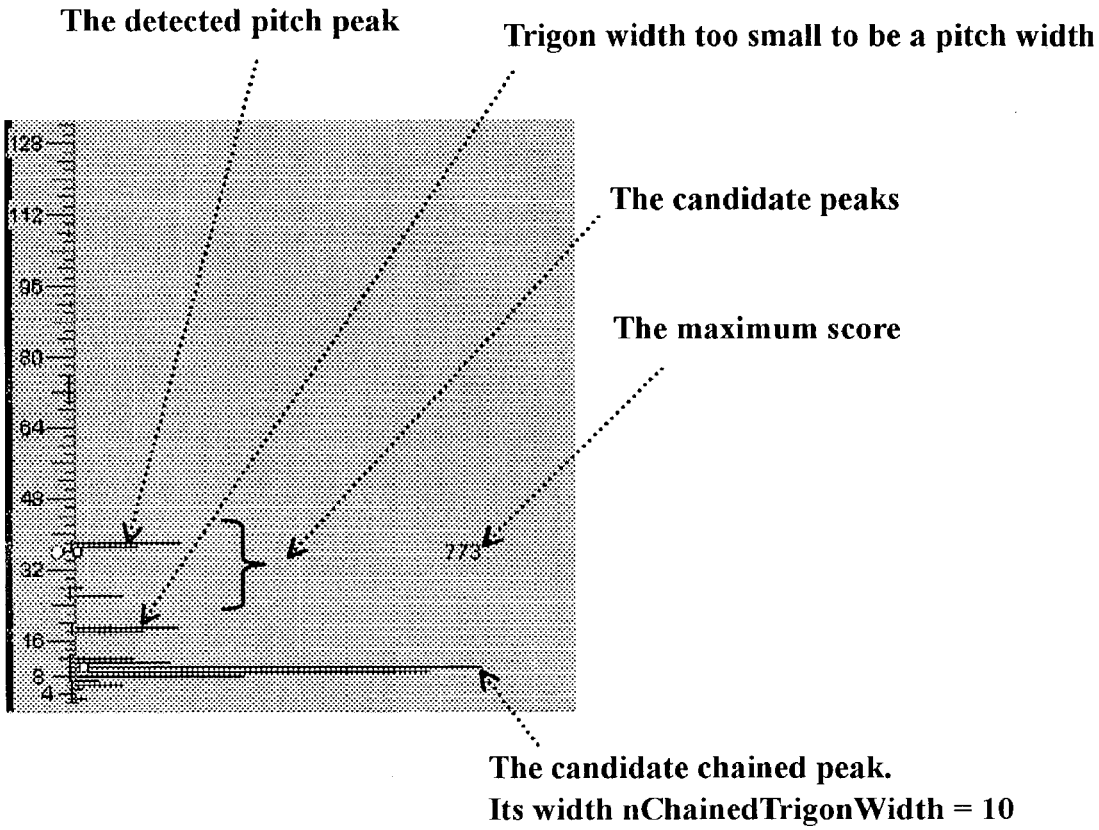
FIG. 25 shows the results of pitch detection of the present invention performed on the sound signal shown in FIG. 18.
Figure 26:
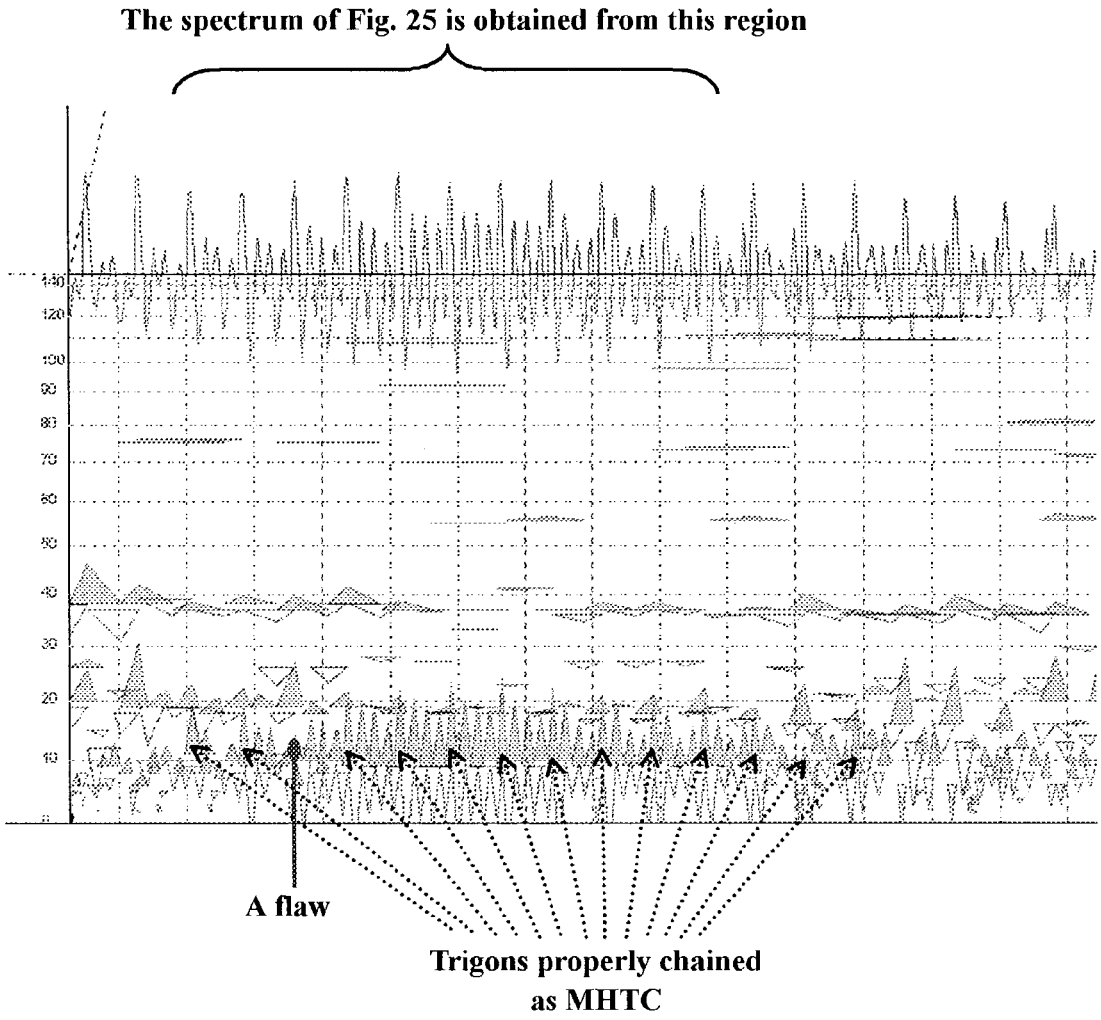
FIG. 26 shows the maximum height trigon chain (MHTC) detected for the sound signal shown in FIG. 18.

FIG. 25 shows the results of pitch detection of the present invention performed on the sound signal shown in FIG. 18, and FIG. 26 shows the detected MHTC.

In the example as shown in FIGS. 18 and 25, the candidate chained peak is determined as having a trigon width of 10, and three candidate peaks are detected as having widths of 19, 26, and 38, respectively.

In a preferred embodiment, for determining the candidate chained peak and candidate peaks, peaks that are sufficiently close to one another are combined into a single peak, as described above. In a preferred embodiment, for a peak with a height of nPeak, all the peaks within the range of nPeak/6+2 are combined into this peak. After such a peak-combining process, the two peaks at around the width of 19 are combined as a single peak at 19, and the two peaks at around the width of 38 are combined into a single peak of 38, and the several peaks at around 10 are combined into a single peak at 10.

Such a peak-combining process dramatically reduces the number of peaks to be tested and greatly improves the efficiency of pitch detection. As for the example shown in FIGS. 19 and 25, the number of candidate peaks is limited to 3.

Then, the periodicity determining and evaluating unit 1903 constructs a candidate MHTC for each of the candidate peaks and calculates a score for each of the candidate peaks, as explained above in step S2208. As an alternative preferred embodiment, the periodicity determining and evaluating unit 1903 comprises a candidate peak pre-screening unit, which performs a pre-screening process, wherein any candidate peaks with a trigon width that is too short for being a pitch width (that is, the width of the candidate peak is too close to that of the candidate chained peak) are discarded. It is to be noted, however, the fact that the width of a candidate peak may be too short for being a pitch width does not mean that the width of the candidate chained peak, which is shorter than the candidate peak, may not be the pitch width. The reason is that for a candidate peak to be a pitch peak, it needs to have a width sufficiently greater than that of the candidate chained peak.

So as shown in FIG. 25, the candidate peak at the width of 19 is determined in the pre-screening process as being too short for being a pitch width and is discarded from the MHTC constructing and scoring process. This further improves the efficiency of pitch detection.

Figure 30A:
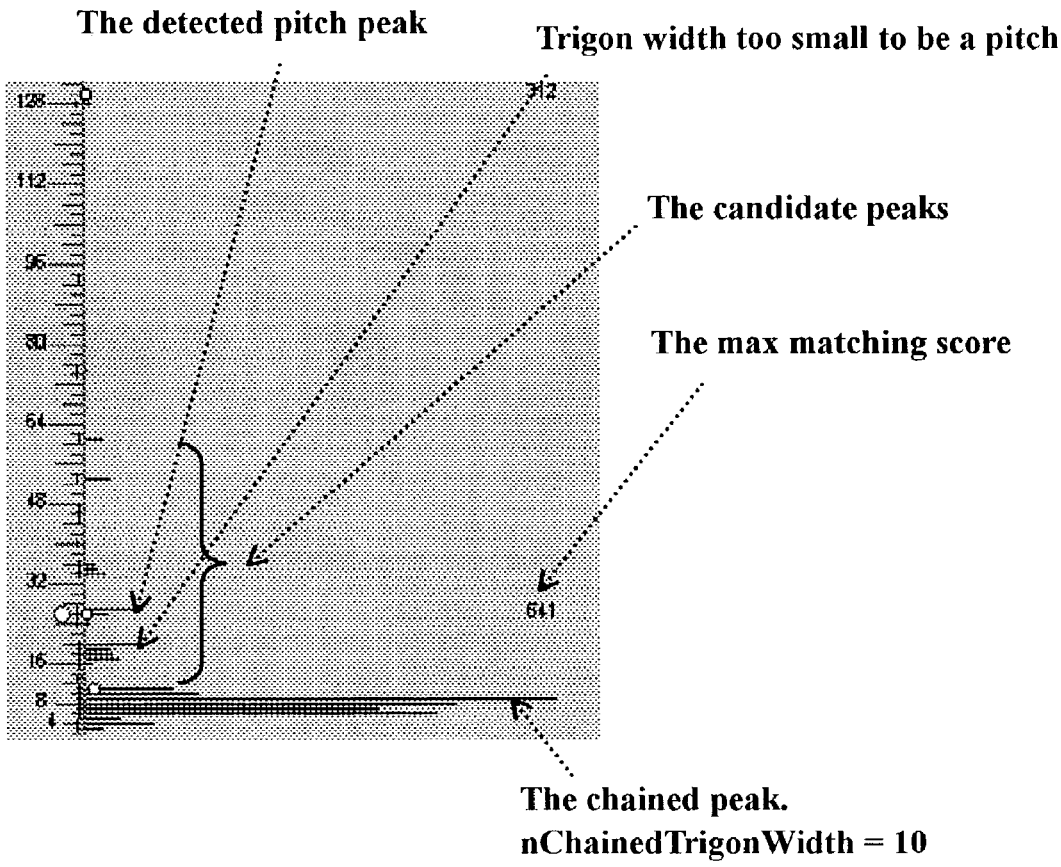
FIG. 30*a* shows, in the upper part thereof, the waveform of an example of a sound signal having a strong pitch frequency and also shows, in the lower part thereof, the trigons extracted from this waveform using WTT.
Figure 30B:
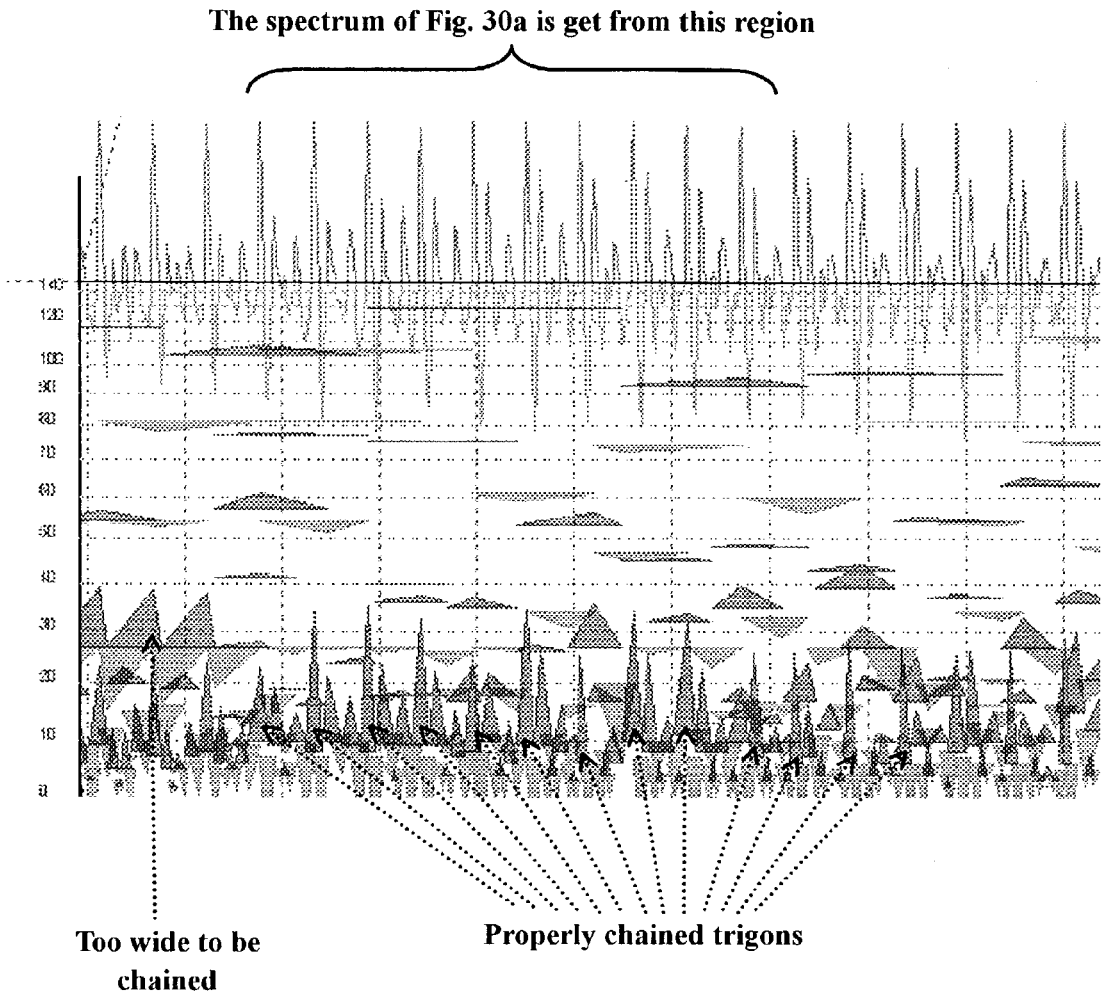
FIG. 30*b* shows the width-energy spectrum of the sound signal shown in the upper part of FIG. 30*a;*

FIG. 30*b* shows, in the upper part thereof, the waveform of another example of a sound signal containing vowel and also shows, in the lower part thereof, the trigons extracted from this sound signal using WTT, and FIG. 30*a* shows the width-energy spectrum of the sound signal shown in the upper part of FIG. 30*b*. As shown in 30*a*, and candidate chained peak is found at the width of 10, and by constructing a candidate MHTC with trigons in the candidate chained peak a maximum score of 641 is obtained for the peak at the width of approximate 27. The score is higher than the threshold for the pitch detection. So the candidate peak of width 27 is detected as the pitch peak.

Figure 29A:
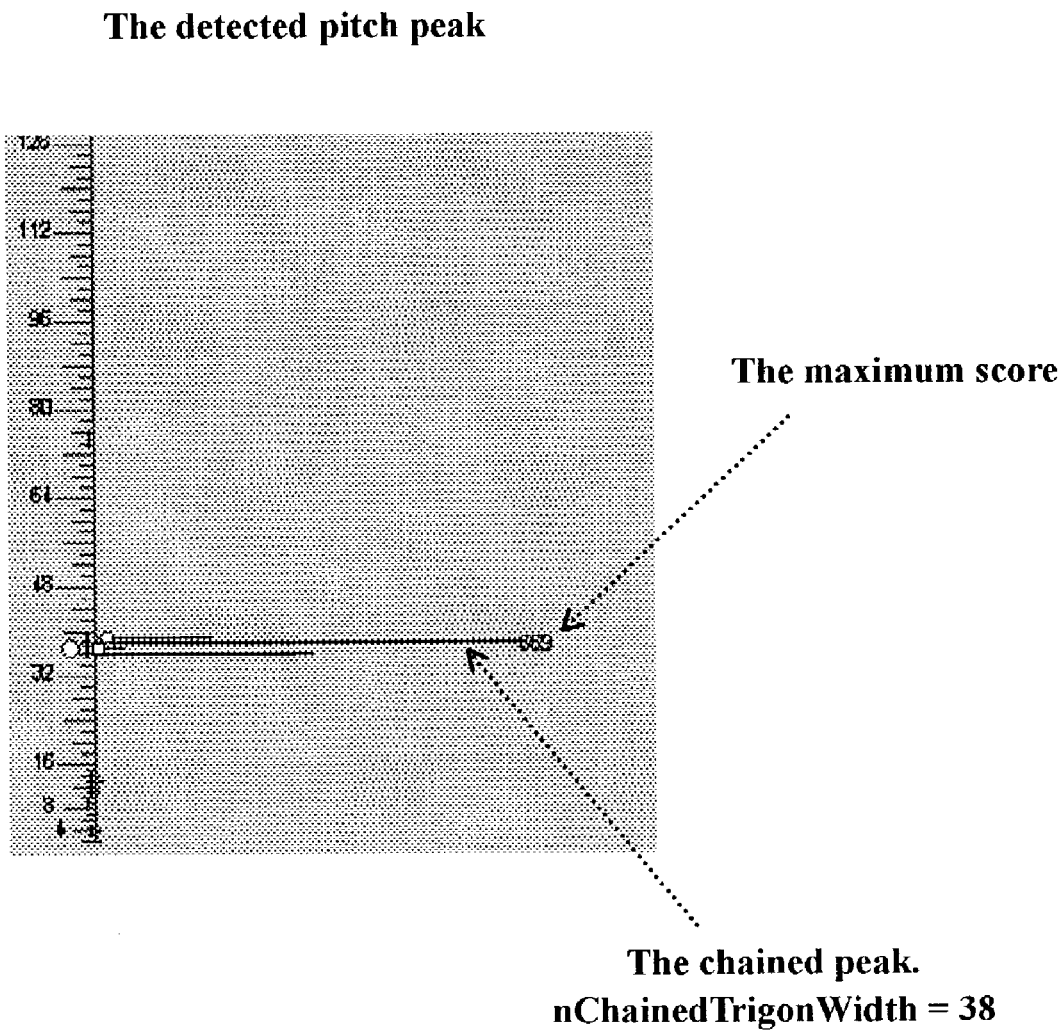
FIG. 29*a* shows, in the upper part thereof, the waveform of another example of a sound signal containing vowel and also shows, in the lower part thereof, the trigons extracted from this sound signal using WTT.
Figure 29B:
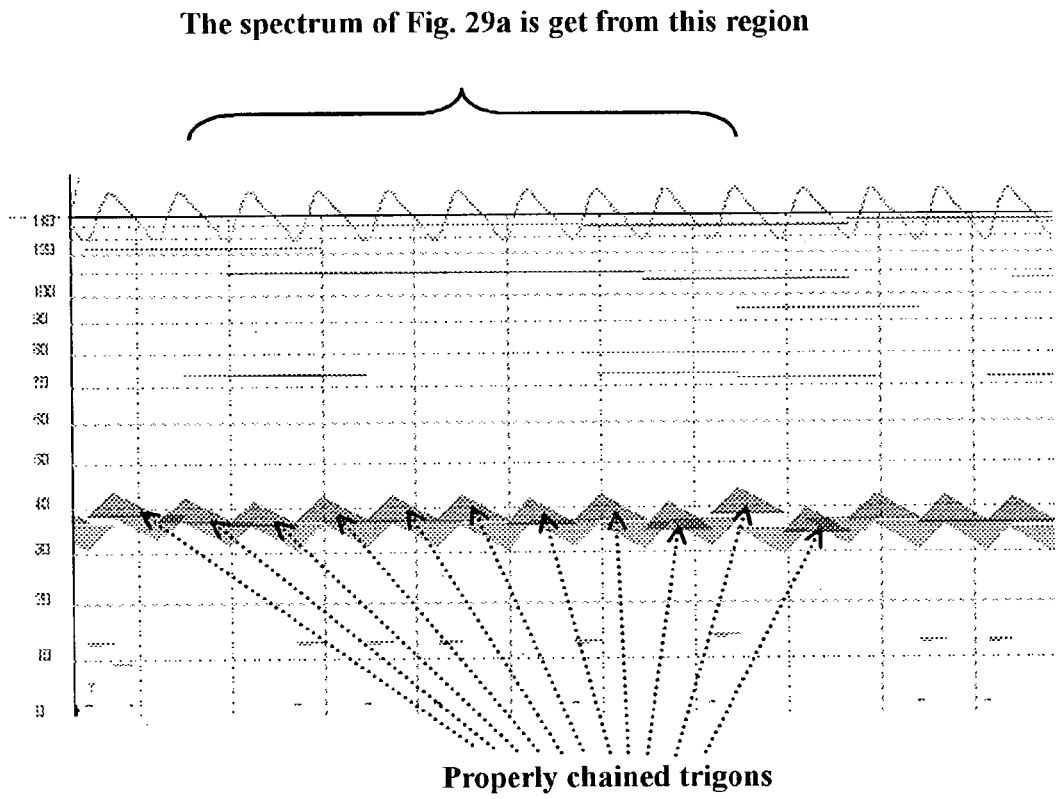
FIG. 29*b* shows the width-energy spectrum of the sound signal shown in the upper part of FIG. 29*a;*

FIG. 29*b* shows, in the upper part thereof, the waveform of an example of a sound signal having a strong pitch frequency and also shows, in the lower part thereof, the trigons extracted from this waveform using WTT, and FIG. 29*a* shows the width-energy spectrum of the sound signal shown in the upper part of FIG. 29*b*. As shown in FIG. 29*a*, and candidate chained peak is found at the width of 38, and by constructing a candidate MHTC with trigons in the candidate chained peak a maximum score of 669 is obtained for the candidate chained peak itself The score is higher than the threshold for the pitch detection. So the candidate chained peak itself is detected as the pitch peak.

Figure 31A:
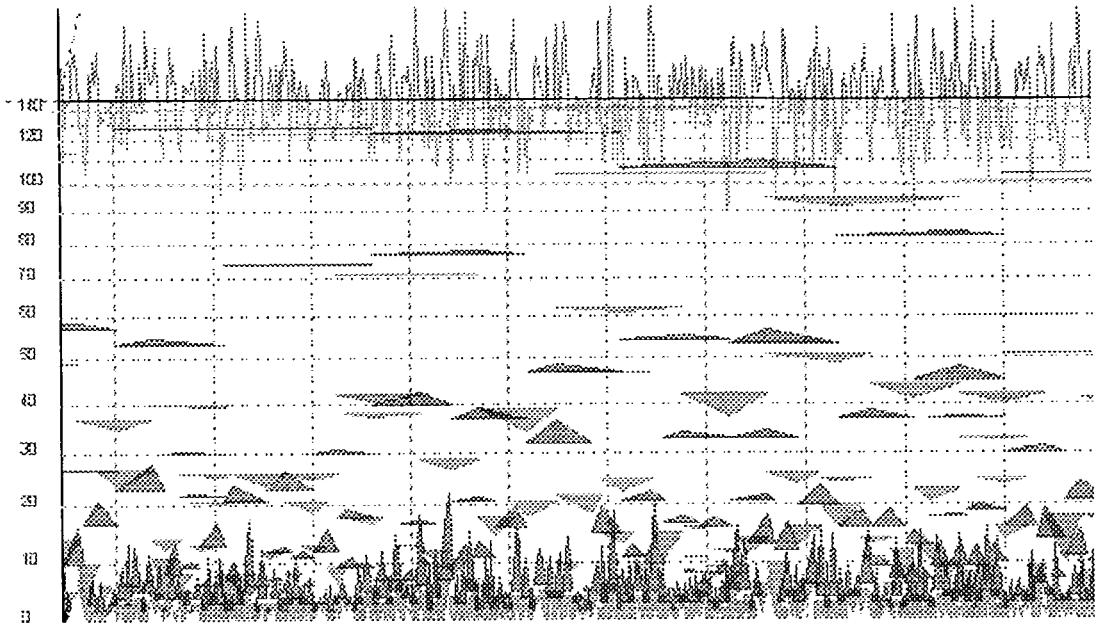
FIG. 31*a* shows, in the upper part thereof, the waveform of an example of a sound signal, which is detected as high-frequency noise segment, and also shows, in the lower part thereof, the trigons extracted from this waveform using WTT.
Figure 31B:
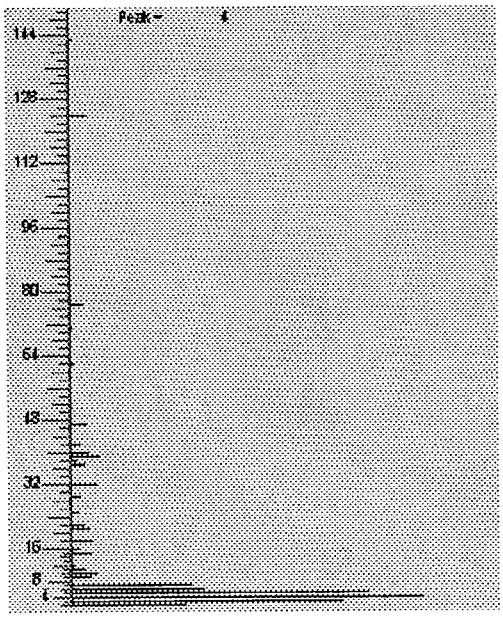
FIG. 31*b* shows the width-energy spectrum of the high frequency noise sound signal shown in the upper part of FIG. 31*a;*

FIG. 31*a* shows, in the upper part thereof, a waveform of an example of a sound signal segment, which is detected as high-frequency noise segment, and also shows, in the lower part thereof, the trigons extracted from this waveform using WTT. FIG. 31*b* shows the width-energy spectrum of the high frequency noise sound signal shown in the upper part of FIG. 31*a*. As shown in FIG. 31*b*, the signal has only high peaks in high frequency and very low energy in pitch frequency area. So no candidate peak can be found having a score higher than the threshold for the signal. And the signal segment is detected as a high-frequency noise segment.

Figure 32A:
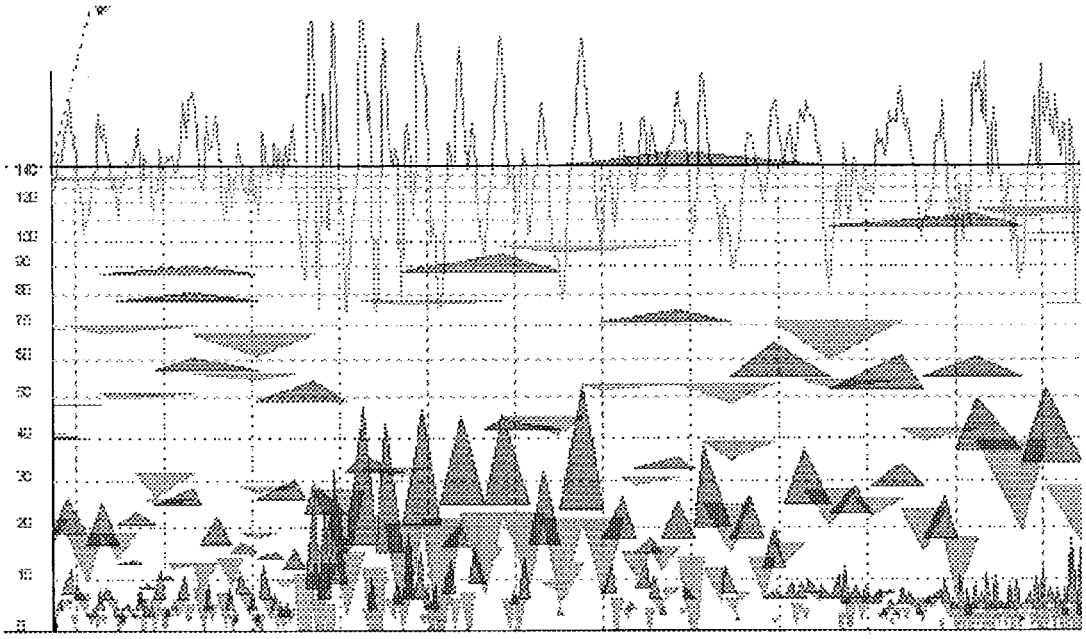
FIG. 32*a* shows, in the upper part thereof, the waveform of an example of a sound signal, which is detected as a noise segment, and also shows, in the lower part thereof, the trigons extracted from this waveform using WTT.
Figure 32B:
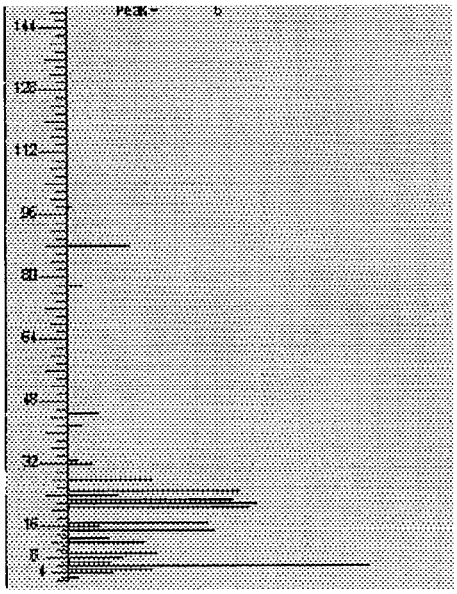
FIG. 32*b* shows the width-energy spectrum of the noise sound signal shown in the upper part of FIG. 32*a;*

FIG. 32*a* shows, in the upper part thereof, the waveform of an example of a sound signal segment, which is detected as a noise segment, and also shows, in the lower part thereof, the trigons extracted from this waveform using WTT. FIG. 32*b* shows the width-energy spectrum of the noise sound signal shown in the upper part of FIG. 32*a*. As shown in FIG. 32*b*, although there are peaks that in the range of pitch width, none of these peaks has a score equal to or above the threshold. So the segment of signal is detected as a noise segment.

Figure 33:
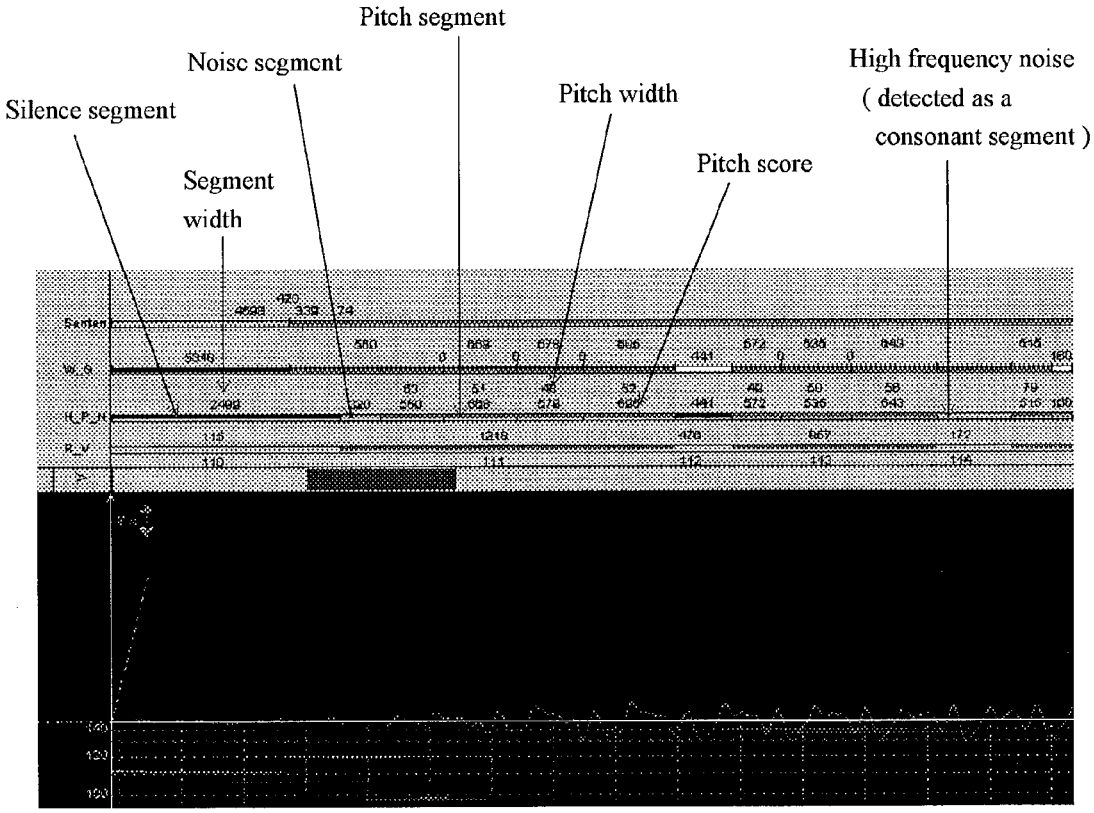
FIG. 33 shows a display of the results of the operation of the pitch detecting apparatus of an embodiment of the present invention, wherein a sound signal is divided into pitch segments, high-frequency noise segments, noise segments, and silence segments.

A result of the pitch detecting apparatus according to an embodiment of the present invention is shown in FIG. 33. As shown in FIG. 33, the bar labeled R_V is the result of the input signal dividing unit 111, the values above the bar indicate the signal levels of respective sections of the signal. The bar mark H_P_N is the result of the pitch detecting process of pitch detecting apparatus according to an embodiment of the present invention, and it shows that the input sound signal is divided into pitch segments, high-frequency noise segments, noise segments, and silence segments.

Figure 39:
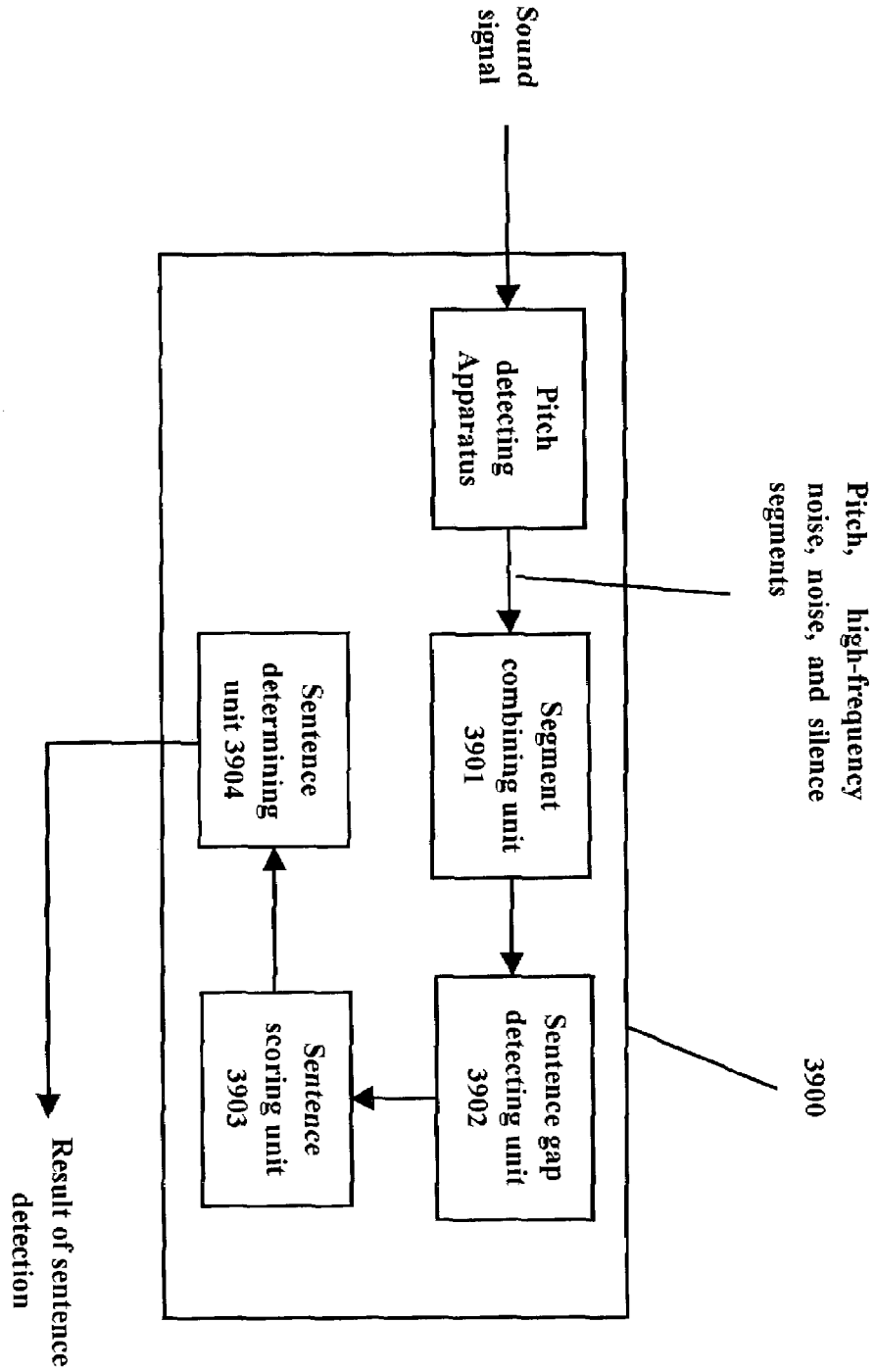
FIG. 39 is a block diagram showing the arrangement of a sentence detecting device according to an embodiment of the present invention.

As shown in FIG. 33, a sound signal, which is processed by the pitch detecting apparatus of the present invention, is divided into silence segments, high-frequency noise segments, pitch segments, and noise segments. The sound signal thus divided is inputted to the sentence detecting device 3900 of the present invention as shown in FIG. 39. As shown in FIG. 39, a segment combining unit 3901 converts the each of the non-silence portions consisting of high-frequency noise segments, pitch segments, and noise segments into a non-silence portion consisting of word segments, gap segments, and consonant segments.

A word segment is a segment containing pitch. If any part of a word segment does not contain pitch, then this part should removed from the word segment so that a pitch appears everywhere in the word segment.

A consonant segment is one that contains high-frequency noise. Since in human speaking a consonant must appear with a vowel, which has a pitch, so a high-frequency noise segment has to be immediately before or after a pitch (word) segment to be a consonant segment, otherwise it would be regarded as a non-consonant high-frequency noise segment.

A gap is a segment that is neither a pitch segment nor a consonant segment. So any segment between two pitches that is neither a pitch segment nor a consonant segment is determined as a gap segment. In addition, if no gap segment is detected between two adjacent pitch segments, then a gap segment having a width of zero is added between the two adjacent pitch segments, for the propose of determining if a separation between two sentences should be made at the position of such a gap having a zero width.

FIG. 39 shows the arrangement of a sentence detecting device according to an embodiment of the present invention, which comprises: a pitch detecting apparatus according to an embodiment of the present invention, a segment combining unit 3901, sentence gap detecting unit 3902, a sentence scoring unit 3903, and a sentence determining unit 3904.

While not shown in FIG. 39, an input signal dividing unit and a section selecting unit (as the input signal dividing unit 111 and the section selecting unit 112 shown in FIG. 19) may be used to divide the input sound signal into silence sections and signal sections and select the signal sections for processing by later stage of the sentence detecting device.

The operation of each parts of the sentence detecting device according to an embodiment of the present invention of FIG. 39 will be described below in detail with reference to FIGS. 34-38.

Figure 34:
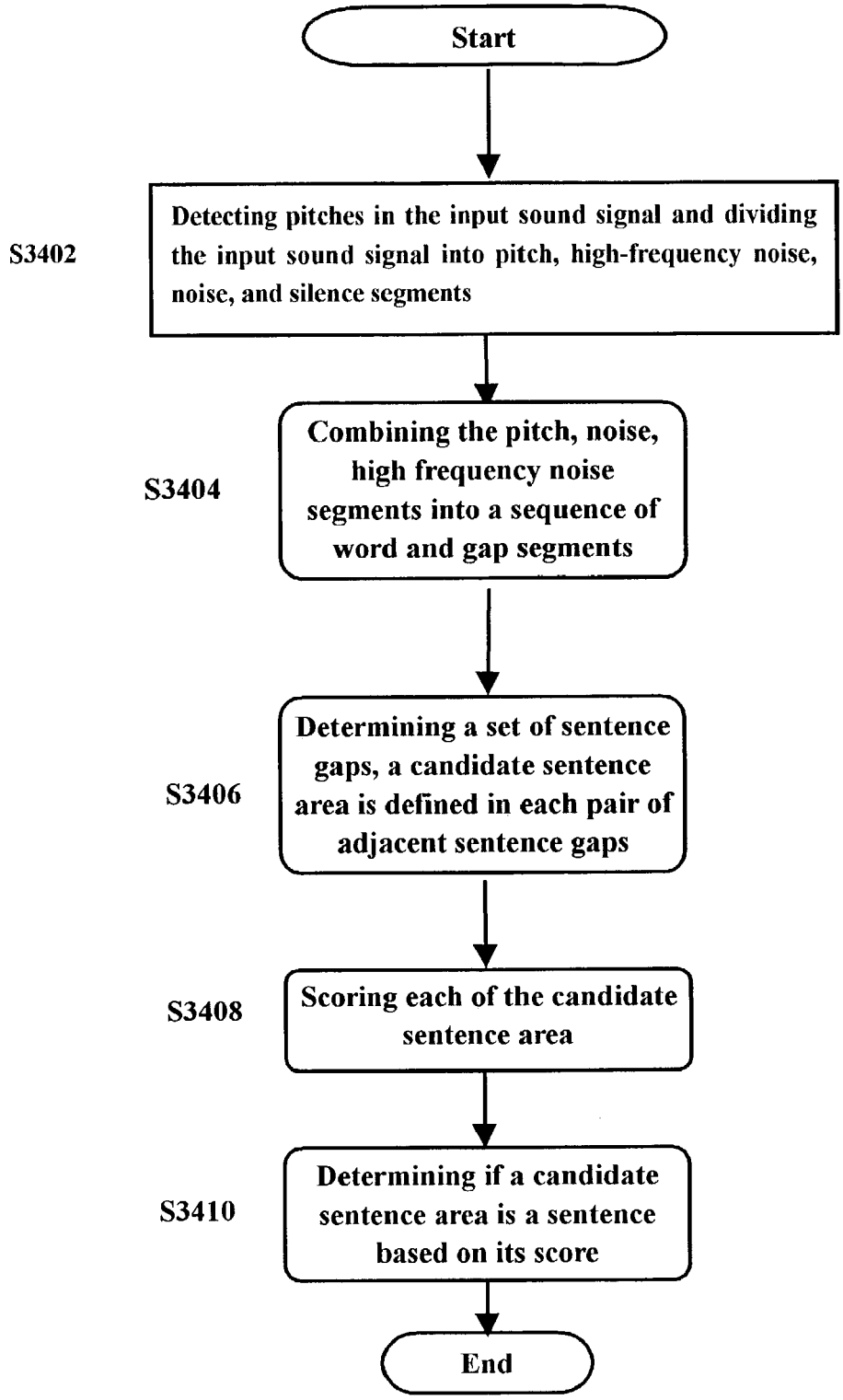
FIG. 34 is a flowchart showing the process of sentence detection according to an embodiment of the present invention.

FIG. 34 shows a flow chart of the process for detecting sentence according to an embodiment of the present invention. As shown in FIG. 34, after the start of the sentence detecting process, pitch detection is performed (step S3402) using the pitch detecting apparatus according to an embodiment of the present invention, such as the pitch detecting apparatus described above. As explained above, with the pitch detecting process of the present invention, the input sound signal is divided into pitch segments, noise segments, high-frequency noise sections, and silence section, as shown in FIG. 33 with the bar labeled "H_P_N".

Then, the process goes to step S3404, where the segment combining unit 3901 performs a segment combining process, as described in detail below.

Figure 35:
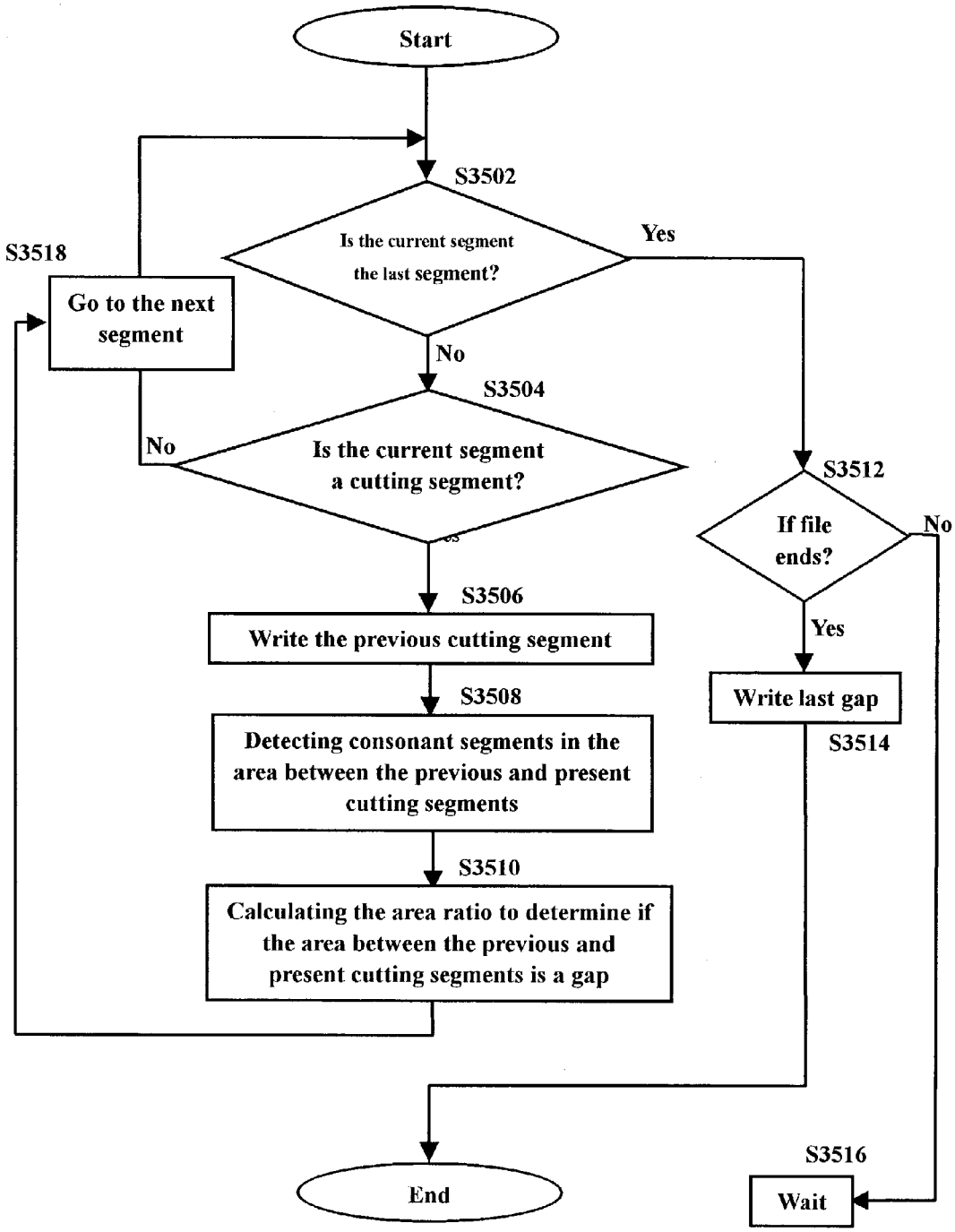
FIG. 35 is a flowchart showing the process of step S3404 of FIG. 34 according to an embodiment of the present invention.

FIG. 35 is a flowchart showing the process of step S3404 of FIG. 34 according to an embodiment of the present invention, performed by the segment combining unit 3901.

Referring to FIG. 35, after the start of the process of step S3404 of FIG. 34, it is determined if the current segment (pitch, high-frequency noise, noise, or silence segment) is the last segment (step S3502). If the result of step S3502 is "YES", then the flow goes to step S3512, where it is determined if the file to be processed ends. If the result of step S3512 is "YES", then the last gap is written and the process of step S3404 ends. If the result of step S3512 is "NO", then the process enters a waiting state (step S3516).

On the other hand, if the result of step S3502 is "NO", the process goes to step S3504, where it is determined if the current segment is an appropriate cutting segment.

Figure 38:
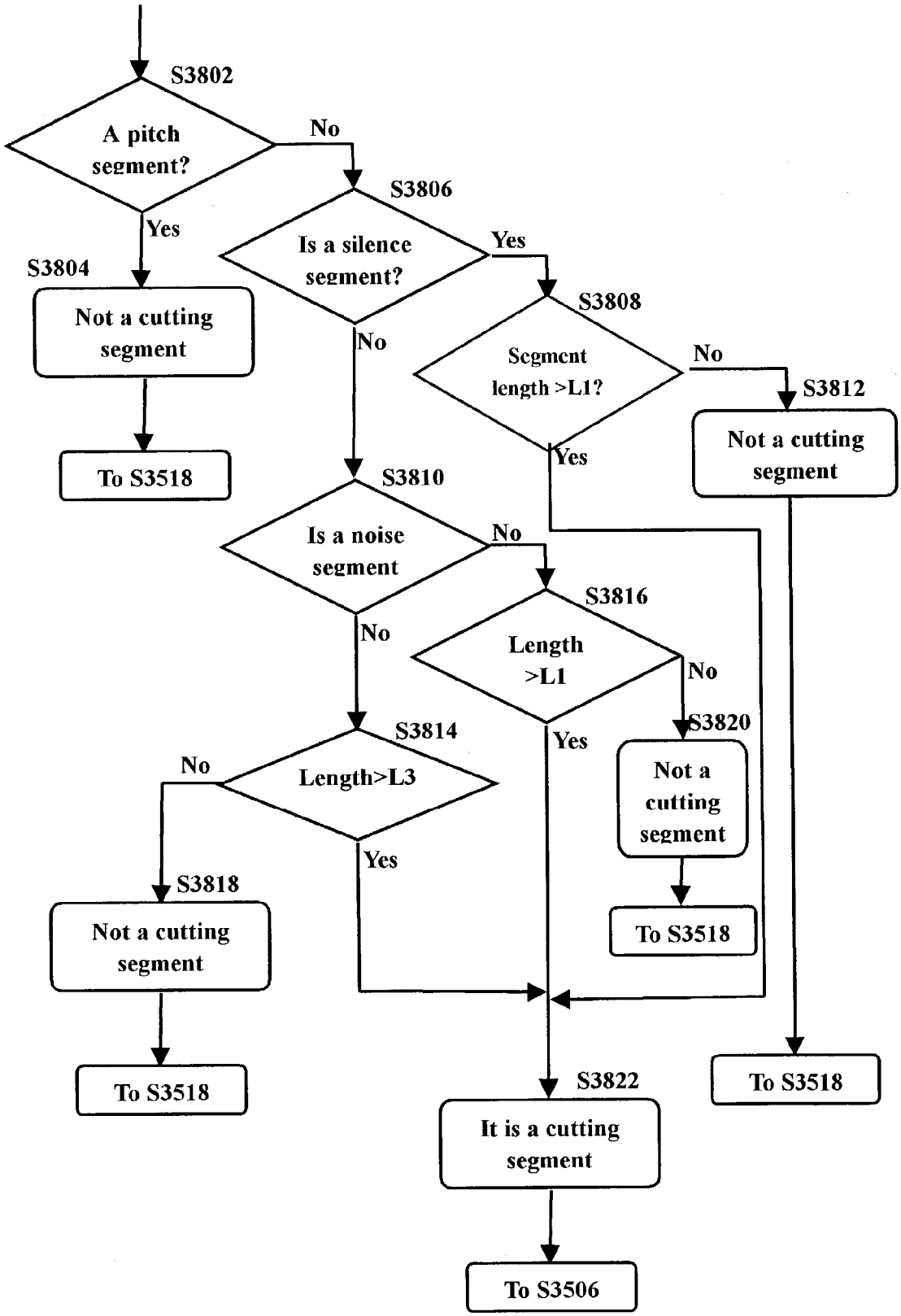
FIG. 38 is a flow chart showing the process of step S3504 of FIG. 35 for determining whether the current segment is an appropriate cuffing segment according to an embodiment of the present invention.

FIG. 38 shows a flow chart of a process for determining whether the current segment is an appropriate cutting segment according to an embodiment of the present invention In the embodiment shown in FIG. 38, it is first determined if the current segment is in a pitch portion (step S3802). If "YES", it is determined that the current segment is not a cutting segment (step S3804), and the process goes to step S3518 of FIG. 35. If the result of step S3802 is "NO", then it is determined whether the current segment is a silence segment (step S3806).

If the result of Step S3806 is "YES", it is determined if the width of the current segment is greater than a threshold L1=m_nMinBreakSVWidth (step S3808). If the result of step S3808 is "NO", then the current segment is determined as not being a cutting segment (step S3812), and the process goes to step S3518 of FIG. 35. On the other hand, if the result of step S3808 is "YES", then the current segment is determined to be a cutting segment (step S3822), and the process goes to step S3506 of FIG. 35.

If the result of step S3806 is "NO", then it is determined whether the current segment is a noise segment (step S3810).

If the result of step S3810 is "YES", it is determined whether the length of the current segment is greater than a threshold L2 (step S3816). If "YES", then the current segment is determined to be a cutting segment (step S3822), and the process goes to step S3506 of FIG. 35.

If the result of step S3816 is "NO", then the current segment is determined as not being a cutting segment (step S3820), and the process goes to step S3518 of FIG. 35.

If the result of step S3810 is "NO", meaning the current segment is a high-frequency noise segment, then it is determined whether the length of the current segment is greater than a threshold L3 (step S3814). If "YES", then the current segment is determined to be a cutting segment (step S3822), and the process goes to step S3506 of FIG. 35.

If the result of step S3814 is "NO", then the current segment is determined as not being a cutting segment (step S3818), and the process goes to step S3518 of FIG. 35.

A preferred range of L1, L2 and L3 is 200-1000.

In another embodiment, another process is used to realized the process of step S3504 for determining whether a current segment is a cutting segment. In this embodiment, first, it is determined whether the current segment is a pitch segment. If "YES," then it is not a cutting segment; if "NO", then it is determined whether the length of the current segment is greater than a threshold L4=m_nMaxConsHlenth/2; if the length of the current segment is greater than L4, then it is a cutting segment; if the length of the current segment is not greater than L4, then it is determined if the current segment is a silence segment; if the current segment is a silence segment, then it is not a cutting segment; if the current segment is not a silence segment, then it is determined whether it is a high frequency noise segment; if the current segment is a high frequency segment, then it is not a cutting segment; if the current segment is not a high frequency noise, then it is determined whether the length of the current segment is greater than L1; if "YES" then it is a cutting segment, otherwise it is not a cutting segment.

A preferred range of m_nMaxConsHlenth is 1000-4000 samples (at a rate of 11025 sample/sec.), and it is chosen as 3000 samples in the present embodiment.

A preferred range of L1 is 200-1000 samples, and L1=610 is chosen in the present embodiment.

Back to FIG. 35, when at step S3504 the current segment is determined as not being a cutting segment, the process goes to step S3518, and the segment next to the current segment is taken as the current segment for processing, and then the process returns to step S3502.

When at step S3504 the current segment is determined as being a cutting segment, the process goes to step S3506, where the previous cutting segment is written.

Then the process goes to step S3508, where it is determined whether each of the high-frequency noise segments between the current cutting segment and the previous cutting segment is a consonant segment.

There are two types of consonant: a head consonant and a tail consonant. A head consonant is a consonant in front of a pitch, and a tail consonant is one that follows a pitch.

In an embodiment of the present invention, whether a high-frequency noise segment is a high-frequency noise segment is determined in accordance with the distance (time) from the consonant segment to the pitch segment nearest to it. Specifically, in an embodiment, the time from the starting point of the high-frequency noise segment to the starting point of the nearest pitch segment is measured and compared with a threshold D. If the time is greater than or equal to D, then the high-frequency noise segment is determined as a non-consonant high-frequency noise segment. On the other hand, if the time is smaller than D, then the high-frequency noise segment is determined as a consonant segment.

A preferred range of D is 300-800 samples (at 11025 sample/sec.), and D=600 samples is chosen in the present embodiment.

Then, the process of FIG. 35 goes to step S3510 for determining whether the region between the previous cutting segment and present cutting segment should be treated as a gap entirely by calculating an ratio of the total length of the word (pitch) and consonant segments between the previous cutting segment and present cutting segment to the total length of the remaining segments between the previous cutting segment and present cutting segment.

When a person speaks, in the duration of a sentence, the total length of words (pitches) and consonants should occupy a great enough portion of the duration. In other word, in the duration of a sentence, the ratio of the total length of word segments and consonant segments to the total length of the remaining segments must be greater than a certain value.

So in step S3510 of FIG. 35, the sum of pitch segments and consonant segments in the region between the previous cutting segment and present cutting segment is calculated, the sum of the segments other than the pitch and consonant segments in the region is calculated, and the ratio of the sum of pitch and consonant segments to the sum of the segments other than the pitch and consonant segments is calculated. Then, the ratio is compared with a threshold TA to determined if the ratio is greater than or equal to TA. If the ratio is greater than or equal to TA, then the region is determined as a word region. If the ratio is smaller than TA, then the region between the previous cutting segment and present cutting segment is entirely determined as a gap.

A preferred range of TA is 0.8-1.2, and TA-1.0 is chosen in the present embodiment.

After step S3510, the process return to step S3502.

Back to FIG. 34, after step S3404, the process goes to step S3406, where the sentence gap determining unit 3902 determines a set of sentence gaps.

Figure 36:
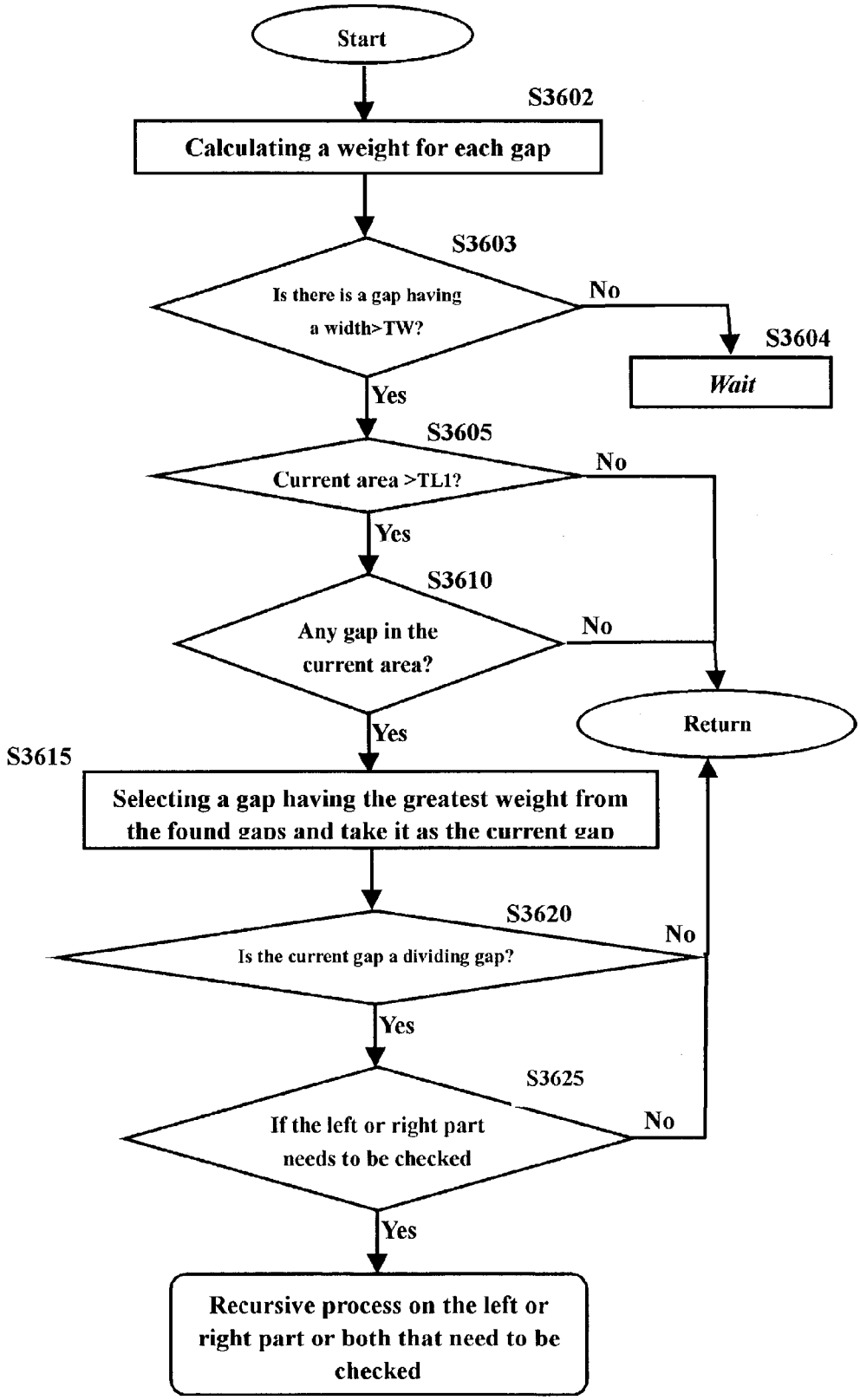
FIG. 36 is a flowchart showing the process of step S3406 of FIG. 34 according to an embodiment of the present invention.

FIG. 36 is a flowchart showing the process of step S3406 of FIG. 34 according to an embodiment of the present invention performed by the sentence gap determining unit 3902.

As shown in FIG. 36, after the beginning of the process of step S3406, a weight is calculated for each of the gaps as determined in step S3510 of FIG. 35.

To calculate the weight of a gap, first, it is determined if a pitch exists both before and after the gap.

If a pitch exists both before and after the gap, then maxP=the maximum pitch of the two pitches, and minP=minimum pitch of the two pitches are calculated; if the width of the gap=0, then $$\text{weight of the gap}=(\text{MIN_SPECTRUM_RANGE}\times 4)\times(\max P-\min P)/\min P$$

and if the width of the gap≈0, then $$\text{weight of the gap}=n\text{Width}+((n\text{Width}\times(\max P-\min P))/\min P$$

where nWidth is the width of the gap, and MIN_SPECTRUM_RANGE is the range of the energy-width spectrum as described above. In an embodiment, MIN_SPECTRUM_RANGE is taken as 640 samples. Of course, other values can be used for MIN_SPECTRUM_RANGE.

if no pitch exists before or after the gap, then

Weight of the current gap=width of the gap

Thus, a weight is calculated for each gap.

Then, the process goes to step S3603, where the sentence gap determining unit 3902 checks whether one of the gaps has a width larger than a threshold TW, where TW=m_nMaxSentenceCutW A preferred range of TW is 3000-6000 samples (at 11025 sample/sec.), and TW=4000 is chosen in the present embodiment.

If a gap having a width greater than TW is not found, then the process goes to step S3604, where the process waits for upcoming input signal.

On the other hand, if a gap having a width greater than TW is found in step S3603, then the gap is regarded as a stopping gap and the process goes to step S3605, where it is determined if the length of the area from the beginning position to the stopping gap is greater than a threshold TL1, where TL1=m_nMaxSentenceLength A preferred range of TL1 is 70,000-110,000 samples (at 11025 samples/sec.), and TL1=88,000 samples is chosen in the present embodiment.

If the result of step S3605 is "NO", then the process returns. If the result of step S3605 is "YES", then, the process goes to step S3610, where it is determined if a gap exist in the area between the beginning position and the stopping gap.

If the result of step S3610 is "NO", then the process returns. If the result of step S3610 is "YES", then the process goes to step S3615, where from the found gaps a gap having the greatest weight as calculated in step S3602 is selected as the current gap.

If only one gap is found in step S3610, then it is selected as the current gap in step S3615.

Then, at step S3620, it is determined whether the current gap is a dividing gap.

In an embodiment, in the process at step S3620, it is determined whether the width of the current gap is greater than Max(TWD1, TWD2), where TWD1=m_nMaxSentenceCutW is the lower limit for a gap to be detected as a dividing gap, and TWD2=m_nMaxSentenceCutWRatio.

If the result is "NO", then the current gap is determined as not being a dividing gap, and the process returns.

A preferred range of TWD1 is 3000-6000 samples (at 11025 sample/sec.), and TWD1=4000 samples is chosen in the present embodiment.

A preferred range of TWD2 is 60%-95% of the width of the current stopping gap, and TWD2=(80% of the width of the present stopping gap) is chosen in the present embodiment.

On the other hand, if the result of step S3620 is "YES", meaning that the current gap is a dividing gap, then the process goes to step S3625, where it is determined whether the part from the beginning position to the dividing gap and the part, from the dividing gap to the stopping gap should be further dividing.

In an embodiment, it is determined whether the length of each of the the part from the beginning position to the dividing gap and the part from the dividing gap to the stopping gap found in step S3603, is greater than a threshold TL2, where TL2=m_nMaxSentenceLength.

A preferred range of TL2, is 35,000-55,000 samples (at 11025 samples/sec.), and TL2=44,000 samples is chosen in the present embodiment.

If both the parts are shorter than TL2, then the dividing gap is taken as a sentence gap, and the process returns. If one of the parts is longer than TL2 and the other is shorter than TL2, then the dividing gap is taken as a sentence gap and the one of the two parts that is longer than TL2 is subject to the process of steps S3610 to S3625. With such a recursive process, all the sentence gaps are detected in the area from the beginning position to the stopping gap.

Then, by taking the present stopping gap as the beginning position, the process returns to step S3603 and the process from steps S3603 to S3625 and the recursive process (if needed) are repeated, until the end of the input audio file is reached. Each of the detected dividing gaps and the stopping gaps is taken as a sentence gap. Thus, a set a sentence gaps is determined in the present audio file , which set of sentence gaps includes all the dividing gaps and stopping gaps; and the area between each adjacent pair of sentence gaps is taken as a candidate sentence area.

These candidate sentence areas, each of which is determined as the area between a pair of adjacent sentence gaps, are to be judged as to whether each of them is a sentence, a music or sound region, or a noise region, as described below.

Back to FIG. 34, after step 3406, in which all the sentence gaps and candidate sentence areas are determined, the process goes to step S3408, where the sentence scoring unit 3903 calculates a score for each of the candidate sentence area, as described below with reference to FIG. 37.

Figure 37:
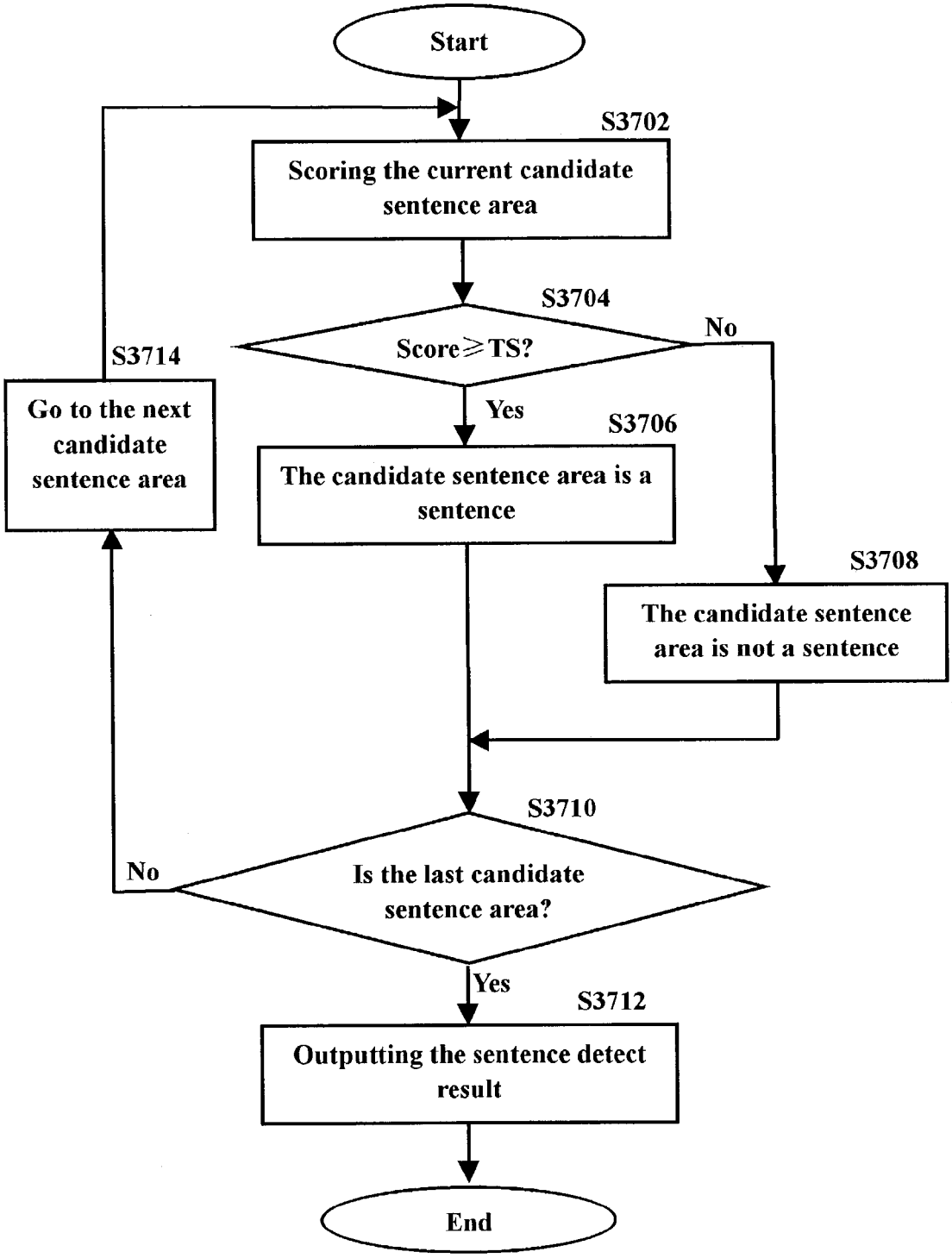
FIG. 37 is a flowchart showing the process of step S3408 of FIG. 34 according to an embodiment of the present invention.

As shown in FIG. 37, in step S3702, a score is calculated for the current candidate sentence area, wherein each of the candidate sentence areas is scored based on the following principles:

1) if the total length of all the pitch segments in a candidate sentence area is greater, then the candidate sentence area will be scored higher; and 2) if the total energy of all the pitches in a candidate sentence area is higher, then the candidate sentence area will be scored high, as in human speaking most energy is usually in pitch.

A process for scoring a candidate sentence area for determining if it is a true sentence according to an embodiment of the present invention is described now.

First, for all the word segments (segments each having pitch) in the candidate sentence area, calculating:

(1) a11=Σ(segment length);

(2) a12=Σ(pitch length×segment length)

(3) a13=Σ(pitch score×segment length), where pitch score is the score as calculated in step S2208 or S2216 of FIG. 22;

(4) a14=Σ(energy of the segment×segment length), where the energy is determined by the input signal dividing unit 111 shown in FIG. 19;

second, for all the gap segments in the candidate sentence area:

(1) b11=Σ(segment length);

(2) b12=Σ(energy of the segment×weight of the segment), where the energy of the segment is determined by the input signal dividing unit 111 shown in FIG. 19, and the weight of the segment is calculated as described above (step S3602 of FIG. 36);

third, for all the consonant segments in the candidate sentence area:

(1) c11=Σ(segment length);

(2) c12=Σ(energy of the segment×segment length), where the energy is determined by the input signal segmenting unit 111 shown in FIG. 19;

forth, calculating $$n\text{EnergyScore}=a14/(a14+b12+c12)$$

finally, calculating the score of the candidate sentence area:

$$n\text{Score}=a13\times n\text{EnergyScore}/(a11+b11)$$

After a score is calculated for each candidate sentence area, the sentence determining unit 3904 compare it with a threshold TS=m_nSentenceThreshold (step S3704).

A preferred range of TS is 60-150, and TS=80 is used in the present embodiment.

If the score is higher than or equal to the threshold, then the candidate sentence area is determined as a sentence or a music/voice area(step S3706). Otherwise, if the score is smaller than the threshold, the candidate sentence area is determined as not being a sentence (step S3708).

As an alternative embodiment, two predetermined threshold TS1 and TS2 (0<TS2<TS1) are used. And the score calculated for each candidate sentence area is compared with TS1 and TS2. If the score≧TS1, then the corresponding candidate sentence area is determined as a sentence. If TS1>the score≦TS2, then the corresponding candidate sentence area is determined as a music/voice area. If the score<TS2, the corresponding candidate sentence area is determined as a noise area.

As a further alternative embodiment, for each detected sentence, it is checked if the segment just before it is a consonant segment. If it is, then the consonant segment is included in the sentence. This is because in human speaking the consonant before a sentence may have very low energy.

The result of sentence detection according to an embodiment of the present invention is shown in FIG. 33. In FIG. 33, the bar labeled W_G is the result of the sentence gap determining unit 3902 according to an embodiment of the present invention. In addition, the bar label "Senten" is the final result of the sentence detecting device according to an embodiment of the present invention.

Although it is described in the above that only one candidate chained peak is chosen for pitch detection, it is also in the scope of the present invention to choose more than one candidate chained peaks and to perform the pitch detection process as described above for each of the chosen candidate chained peaks, as can be understood by one skilled in the art.

Although the term "energy-width spectrum" has been used in the specification, it is to be noted that other variables that can reflect the sum of height of trigons of the same width can be used. And in the present specification the term "energy-width spectrum" is used even if the height of peaks in the spectrum is actually not scaled in direct proportion of energy.

It is to be understood that the scoring process for MHTC is not limited to the specific example as described. Any scoring that reflects the periodicity of the MHTC can be used without departing from the spirit and scope of the present invention.

What is claimed is:

1. A method for analyzing a wave signal, comprising:

an inputting step of inputting a wave signal representing a sound signal;

an acme detecting step for detecting a set of acmes of a waveform of the wave signal representing the sound signal; and a trigon extracting step for extracting a set of trigons in accordance with the set of acmes detected by the acme detecting step.

2. The method of claim 1, further comprising:

a smoothed point calculating step for calculating a set of smoothed points based on the set of acmes detected by the acme detecting step.

3. The method of claim 2, further comprising:

detecting from the set of smoothed points a new set of acmes; and extracting trigons based on the new set of acmes detected from the set of smoothed points.

4. The method of claim 3, further comprising: calculating a next set of smoothed points based on the acmes detected from the set of smoothed points.

5. The method according to claim 2, further comprising:

an energy level determining step for determining whether an energy level of the set of trigons extracted is higher than a preset value.

6. The method of claim 5, further comprising:

if it is determined in the energy level determining step that an energy level of a current set of trigons extracted is higher than the preset value, calculating a current set of smoothed points based on a current set of acmes detected;

detecting a next set of acmes from the current set of smoothed points; and extracting a next set of trigons based on the next set of acmes; and if it is determined in the energy level determining step that an energy level of the current set of trigons is not higher than the preset value, stopping calculating the current set of smoothed points.

7. The method of claim 1, wherein a trigon is extracted for each of the acmes.

8. The method of claim 7, wherein a trigon has a base line extending in parallel to the time axis and has a height, the time axis representing time as advancing from earlier to later in the direction of left to right.

9. The method of claim 8, wherein a left end of the base line of a trigon is at the time of the closest left neighboring acme of the current acme, for which the trigon is extracted, and a right end of the base line of the trigon is at the time of the closest right neighboring acme of the current acme, and the height of the trigon equals one half of the length of the projective line from the current acme to the line connecting the closest left and right neighboring acmes of the current acme.

10. The method of claim 9, further comprising:

an energy level determining step for determining whether an energy level of the set of trigons extracted is higher than a preset value.

11. The method of claim 5 or 10, wherein the energy level determining step determines the energy level of a set of trigons according to a width and a height of the trigons.

12. The method of claim 11, wherein the energy level determining step determines the energy level of a set of trigons according to an average width and an average height of the trigons.

13. The method of claim 11, wherein the energy level determining step determines the energy level of a set of trigons according to the smallest width and the greatest height of the trigons.

14. The method of claim 5 or 10, wherein the energy level determining step determines the energy level of a set of trigons according to the smallest width and the greatest height of the trigons.

15. The method of claim 10, further comprising:

if it is determined in the energy level determining step that an energy level of a current set of trigons extracted is higher than the preset value, calculating a current set of smoothed points based on a current set of acmes detected;

detecting a next set of acmes from the current set of smoothed points; and extracting a next set of trigons based on the next set of acmes; and if it is determined in the energy level determining step that an energy level of the current set of trigons is not higher than the preset value, stopping calculating a current set of smoothed points.

16. The method of claim 9, further comprising:

a smoothed point calculating step for calculating a set of smoothed points from a set of acmes, wherein a smoothed point is calculated for each of the acmes and a smoothed point calculated for an acme is at approximately the middle point of said projective line of the acme.

17. The method of claim 2 or 16, further comprising:

detecting a current set of acmes from a previous set of smoothed points;

extracting a current set of trigons based on the current set of acmes; and calculating a current set of smoothed points based on the current set of acmes.

18. The method of claim 16, further comprising:

detecting from the set of smoothed points a next set of acmes; and extracting trigons based on the next set of acmes detected from the set of smoothed points.

19. The method according to claim 16, further comprising:

an energy level determining step for determining whether an energy level of a set of trigons extracted is higher than a preset value.

20. The method of claim 19, further comprising:

if it is determined in the energy level determining step that an energy level of a previous set of trigons extracted is higher than the preset value, detecting a current set of acmes from a previous set of smoothed points;

extracting a current set of trigons based on the current set of acmes; and calculating a current set of smoothed points based on the current set of acmes; and if it is determined in the energy level determining step that an energy level of the previous set of trigons is not higher than the preset value, stopping detecting a current set of acmes.

21. The method of claim 19, wherein the energy level determining step determines the energy level of a set of trigons according to a width and a height of the trigons.

22. The method of claim 21, wherein the energy level determining step determines the energy level of a set of trigons according to an average width and an average height of the trigons.

23. The method of claim 21, wherein the energy level determining step determines the energy level of a set of trigons according to the smallest width and the greatest height of the trigons.

24. The method of claim 19, wherein the energy level determining step determines the energy level of a set of trigons according to the smallest width and the greatest height of trigons.

25. The method of claim 9, further comprising:

calculating a next set of smoothed points based on a next set of acmes.

26. The method according to claim 1, further comprising:

a signal dividing and selecting step for dividing the wave signal into sections, selecting sections that are appropriate for analysis, and sending selected sections to an acme detecting means.

27. The method of claim 26, wherein the signal dividing and selecting step selects the sections based on an energy level of the sections.

28. The method according to claim 1, further comprising the steps of:

detecting the wave signal as an analog signal; and converting the analog wave signal into digital wave signal.

29. The method according to claim 1, further comprising the step of:

reproducing the wave signal from a recording medium.

30. A device for analyzing a wave signal, comprising:

an input means for inputting a wave signal representing a sound signal;

an acme detecting means for detecting a set of acmes of a waveform of the wave signal representing the sound signal; and a trigon extracting means for extracting a set of trigons in accordance with the set of acmes detected by the acme detecting means.

* * * * *

UNITED STATES PATENT AND TRADEMARK OFFICE

CERTIFICATE OF CORRECTION

PATENT NO. : 7,251,596 B2 
APPLICATION NO. : 10/326104
DATED : July 31, 2007
INVENTOR(S) : Lianshan Zhu et al.

It is certified that error appears in the above-identified patent and that said Letters Patent is hereby corrected as shown below:

ON THE TITLE PAGE:
At Item (30), Foreign Application Priority Data, "Dec. 31, 2001 (CN) ……01 1 45305" should read --Dec. 31, 2001 (CN) ……01 1 45305.2--.

At Item (56), OTHER PUBLICATIONS,: "$C^{++}$Implementation" should read --$C^{++}$ Implementation-- and "Widely" should read --Wiley--.

IN THE DRAWINGS:
Sheet 26, Fig. 28, S2814, "uses" should read --using--.
Sheet 28, Fig. 29b, "get" should read --obtained--.
Sheet 30, Fig. 30b, "get" should read --obtained--.
Sheet 35, Fig. 35,

"

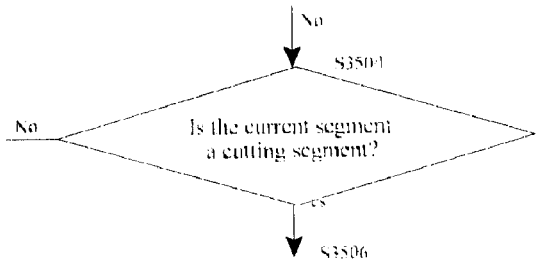

"

should read

--

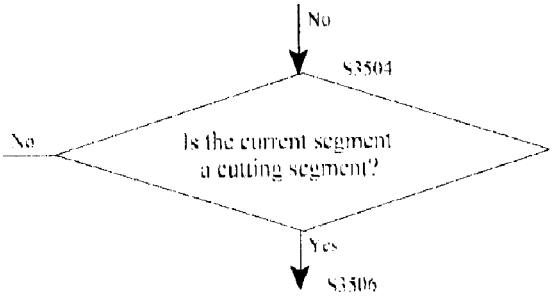

--.

UNITED STATES PATENT AND TRADEMARK OFFICE

CERTIFICATE OF CORRECTION

PATENT NO. : 7,251,596 B2
APPLICATION NO. : 10/326104
DATED : July 31, 2007
INVENTOR(S) : Lianshan Zhu et al.

It is certified that error appears in the above-identified patent and that said Letters Patent is hereby corrected as shown below:

IN THE DRAWINGS, Cont'd.:
Sheet 36, Fig. 36, S3615, "take" should read --taking--.
Sheet 36, Fig. 36, S3625, "If" should read --Does-- and "needs" should read --need--.

COLUMN 1:
Line 9, "a" (second occurrence) should read --and--.
Line 26, "pleased" should read --pleasant--.
Line 34, "features in that it" should be deleted.

COLUMN 2:
Line 15, "etc.)" should read --etc.).--.
Line 32, "sections" should read --section--.
Line 64, "the" (first occurrence) should be deleted.

COLUMN 3:
Line 19, "signal. In" should read --signal. ¶In--.

COLUMN 4:
Line 54, "to" should read --to the-- and "accompany" should read --accompanying--.
Line 55, "ing." should read --ings.--

COLUMN 6:
Line 42, "cuffing" should read --cutting--.
Line 46, "invention;" should read --invention.--.
Line 49, "EMBODIMENT" should read --EMBODIMENTS--.
Line 52, "defined" should read --defined as--.
Line 66, "width (nWidth):" should read --its width (nWidth),--.

COLUMN 7:
Line 57, "and comparing" (second occurrence) should be deleted.
Line 59, "height," should read --height.--.
Line 61, "hear.If" should read --hear. If--.
Line 66, "do" should read --does--.

COLUMN 8:
Line 7, "in" should be deleted.
Line 49, "etc." should read --etc.,--.

UNITED STATES PATENT AND TRADEMARK OFFICE

CERTIFICATE OF CORRECTION

PATENT NO. : 7,251,596 B2
APPLICATION NO. : 10/326104
DATED : July 31, 2007
INVENTOR(S) : Lianshan Zhu et al.

It is certified that error appears in the above-identified patent and that said Letters Patent is hereby corrected as shown below:

COLUMN 9:
Line 15, “trigons,”. should read --trigons.”--.
Line 18, “FIG. 8).” should read --FIG. 8.--.
Line 29, “etc.)” should read --etc.).--.
Line 32, “(nWidth) etc.” should read --(nWidth), etc.,--.

COLUMN 10:
Line 48, “to” should be deleted.
Line 49, “i.e” should read --i.e.,--.
Line 52, “appears” should read --appear--.
Line 65, “pointed” should read --points--.

COLUMN 11:
Line 31, “the” should read --The--.
Line 47, “method” should read --methods--.
Line 49, “invention.”” should read --invention.--.

COLUMN 12:
Line 5, “e.g.” should read --e.g.,--.
Line 10, “etc)” should read --etc.)--.
Line 52, “to” should be deleted.
Line 54, “i.e.” should read --i.e.,-- and “trigons,” should read --trigon,--.
Line 55, “trigons,” should read --trigon,-- and “vise” should read --vice--.
Line 58, “Ti.iTime+Ti.nWidth==$T_{i+1}$.iCenterTime.” should read --Ti.iTime+Ti.nWidth≈$T_{i+1}$.iCenterTime.--.

COLUMN 13:
Line 4, “results” should read --results.--.

COLUMN 14:
Line 27, “shown” should read --shown in--.
Line 44, “i.e.” should read --i.e.,--.
Line 45, “give” should read --given--.
Line 53, “heights” should read --heights of--.

UNITED STATES PATENT AND TRADEMARK OFFICE

CERTIFICATE OF CORRECTION

PATENT NO. : 7,251,596 B2
APPLICATION NO. : 10/326104
DATED : July 31, 2007
INVENTOR(S) : Lianshan Zhu et al.

It is certified that error appears in the above-identified patent and that said Letters Patent is hereby corrected as shown below:

COLUMN 15:
Line 13, “be” should read --been--.
Line 62, “smaller” should read --smaller than--.
Line 64, “to” should be deleted.

COLUMN 16:
Line 3, “between” should be deleted.
Line 30, “1/11025X” should read --1/11025--.

COLUMN 17:
Line 9, “take” should read --takes--.
Line 57, “smaller” should read --smaller than--.
Line 59, “to” should be deleted.
Line 66, “between” should be deleted.

COLUMN 18:
Line 24, “trigons contain” should read --trigon contains--.
Line 28, “stating” should read --starting--.
Line 34, “to” should be deleted.
Line 35, “i.e.” should read --i.e., --, and “trigons,” should read --trigon,--.
Line 36, “trigons,” should read --trigon,-- and “vise” should read --vice--.
Line 38, “Ti.iTime+Ti.nWidth==$T_{i+1}$” should read --Ti.iTime+TI.nWidth≈$T_{i+1}$--.
Line 62, “point” should read --point of--.
Line 64, “point” should read --point of--.

COLUMN 19:
Line 3, “point” (second occurrence) should read --point of--.
Line 6, “point” should read --point of--.
Line 12, “trigon” should read --trigons--.
Line 14, “above described “ should read --above-described--.
Line 15, “have” should read --having--.
Line 19, “above” should read --above- --.
Line 20, “have” should read --having--.
Line 22, “have” should read --having--.
Line 49, “on” should read --one--.

UNITED STATES PATENT AND TRADEMARK OFFICE

CERTIFICATE OF CORRECTION

PATENT NO. : 7,251,596 B2
APPLICATION NO. : 10/326104
DATED : July 31, 2007
INVENTOR(S) : Lianshan Zhu et al.

It is certified that error appears in the above-identified patent and that said Letters Patent is hereby corrected as shown below:

COLUMN 21:
Line 22, “and” should read --a--.
Line 26, “approximate” should read --approximately--.
Line 35, “and” (first occurrence) should read --a--.
Line 38, “itself” should read --itself.--.
Line 59, “that” should read --that are--.

COLUMN 22:
Line 13, “the” (first occurrence) should be deleted.
Line 19, “should” should read --should be--.
Line 34, “propose” should read --purpose--.
Line 49, “parts” should read --part--.
Line 63, “section,” should read --sections,--.

COLUMN 23:
Line 18, “invention” should read --invention.--.
Line 26, “Step” should read --step--.
Line 57, “ized” should read --ize--.

COLUMN 24:
Line 48, “an” should read --a--.
Line 55, “word,” should read --words,--.
Line 67, “mined” should read --mine--.

COLUMN 25:
Line 5, “TA–1.0” should read --TA=1.0--.
Line 7, “return” should read --returns--.
Line 27, “gap≈0,” should read --gap $\neq$ 0,--.
Line 36, “if” should read --If--.
Line 64, “exist” should read --exists--.

COLUMN 26:
Line 26, “part,” should read --part--.
Line 27, “dividing.” should read --divided--.
Line 50, “a” (third occurrence) should read --of--.
Line 51, “file ,” should read --file,--.
Line 63, “area,” should read --areas,--.

UNITED STATES PATENT AND TRADEMARK OFFICE

CERTIFICATE OF CORRECTION

PATENT NO. : 7,251,596 B2
APPLICATION NO. : 10/326104
DATED : July 31, 2007
INVENTOR(S) : Lianshan Zhu et al.

It is certified that error appears in the above-identified patent and that said Letters Patent is hereby corrected as shown below:

COLUMN 27:
Line 32, “segmenting” should read --dividing--.
Line 34, “forth,” should read --fourth,--.
Line 42, “compare” should read --compares--.
Line 49, “area(step” should read --area (step--.
Line 53, “old” should read --olds--.
Line 57, “TS1>the score≤TS2,” should read --TS1>the score≥TS2,--.

COLUMN 28:
Line 8, “peaks” should read --peak--.

Signed and Sealed this

Twentieth Day of May, 2008

JON W. DUDAS
*Director of the United States Patent and Trademark Office*